US012042746B2

(12) United States Patent
Atwood, III

(10) Patent No.: US 12,042,746 B2
(45) Date of Patent: Jul. 23, 2024

(54) INTERCONNECTING BUILDING TOY AND TRACK

(71) Applicant: ATWOOD ROPE MFG, Millersport, OH (US)

(72) Inventor: Curtis Dale Atwood, III, Millersport, OH (US)

(73) Assignee: ATWOOD ROPE MFG, Millersport, OH (US)

( * ) Notice: Subject to any disclaimer, the term of this patent is extended or adjusted under 35 U.S.C. 154(b) by 203 days.

(21) Appl. No.: 17/438,063

(22) PCT Filed: Mar. 13, 2020

(86) PCT No.: PCT/US2020/022627

§ 371 (c)(1),
(2) Date: Sep. 10, 2021

(87) PCT Pub. No.: WO2020/186157

PCT Pub. Date: Sep. 17, 2020

(65) Prior Publication Data

US 2022/0016540 A1 Jan. 20, 2022

Related U.S. Application Data

(60) Provisional application No. 62/889,777, filed on Aug. 21, 2019, provisional application No. 62/817,712, filed on Mar. 13, 2019.

(51) Int. Cl.
*A63H 33/10* (2006.01)
*A63F 9/28* (2006.01)

(52) U.S. Cl.
CPC ..... *A63H 33/101* (2013.01); *A63F 9/28* (2013.01)

(58) Field of Classification Search
CPC ..... A63H 33/062; A63H 33/101
See application file for complete search history.

(56) References Cited

U.S. PATENT DOCUMENTS 4,740,185 A 4/1988 Inglee
9,895,623 B2 * 2/2018 Cochella ..... A63H 33/101
(Continued)

FOREIGN PATENT DOCUMENTS

GB 193457 2/1923
WO 2016111721 7/2016

OTHER PUBLICATIONS

Patent Cooperation Treaty (PCT), International Search Report and Written Opinion for Application PCT/US2020/022627 filed Mar. 13, 2020 mailed Jun. 9, 2020, International Searching Authority, US.

*Primary Examiner* — John A Ricci
(74) *Attorney, Agent, or Firm* — McDonald Hopkins LLC

(57) ABSTRACT

Provided is a toy building system. The toy building system may comprise one or more of interconnecting tiles, flat tiles, arcs, line reactors, clips, tracks, rotatable tracks, split tracks, launchers and other pieces that are adaptable to connect in a multitude of configurations and may be set up in sequence to create a chain reaction of falling as in dominos. Various types of tiles or "falling units" may be utilized, including line reactors, arcs, or tiles having a multitude of different mating components and orientations including an interconnecting orientation and a flat orientation. The domino tile may further connect to other pieces of the toy building system including an arc or a rapid track builders including a track and a clip. The tiles, independently set up, as a part of the arc, or as a part of the rapid track and/or line reactors may be positioned so as to create a domino effect when a force is applied thereto, such as a force applied by a launcher. The various components and interconnectability
(Continued)

between components allow for limitless configurations as building blocks and as a domino show.

19 Claims, 49 Drawing Sheets

(56) References Cited

U.S. PATENT DOCUMENTS

| | | | | |
|---|---|---|---|---|
| 10,493,371 | B2 * | 12/2019 | Cochella | A63H 33/101 |
| 2010/0173557 | A1 | 7/2010 | Saucedo | |
| 2010/0330867 | A1 * | 12/2010 | Fogel | A63H 33/062<br>446/124 |
| 2013/0095722 | A1 | 4/2013 | Cochella | |
| 2014/0045403 | A1 * | 2/2014 | Murphy | A63H 33/101<br>446/124 |
| 2019/0240591 | A1 * | 8/2019 | Koczwara | A63H 33/044 |

* cited by examiner

FIG. 2B
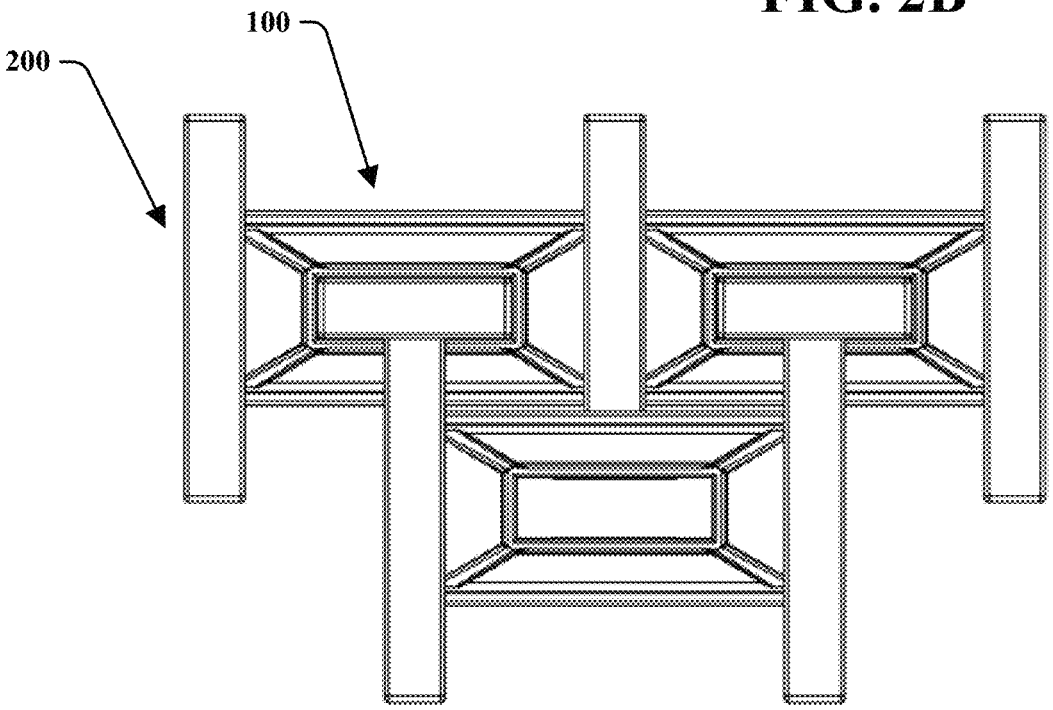
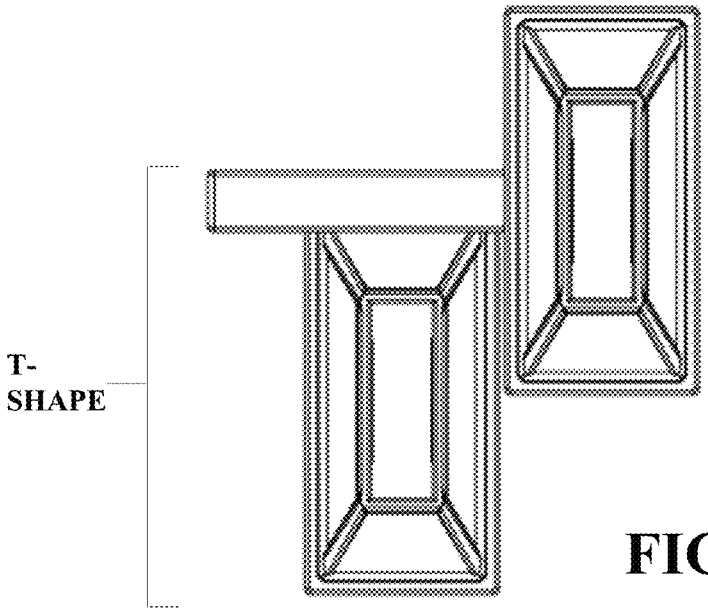
FIG. 2C

FIG. 13B
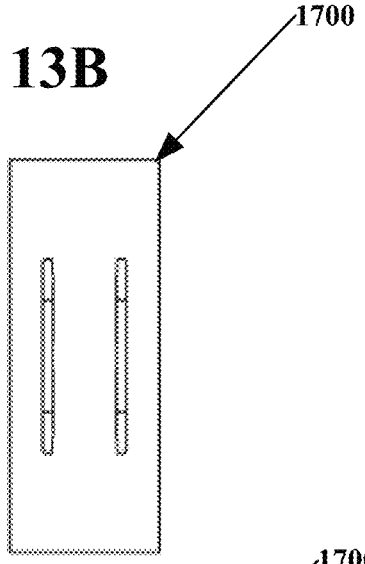
FIG. 13C
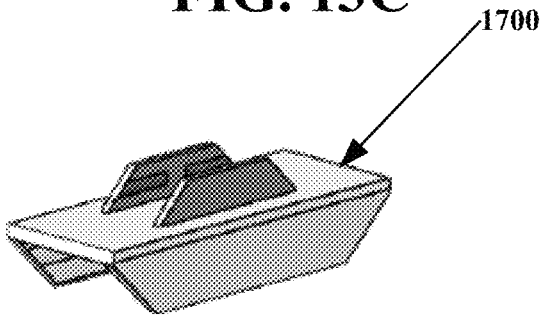
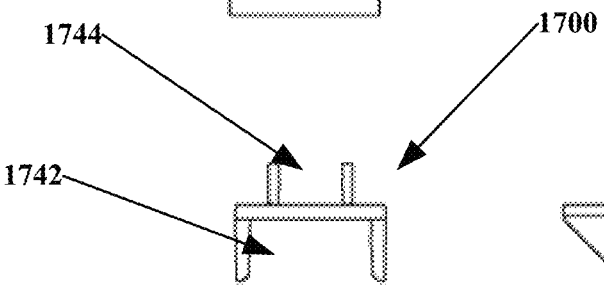
FIG. 13D
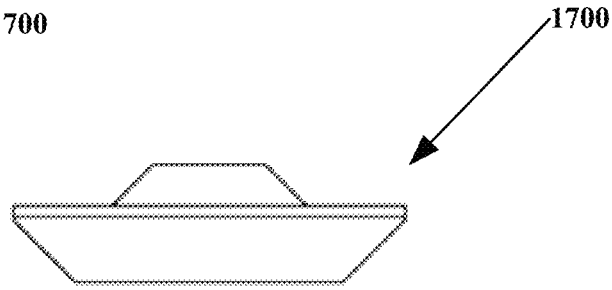
FIG. 13E

INTERCONNECTING BUILDING TOY AND TRACK

CROSS-REFERENCE TO RELATED APPLICATIONS

This application is a 35 U.S.C. 371 national stage filing of PCT Application No. PCT/US2020/022627 filed on Mar. 13, 2020, which claims the priority to U.S. Provisional Application No. 62/889,777 filed on Aug. 21, 2019 and U.S. Provisional Patent App. No. 62/817,712 filed on Mar. 13, 2019 and entitled "Interconnecting Building Toy," each of which are incorporated herein by reference in their entireties.

FIELD OF THE INVENTION

The present disclosure relates generally to toy building pieces and, more particularly, to interconnecting blocks, tiles, arcs, line reactors, clips, tracks, and other pieces that are adaptable to connect in a multitude of configurations and angles and may be set up in sequence to create a chain reaction of falling as in dominos.

SUMMARY

The following presents a summary of this disclosure to provide a basic understanding of some aspects. This summary is not intended to identify key or critical elements or define any limitations of embodiments or claims. Furthermore, this summary may provide a simplified overview of some aspects that may be described in greater detail in other portions of this disclosure.

Disclosed is a toy building system. The toy building system may comprise one or more of interconnecting tiles, flat tiles, arcs, line reactors, clips, tracks, rotatable tracks, split tracks, launchers, and other pieces that are adaptable to connect in a multitude of configurations and may be set up in sequence to create a chain reaction of falling as in dominos. In an embodiment, an interconnecting tile may include multiple mating components so as to connect to another tile in a multitude of configurations. Various types of tiles or "falling units" may be utilized, including line reactors, arcs, or tiles having a multitude of different mating components and orientations including an interconnecting orientation and a flat orientation. The tile may further connect to other pieces of the building system including an arc or a rapid track builder including a track and a clip. In an embodiment, the track may be rotatable or may be a splitter that multiples the number of lanes of tiles. The tiles, independently set up, as a part of the arc, or as a part of the rapid track and/or line reactors may be positioned so as to create a domino effect when a force is applied thereto, such as a force applied by a launcher. The launcher, such as that which launches an object like a ball, may be used to knock down or begin a falling sequence. In an embodiment, the launcher may be initiated by the user or by a falling tile, arc, line reactor, etc. The various components and interconnectability between components allow for limitless configurations as building blocks and as a domino show or Rube Goldberg machine.

In an embodiment, a toy building system may comprise a plurality of tiles, wherein each tile may include at least one mating edge; a plurality of clips, wherein each clip may comprise a receiving portion configured to selectively receive the at least one mating edge of the tiles and may further comprise an engagement portion; and a plurality of tracks, wherein each track may comprise at least one receiving portion configured to selectively engage the engagement portion of the clips and may further comprise connecting portions. In an embodiment, the connecting portions may be configured to selectively connect the plurality of tracks. In an embodiment, the tracks may be rotatable about an axis defined by the selective connection of the connecting portions. In an embodiment, the plurality of clips may be rotatable about an axis defined by the selective engagement of the clips to the tracks.

The mating edge may be a width edge. The selective attachment between the plurality of tiles and the plurality of clips may be friction-fit. The receiving portion of each clip may include a base, a first wall and a second wall extending from the base, and a receiving space between the first wall and the second wall. The engagement portion of each clip may include more than one protrusions extending from the clip.

The receiving portion of each track may include a base, a first arm and a second arm extending from the base, and a receiving space between the first arm and the second arm. The first arm and second arm of the receiving portions of the track each may include a recess configured to selectively engage the more than one protrusions extending from each clip. It is noted that the reverse is also possible where the receiving portion of the track may include a protrusion that engages a recess on the clip. The selective engagement between the plurality of clips and plurality of tracks may be snap-fit engagement.

The connecting portions of each track may include a protrusion on a first end of the track and a recess on a second end of the track, wherein the protrusion of the first end of one track may be is configured to connect to the recess on the second end of another track. The selective connection between the plurality of tracks may be a snap-fit connection. The connection between the plurality of tracks may be rotatable by up to about 180°.

The plurality clips may be rotatable from a first standing position to a second falling position. The transition of one clip from the standing to the falling positions may cause subsequent clips to transition from the standing to the falling positions by contact through attached tiles. A right angle track may include at least two receiving portions positioned at about a right angle from each other. A first end of first track may be configured to selectively connect to a second end of at least a second and a third track. The second and the third tracks may be adjacent or separated by an angle up to about 180°.

In an embodiment, a toy building system may comprise at least two tiles, wherein each tile may be configured to selectively attach to a corresponding clip, wherein each clip may be configured to selectively and rotatably attach to a corresponding track, and wherein a plurality of tracks may be configured to selectively and rotatably attach to each other. The clips may be rotatable from a first standing position to a second falling position. The tracks may be rotatable by up to about 180°. The transition of one clip from the standing to the falling positions may cause subsequent clips to transition from the standing to the falling positions by contact through attached tiles. The clips may be rotatable from a first falling position to a second standing position by tilting the toy building system backward in a direction of the standing position. The toy building system may further comprise at least one straight track and an additional clip, wherein the straight track may be selectively attachable to at least one of the plurality of tracks wherein at least one of the additional clip may be selectively attachable to the straight track.

Disclosed is a toy building system that comprises a plurality of tiles or blocks, each having a base plate, a first face, and a second face. The base plate of the tile has at least one length edge and at least one width edge, where the width edge may also serve as a mating portion of the tile. At least one of the first or the second face may be open and comprise a recess or hollow cavity. Within the recess may be a projection or receiving portion adapted to receive a mating portion of a second tile. When the projections of a first tile are connected to the mating portion of a second tile, the resulting shape is a t-configuration. The projections on each the first and/or the second face may be the same as or different than one another. In an embodiment, the toy building system comprises variously sized tiles including a standard tile and a mini tile.

In an embodiment, a toy building system further comprises a straight clip. The straight clip has two receiving portions that are adapted to receive an edge of a tile and may connect at least two tiles in a straight orientation, where the tiles are in the same plane. Each receiving portion of the straight clip may attach to either the lengthwise or widthwise edge of the tile. The straight clip may be used to connect two tiles by a length of each tile, by a width of each tile, or by a length of one tile and a width of another tile. When the edge of a first tile is connected to the edge of a second tile by the straight clip, the resulting shape is a line configuration. In an embodiment, multiple tiles may be attached into each receiving portion of the straight clip.

In an embodiment, a toy building system further comprises a cross-hatch clip. The cross-hatch clip has two receiving portions that are adapted to receive an edge of a tile and may connect at least two tiles in a perpendicular orientation, where the tiles are in perpendicular planes. Each receiving portion of the cross-hatch clip may attach to either the lengthwise or widthwise edge of the tile. The cross-hatch clip may be used to connect two tiles by a length of each tile, by a width of each tile, or by a length of one tile and a width of another tile. When the edge of a first tile is connected to the edge of a second tile by the cross-hatch clip, the resulting shape is an x-configuration. In an embodiment, multiple tiles may be attached into each receiving portion of the cross-hatch clip.

In an embodiment, a toy building system further comprises a three-way clip. The three-way clip has three receiving portions that are adapted to receive an edge of a tile and may connect at least three tiles. Each receiving portion of the three-way clip may attach to either the lengthwise or widthwise edge of the tile. The three-way clip may be used to connect three tiles in any combination of lengths or widths of the tiles. In an embodiment, multiple tiles may be attached into each receiving portion of the three-way clip.

In an embodiment, a toy building system further comprises a four-way clip. The four-way clip has four receiving portions that are adapted to receive an edge of a tile and may connect at least four tiles. Each receiving portion of the four-way clip may attach to either the lengthwise or widthwise edge of the tile. The four-way clip may be used to connect four tiles in any combination of lengths or widths of the tiles. In an embodiment, multiple tiles may be attached into each receiving portion of the four-way clip.

In an embodiment, a toy building system further comprises a right-angle clip. The right-angle clip has two receiving portions that are adapted to receive an edge of a tile and may connect at least two tiles at a right angle. Each receiving portion of the right-angle clip may attach to either the lengthwise or widthwise edge of the tile. The right-angle clip may be used to connect two tiles by a length of each tile, by a width of each tile, or by a length of one tile and a width of another tile. When the edge of a first tile is connected to the edge of a second tile by the right angle clip, the resulting shape is an L-configuration or 90° angle. In an embodiment, multiple tiles may be attached into each receiving portion of the right-angle clip.

In an embodiment, a toy building system further comprises a 45-angle clip. The 45-angle clip has two receiving portions that are adapted to receive an edge of a tile and may connect at least two tiles in at a 45° angle. Each receiving portion of the 45-angle clip may attach to either the lengthwise or widthwise edge of the tile. The 45-angle clip may be used to connect two tiles by a length of each tile, by a width of each tile, or by a length of one tile and a width of another tile. When the edge of a first tile is connected to the edge of a second tile by the 45-angle clip, the resulting shape is a 45° angle. In an embodiment, multiple tiles may be attached into each receiving portion of the 45-angle clip.

In an embodiment, a toy building system further comprises a twisted tile. The twisted tile includes two mating portions at each of its widths. Unlike a general tile where each edge is in the same orientation and all sides are on the same plane, the twisted tile has a twist in its body such that the widthwise edges of the tile are in perpendicular planes.

In an embodiment, a toy building system further comprises a rotatable tile. The rotatable tile has a rotating portion along a mid-section of a base plate and at least one width edge or mating portion. The mating portion may attach to another tile or the receiving portion of a clip.

In an embodiment, a toy building system further comprises a wheel tile. The wheel tile includes a wheel having a first face and a second face. On one or both of the faces, the wheel tile may include at least one projection adapted to receive the width or mating portion of another tile. On one or both of the faces, the wheel tile may itself include a mating portion adapted to fit within the projection of another tile or the receiving portion of a clip. The mating portion may have a substantially similar shape as an edge of a tile.

In an embodiment, a toy building system further comprises an adapter tile. The adaptor tile includes a base plate, a first face, and a second face. The first face may include a plurality of projections or mating portions. The projections may be of any suitable shape and positioned in any suitable orientation. For example, the projections may be square, rectangular, ovular, or irregular. Two, three, four, five, etc. projections may be positioned on the first face of the adapter tile in any orientation suitable to receive a mating portion in a space provided. In an embodiment, each projection is circular. In an embodiment, at least four projections are positioned apart from one another in the shape of a square. The first face may include one, two, three, four etc. sets of projections so as to comprise multiple mating portions. The second face may be open and comprise a recess or hollow cavity. Within the recess may be a projection or receiving portion operatively attachable to the projections or mating portion of a second adaptor tile. When the mating portion of a first adaptor tile is connected to the receiving portion of a second adaptor tile, the first face of the first adaptor tile and the second face of the second adaptor tile may be in surface contact.

In an embodiment, the adaptor tile may be shaped to fit within a projection on a second face of a standard tile. For example, the thickness of the adaptor tile may generally correlate to the depth of the standard tile projection, and the length and width of the adaptor tile may generally correlate to the length and width of the projection on the standard tile. The adaptor tile may operatively fit within the projection of a standard tile by the adaptor tile's first face or second face. For example, the first face of the adaptor tile may fit into the projection of the standard tile and the second face or receiving portion of the adaptor tile may thereby be exposed. Additionally, the second face of the adaptor tile may fit into the projection of the standard tile and the first face or mating portion of the adaptor tile may thereby be exposed. The adaptor tiles may be used to connect two faces of two standard tiles, when the corresponding mating portions and receiving portions of the two adaptor tiles are exposed when connected to each standard tile. In an embodiment, the base plate of the adaptor tile may be discontinuous and have a hole in a middle of the adaptor tile so as to facilitate removal of the adaptor tile from the standard tile, for example.

In an embodiment, a toy building system further comprises a mini tile. The mini tile may have the same mating portions and projections as a standard tile and two mini tiles may interact in the same manner as two standard tiles. For example, a width edge of the mini tile may serve as a mating portion and operatively insert into a projection or receiving portion of a second mini tile. In an embodiment, the mini tile may be sized to interact and operatively attach to a standard tile. For example, the thickness of the mini tile may generally correspond to the width of the projection or receiving portion of the standard tile and the length edge of the mini tile may correspond to the projection or receiving portion of the standard tile. As a result, the length edge of the mini tile may serve as a mating portion and operatively fit within the projection of the standard tile. In another embodiment, various clips as described above may be provided with receiving portions that generally correspond to the thickness and other dimensions of the mini tile. Each clip, such as the straight clip, cross-hatch-clip, three-way clip, four-way clip, right-angle clip, and 45-angle clip may have receiving portions for only the standard tile, for only the mini tile, for both the standard tile and mini tile on a single clip, and/or for both in an embodiment where the thicknesses are interchangeable.

The following description and the drawings disclose various illustrative aspects. Some improvements and novel aspects may be expressly identified, while others may be apparent from the description and drawings.

BRIEF DESCRIPTION OF THE DRAWINGS

The present teachings may be better understood by reference to the following detailed description taken in connection with the following illustrations, wherein:

FIGS. 2A-C show an embodiment of a toy building system;

FIGS. 13A-E show an embodiment of a toy building system including a mini tile, a standard tile, and a clip configured to attach to the mini tile and standard tile;

FIGS. 32A-F show non-limiting angular positions of an embodiment of a launcher.

DETAILED DESCRIPTION

Figure 1A:
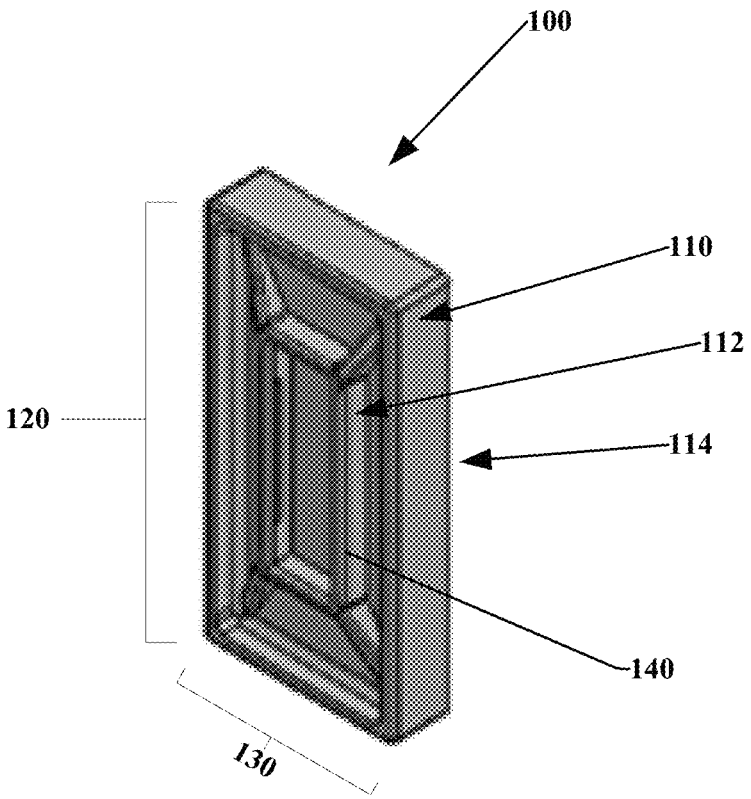
FIGS. 1A-B show an embodiment of a first tile in a toy building system.

Reference will now be made in detail to exemplary embodiments of the present teachings, examples of which are illustrated in the accompanying drawings. It is to be understood that other embodiments may be utilized and structural and functional changes may be made without departing from the respective scope of the present teachings. Moreover, features of the various embodiments may be combined or altered without departing from the scope of the present teachings. As such, the following description is presented by way of illustration only and should not limit in any way the various alternatives and modifications that may be made to the illustrated embodiments and still be within the spirit and scope of the present teachings. In this disclosure, numerous specific details provide a thorough understanding of the subject disclosure. It should be understood that aspects of this disclosure may be practiced with other embodiments not necessarily including all aspects described herein, etc.

As used herein, the words "example" and "exemplary" means an instance, or illustration. The words "example" or "exemplary" do not indicate a key or preferred aspect or embodiment. The word "or" is intended to be inclusive rather than exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Further, unless context suggest otherwise, descriptions of shapes (e.g., circular, rectangular, triangular, etc.) refer to shapes meeting the definition of such shapes and general representation of such shapes. For instance, a triangular shape or generally triangular shape may include a shape that has three sides and three vertices or a shape that generally represents a triangle, such as a shape having three major sides that may or may not have straight edges, triangular like shapes with rounded vertices, etc.

While embodiments may refer to a particular example of the described toy building system as having a particular attachment between tiles, arcs, line reactors, clips, or tracks, it is noted that many other orientations and attachments may be possible as many of the pieces are interchangeable or can connect to another piece in multiple variations. It is also noted that the various pieces may be modified to include additional repeated aspects as desired. While the embodiments may refer to a particular game application, it is noted that disclosed embodiments may be suitable for users of any age and may be applicable to various other uses, products, and industries. Generally, described embodiments may be utilized for any application that incorporates tiles, rotation, building, dominos, etc. As an example, while the building system may apply to setting up dominos or a Rube Goldberg machine, the building systems may be utilized as 3-D puzzles, as a board game, to build specific instructed shapes or patterns (as in building blocks or as fallen dominos), as well as the freehand building.

Disclosed is a toy building system that comprises interconnecting blocks, tiles, arcs, line reactors, clips, tracks, launchers, rotatable components, wheels, and/or other pieces that are adaptable to connect to or interact with each other in a multitude of configurations and angles. The various pieces are interchangeable and generally comprise similar dimensions in their mating and receiving portions so as to connect the pieces in innumerable orientations.

Figure 1B:
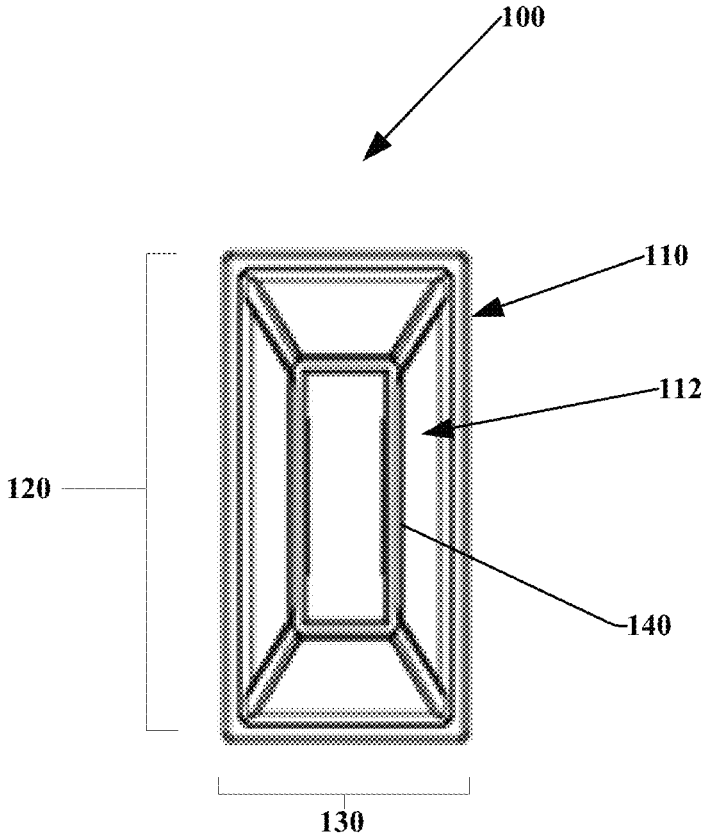
Figure 13A:
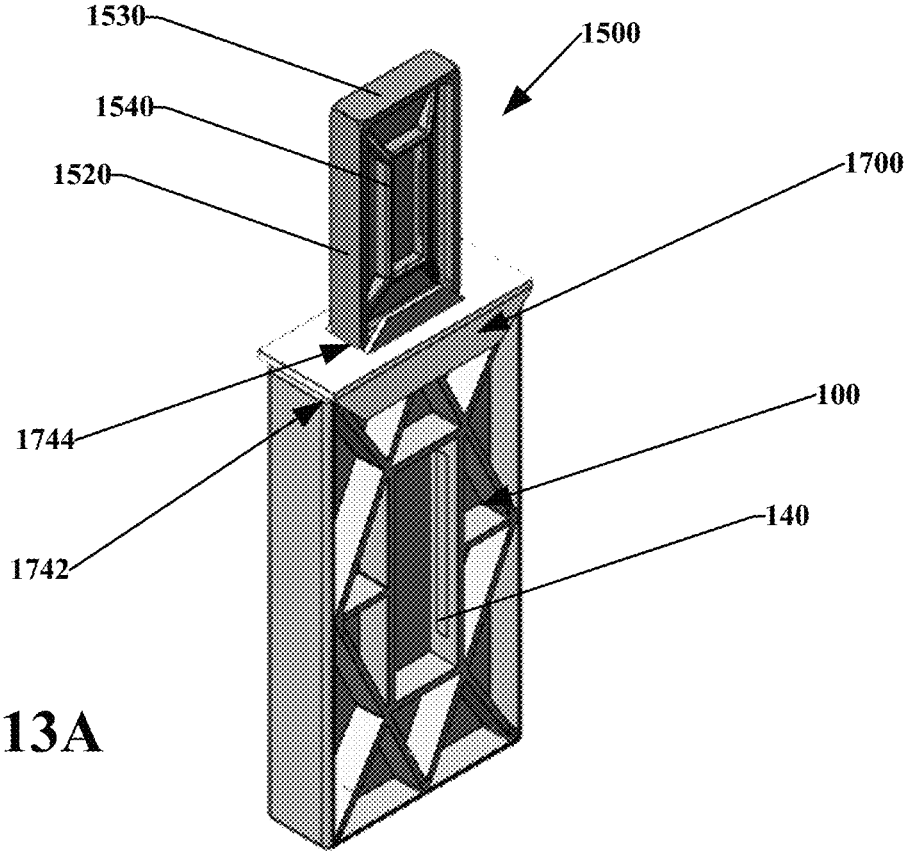
Figure 14A:
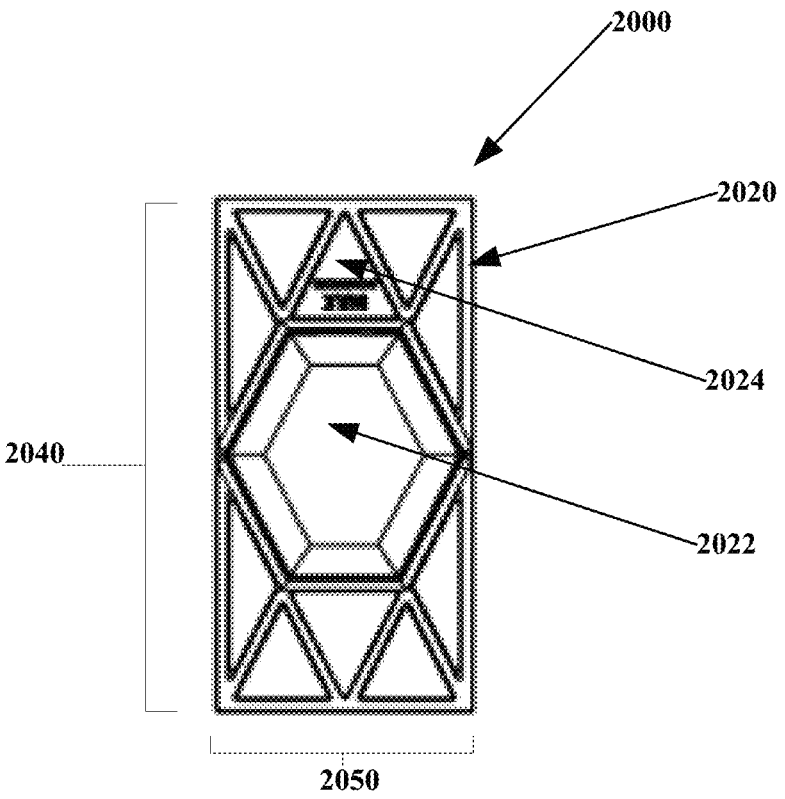
FIGS. 14A-E show an embodiment of a second tile in a toy building system.

FIGS. 1A and 1B depict perspective and front views of a tile or block 100 to be used in a toy building system. In an embodiment, the toy building system comprises variously sized tiles including a standard tile 100 and a mini tile 1500, shown in FIG. 13A. In an embodiment, the toy building system comprises tiles including various engageable aspects such as a first tile 100 and a second tile 2000, shown in FIG. 14A.

Figure 2A:
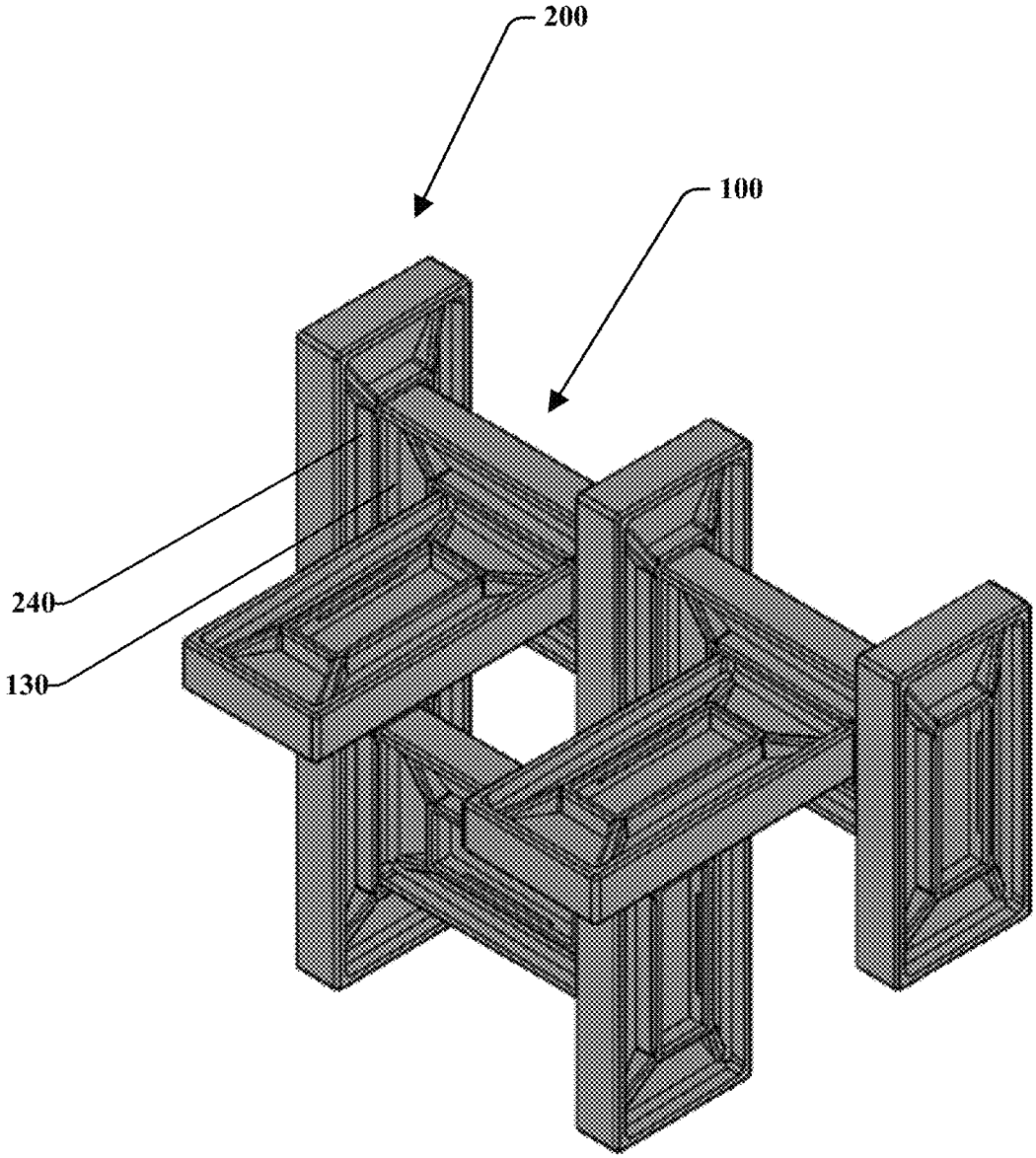

In an embodiment, the tile 100 comprises a base plate 110, a first face 112, and a second face 114. The base plate 110 of the tile 100 has at least one length edge 120 and at least one width edge 130, where the width edge 130 may also serve as a mating portion of the tile 100. While the described embodiments generally refer to the width edge and mating portion as the same aspect 130, it is noted that the length edge or any other edge of a tile could also serve as a mating portion, as may be the case, for instance, between a mini tile 1500 and a standard tile 1000. At least one of the first 112 or the second face 114 of the tile 100 is open and comprises a recess or hollow cavity. Within the recess of the tile 100 is a projection or receiving portion 140 adapted to receive a mating portion 230 of a second tile 200, which generally corresponds to a width edge of the second tile 200, as shown in FIGS. 2A-2C. It is also noted that other engageable aspects may be provided to selectively attach two or more tiles, including, for instance, that shown in the second tile 2000.

FIG. 2A depicts a perspective view of a plurality of tiles 100, 200 arranged such that a mating portion or width edge 130 of a first tile 100 is inserted into the projection 240 of a second tile 200. When the projections and mating portions of two tiles are connected, the resulting shape is a t-configuration, as partially illustrated in FIG. 2C. The projections on each the first and/or the second face may be the same as or different than one another. Both the first tile 100 and second tile 200 may receive a mating portion of a third tile or itself may be inserted into a projection of a fourth tile, and so on and so on. In an embodiment, each tile has the ability to be inserted into the projections of two separate blocks, by virtue of the two width edges, and may receive the mating portions of two separate blocks, by virtue of a projection on each face of the tile. While the figures generally depict rectangular tiles with these aspects, it is noted that the tiles may comprise any shape, with any number or dimensions of width edges and with any number of projections on its faces. For example, the tile might have three, four, five, six, or more sides of different or equal lengths or widths. The tile might have one, two, three, four, or more sized projections on each face to accommodate these various sides of the tiles.

FIGS. 3A-D depict an embodiment of the toy building system further comprising a straight clip 300. The straight clip 300 has two receiving portions 342, 344 that are adapted to receive an edge of a tile 120, 130 and may connect at least two tiles 100, 200 in a straight orientation, where the tiles are in the same plane. Each receiving portion 342, 344 of the straight clip 300 may attach to either the lengthwise 120, 220 or widthwise 130, 230 edge of the tile 100, 200. The straight clip 300 may be used to connect two tiles 100, 200 by a length 120, 220 of each tile, by a width 130, 230 of each tile, or by a length 120, 220 of one tile and a width 130, 230 of another tile. When the edge 120, 130 of a first tile 100 is connected to the edge 220, 230 of a second tile 200 by the straight clip 300, the resulting shape is a line configuration.

Figure 3A:
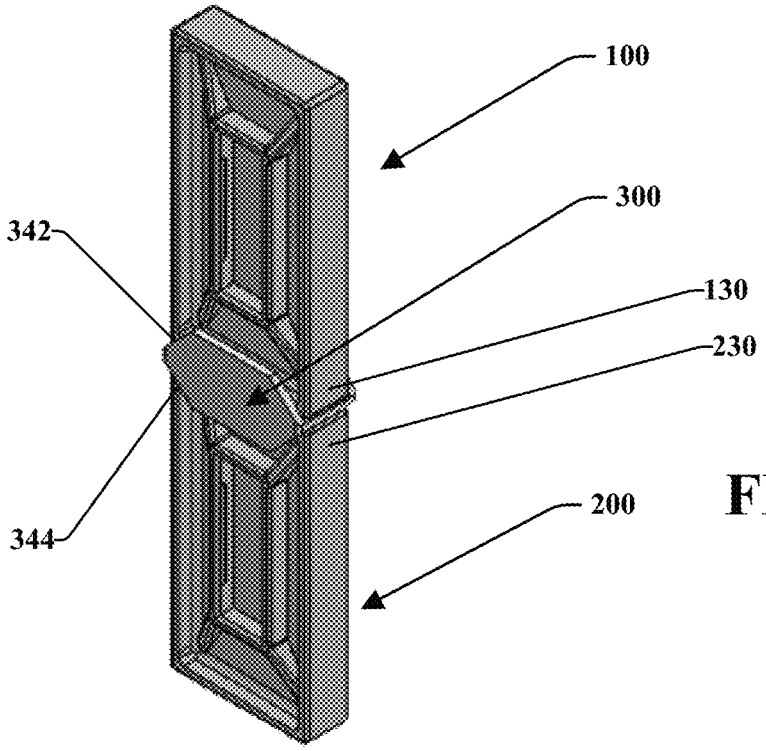
FIGS. 3A-B show an embodiment of a toy building system including a straight clip.
Figure 3B:
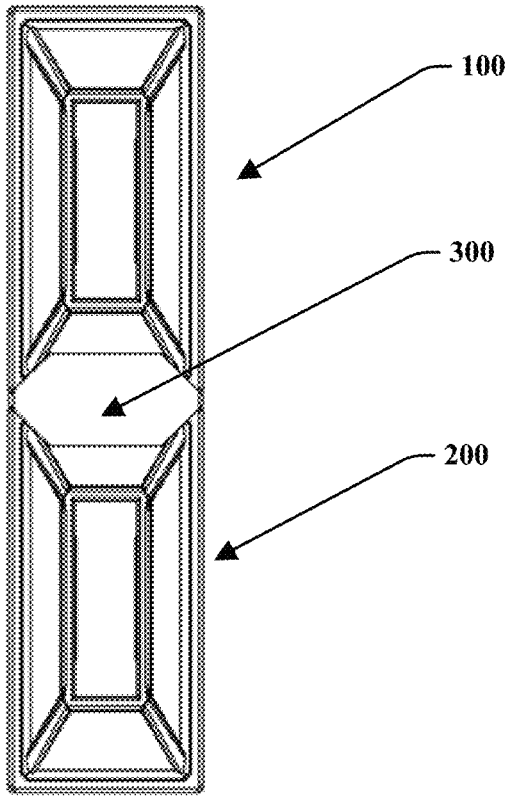
Figure 3C:
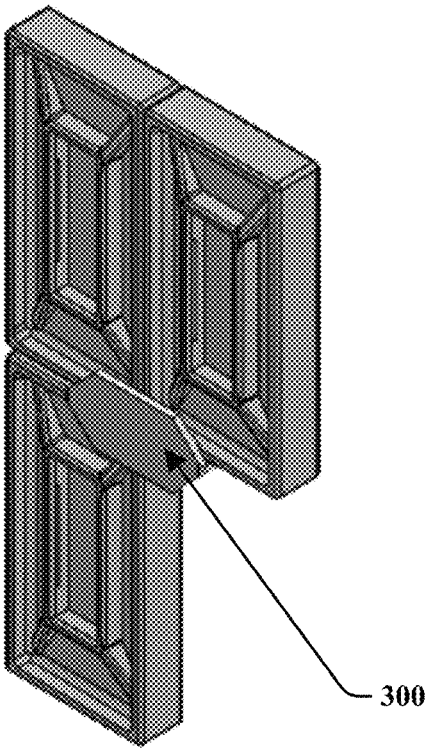
FIGS. 3C-D show an embodiment of a toy building system including a straight clip.
Figure 3D:
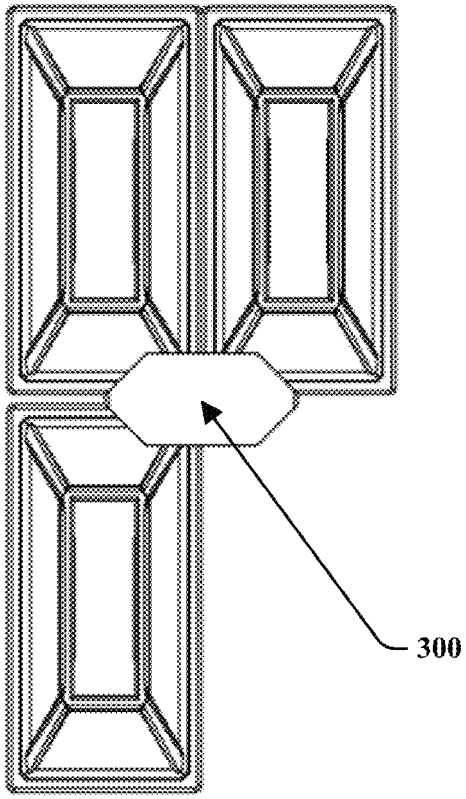
Figure 4A:
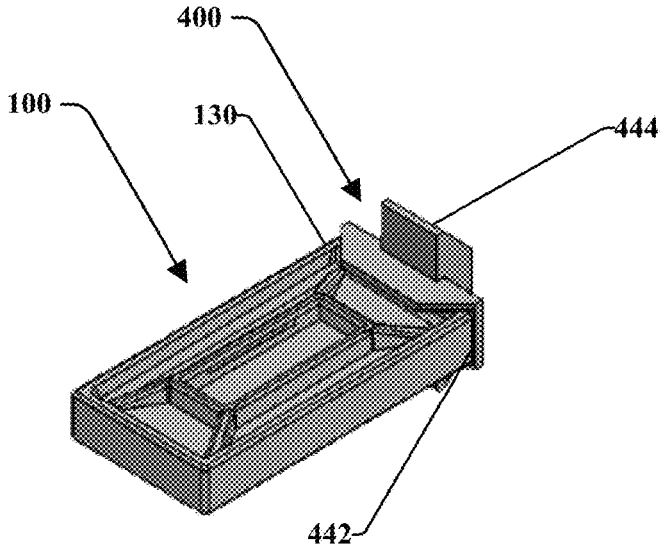
FIGS. 4A-D shoe an embodiment of a toy building system including a cross-hatch clip.
Figure 4B:
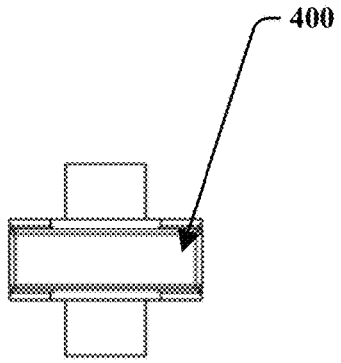
Figure 4C:
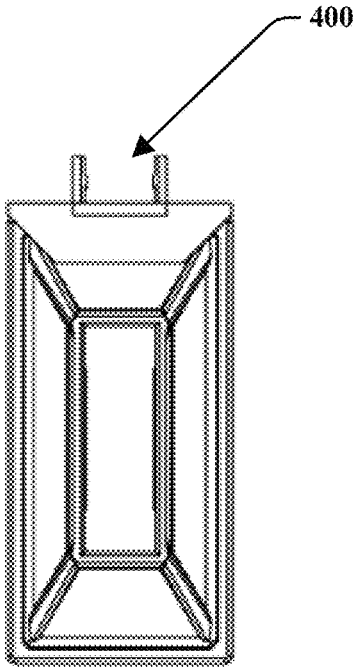
Figure 4D:
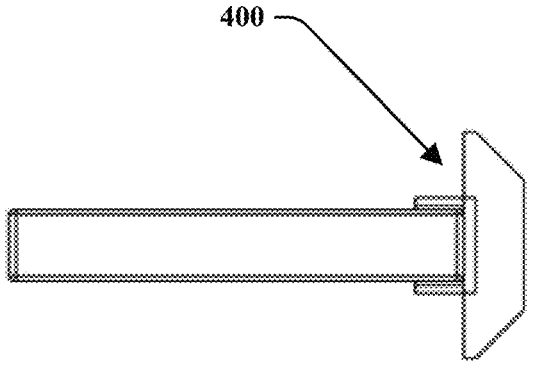

As shown in FIGS. 3C-D, in an embodiment, multiple tiles may be attached into each receiving portion 342, 344 of the straight clip 300.

FIGS. 4A-D depict an embodiment of the toy building system further comprising a cross-hatch clip 400. The cross-hatch clip 400 has two receiving portions 442, 444 that are adapted to receive an edge of a tile 120, 130 and may connect at least two tiles 100, 200 in a perpendicular orientation, where the tiles are in perpendicular planes. Each receiving portion 442, 444 of the cross-hatch clip 400 may attach to either the lengthwise 120, 220 or widthwise 130, 230 edge of the tile 100, 200. The cross-hatch clip 400 may be used to connect two tiles 100, 200 by a length 120, 220 of each tile, by a width 130, 230 of each tile, or by a length 120, 220 of one tile and a width 130, 230 of another tile. When the edge 120, 130 of a first tile 100 is connected to the edge 220, 230 of a second tile 200 by the cross-hatch clip 400, the resulting shape is an x-configuration. Although not shown, in an embodiment, multiple tiles may be attached into each receiving portion 442, 444 of the cross-hatch clip 400.

Figure 5A:
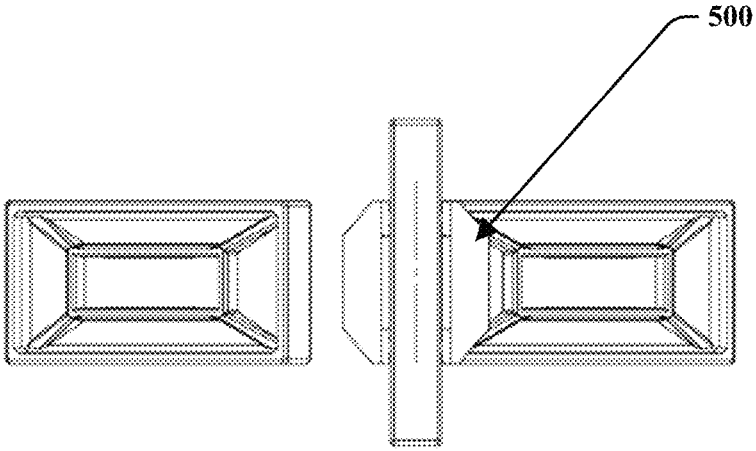
FIGS. 5A-C show an embodiment of a toy building system including a three-way clip.
Figure 5B:
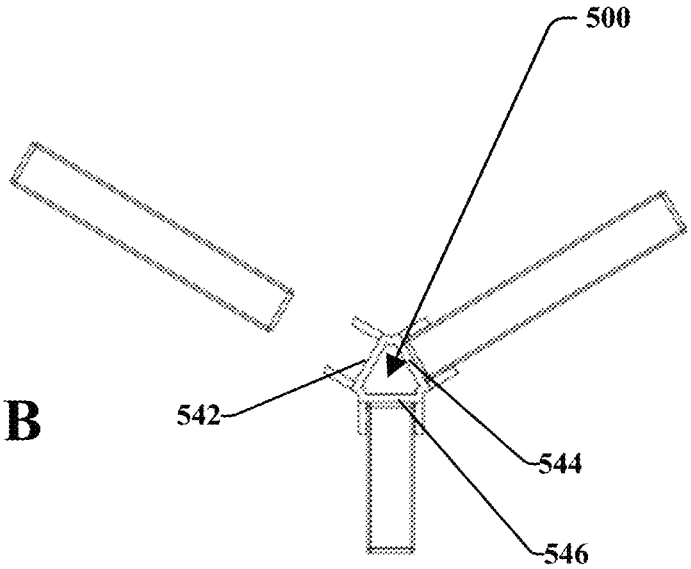
Figure 5C:
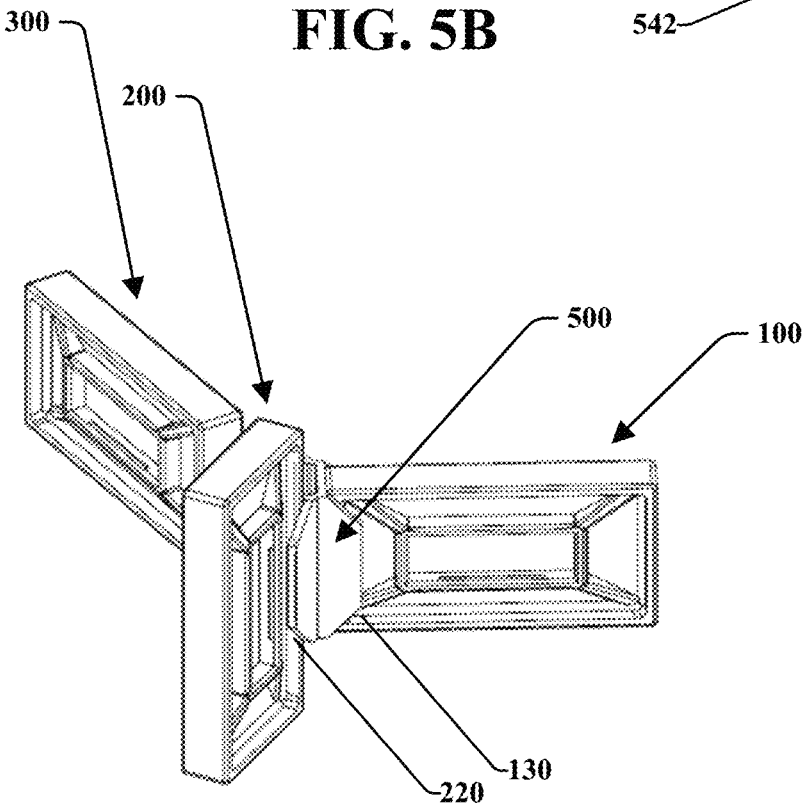

FIGS. 5A-C depict an embodiment of the toy building system further comprising a three-way clip 500. The three-way clip 500 has three receiving portions 542, 544, 546 that are adapted to receive an edge of a tile 120, 130 and may connect at least three tiles 100, 200, 300. Each receiving portion 542, 544, 546 of the three-way clip 500 may attach to either the lengthwise 120, 220, 320 or widthwise edge 130, 230, 330 of the tile 100, 200, 300. The three-way clip 500 may be used to connect three tiles 100, 200, 300 in any combination of lengths 120, 220, 320 or widths of the tiles 130, 230, 330. In an embodiment, multiple tiles may be attached into each receiving portion 542, 544, 546 of the three-way clip 500.

Figure 6A:
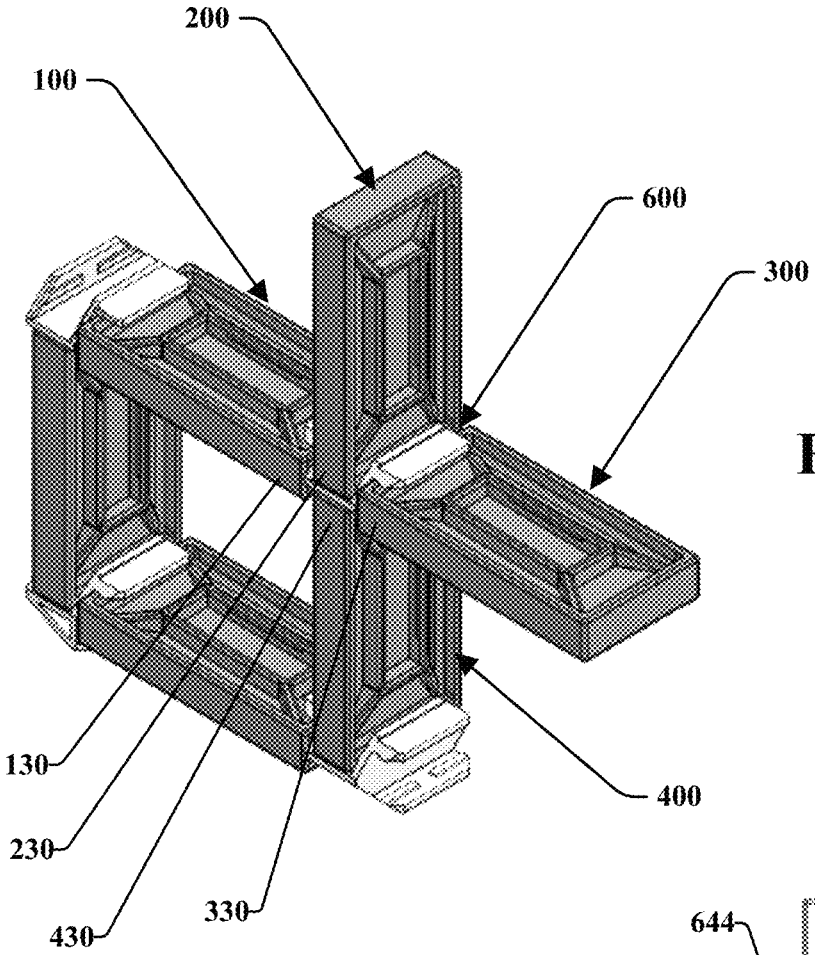
FIGS. 6A-B show an embodiment of a toy building system including a four-way clip.
Figure 6B:
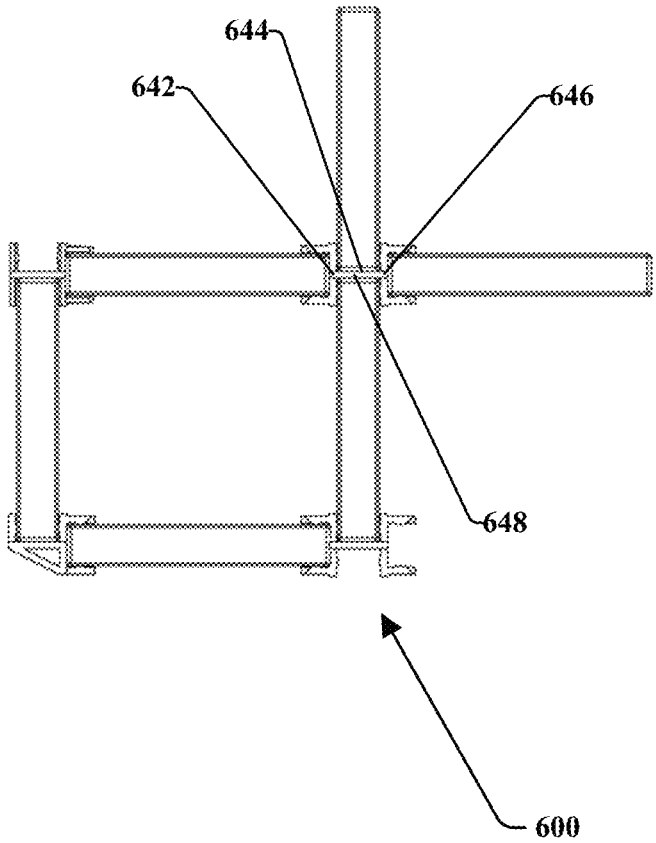

FIGS. 6A-B depict an embodiment of the toy building system further comprising a four-way clip 600. The four-way clip 600 has four receiving portions 642, 644, 646, 648 that are adapted to receive an edge of a tile 120, 130 and may connect at least four tiles 100, 200, 300, 400. Each receiving portion 642, 644, 646, 648 of the four-way clip 600 may attach to either the lengthwise 120, 220, 320, 420 or widthwise edge 130, 230, 330, 430 of the tile 100, 200, 300, 400. The four-way clip 600 may be used to connect four tiles 100, 200, 300, 400 in any combination of lengths 120, 220, 320, 420 or widths 130, 230, 330, 430 of the tiles. In an embodiment, multiple tiles may be attached into each receiving portion 642, 644, 646, 648 of the four-way clip.

Figure 7A:
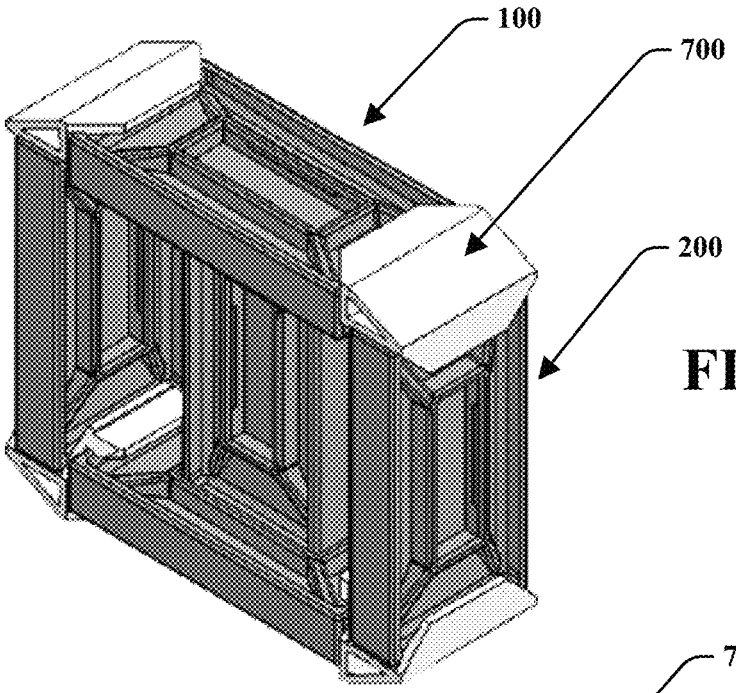
FIGS. 7A-C show an embodiment of a toy building system including a right-angle clip.
Figure 7B:
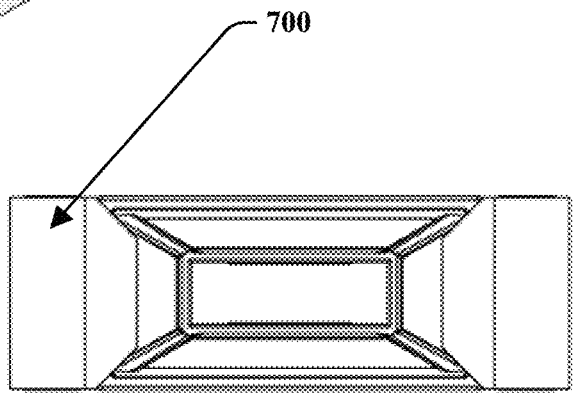
Figure 7C:
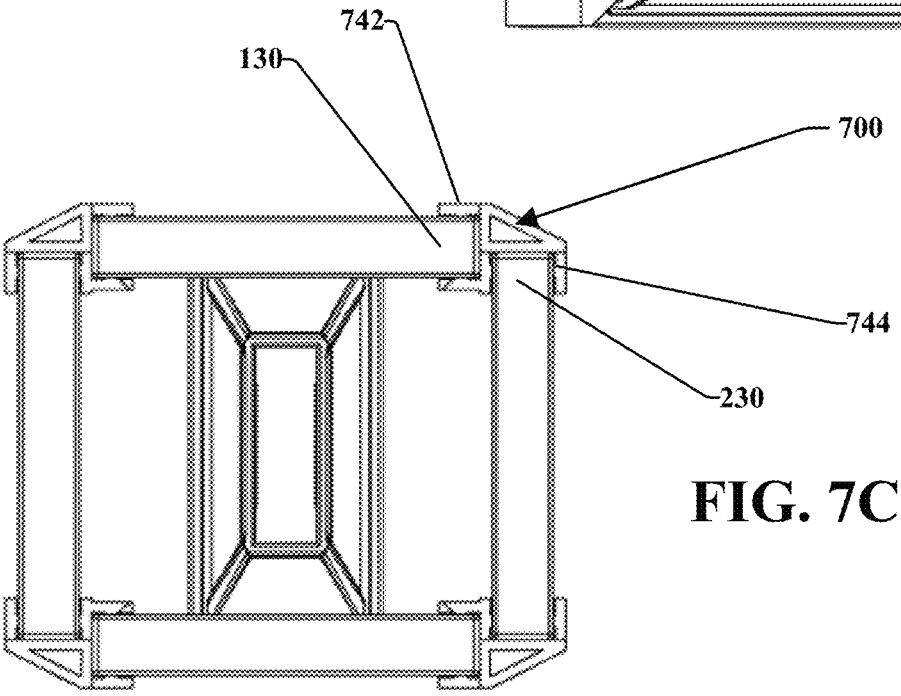

FIGS. 7A-C depict an embodiment of the toy building system further comprising a right-angle clip 700. The right-angle clip 700 has two receiving portions 742, 744 that are adapted to receive an edge of a tile 120, 130 and may connect at least two tiles 100, 200 at a right angle. Each receiving portion 742, 744 of the right-angle clip 700 may attach to either the lengthwise 120, 220 or widthwise edge 130, 230 of the tile 100, 200. The right-angle clip 700 may be used to connect two tiles 100, 200 by a length of each tile 120, 220, by a width of each tile 130, 230, or by a length 120, 220 of one tile and a width 130, 230 of another tile. When the edge 120, 130 of a first tile 100 is connected to the edge 220, 230 of a second tile 200 by the right angle clip 700, the resulting shape is an L-configuration or 90° angle. In an embodiment, multiple tiles may be attached into each receiving portion 742, 744 of the right-angle clip 700.

Figure 8:
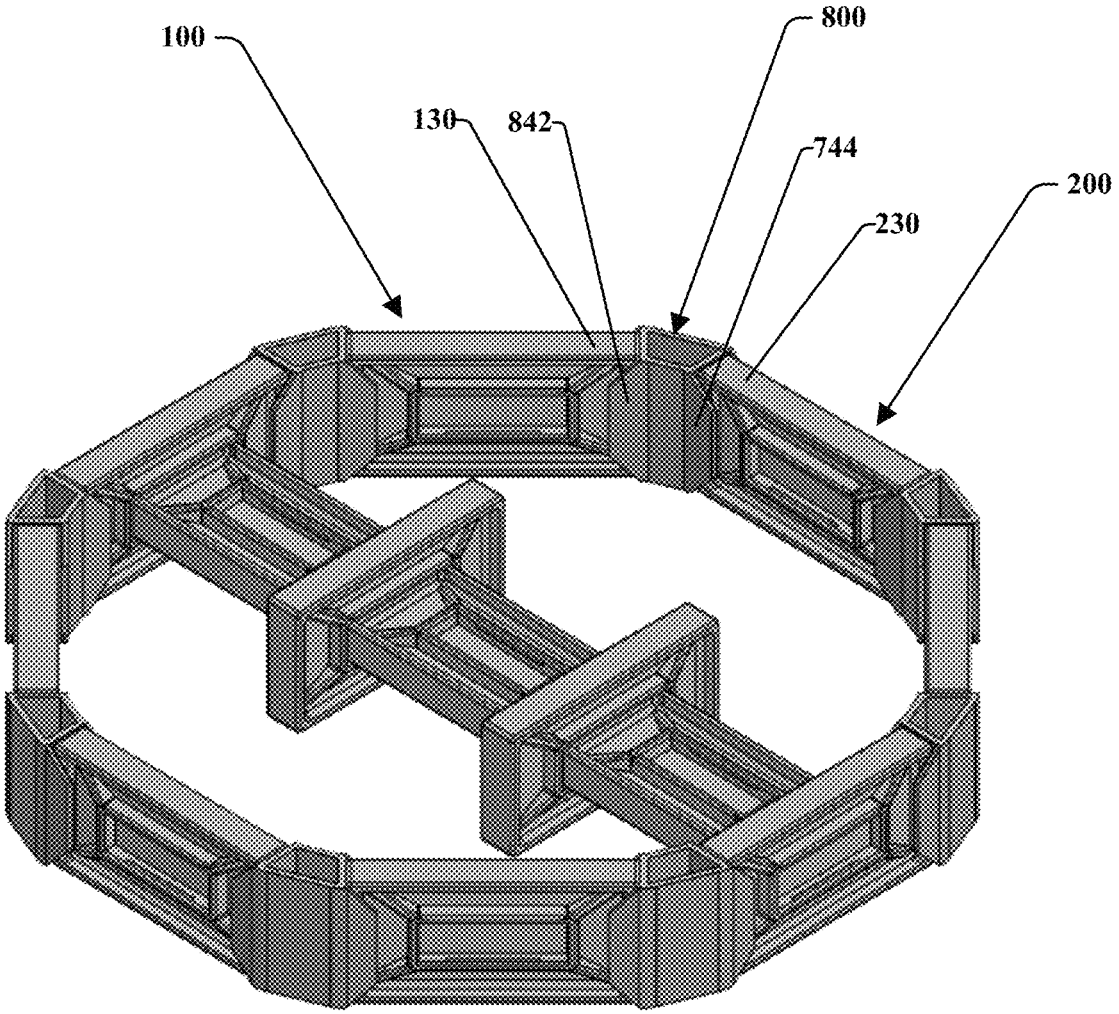
FIG. 8 shows an embodiment of a toy building system including a 45-angle clip.
Figure 9A:
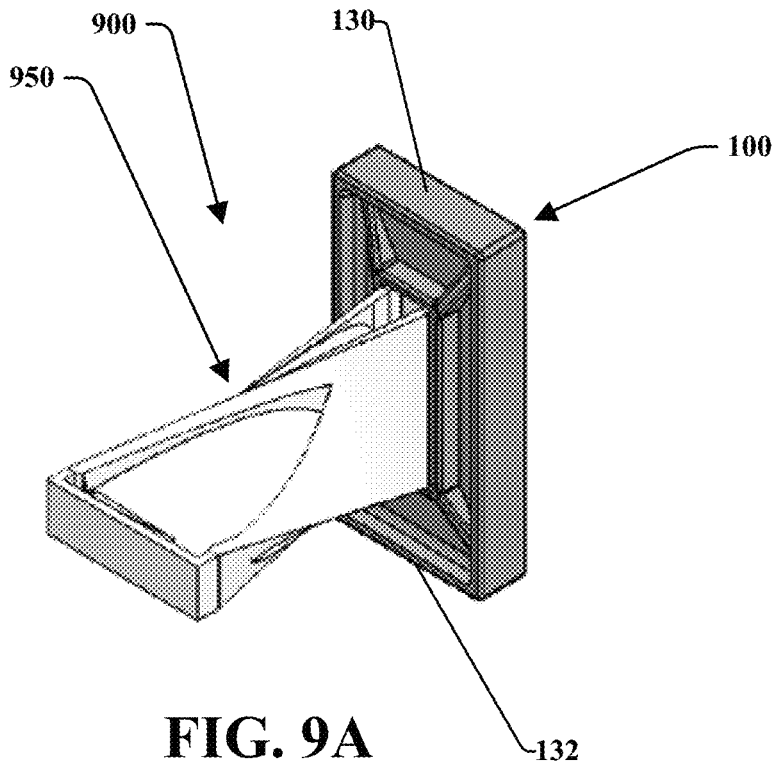
FIGS. 9A-D show an embodiment of a toy building system including a twisted tile.
Figure 9B:
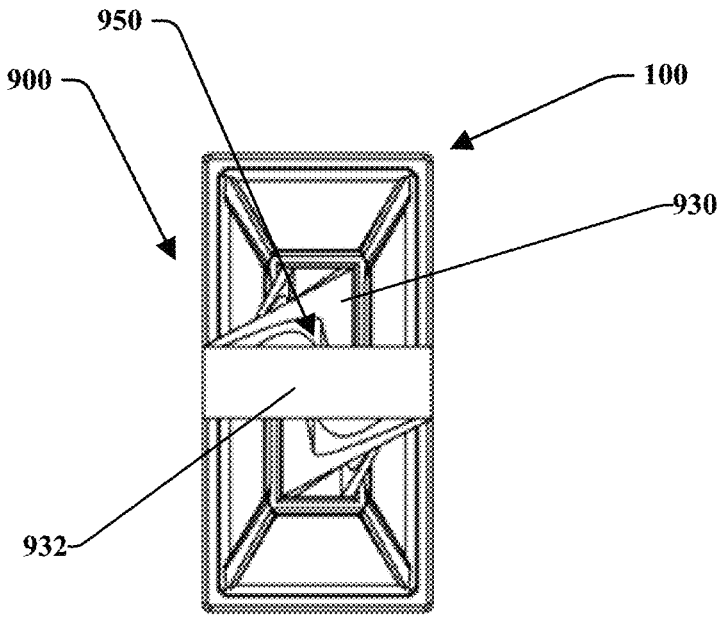
Figure 9C:
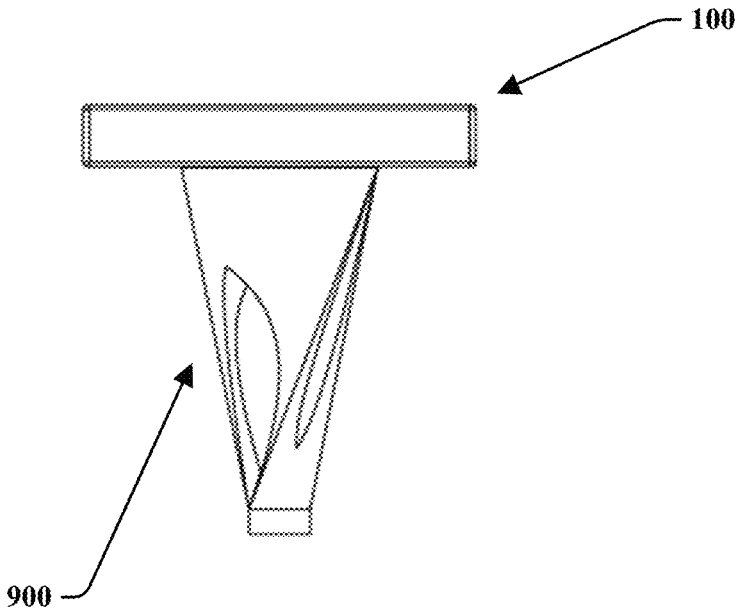
Figure 9D:
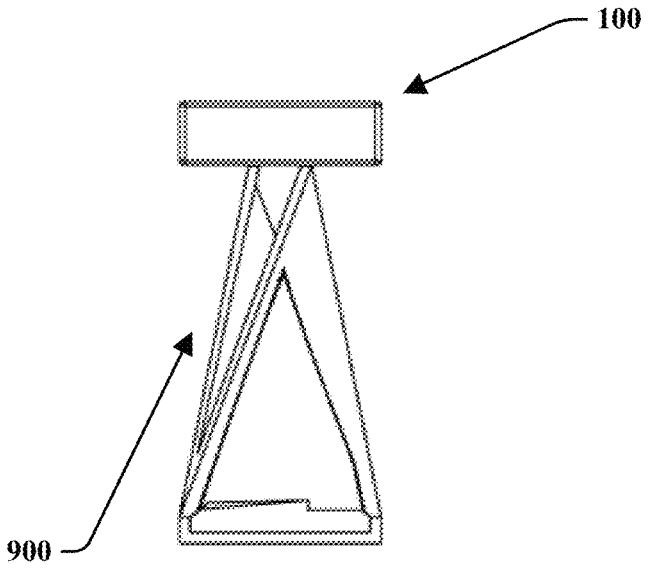
Figure 10A:
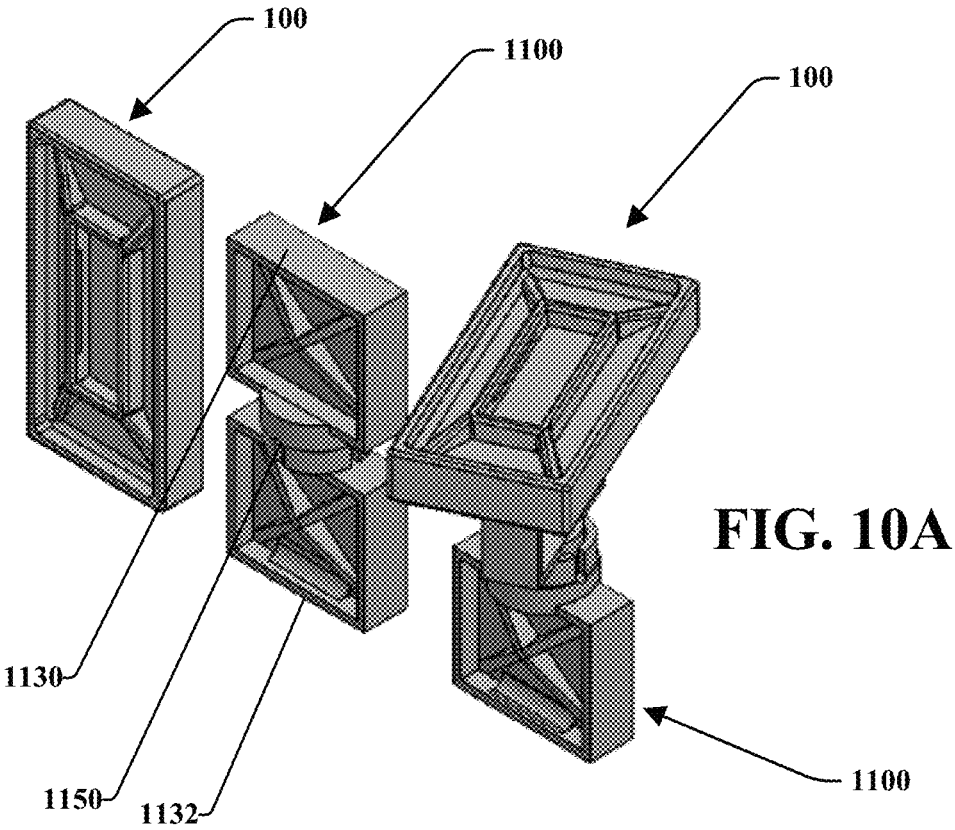
FIGS. 10A-D show an embodiment of a toy building system including a rotatable tile.
Figure 10B:
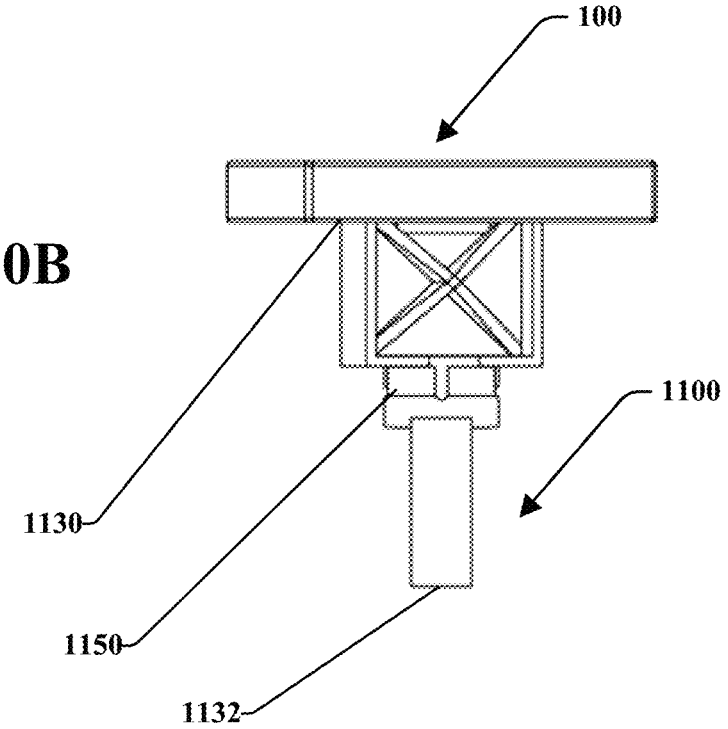
Figure 10C:
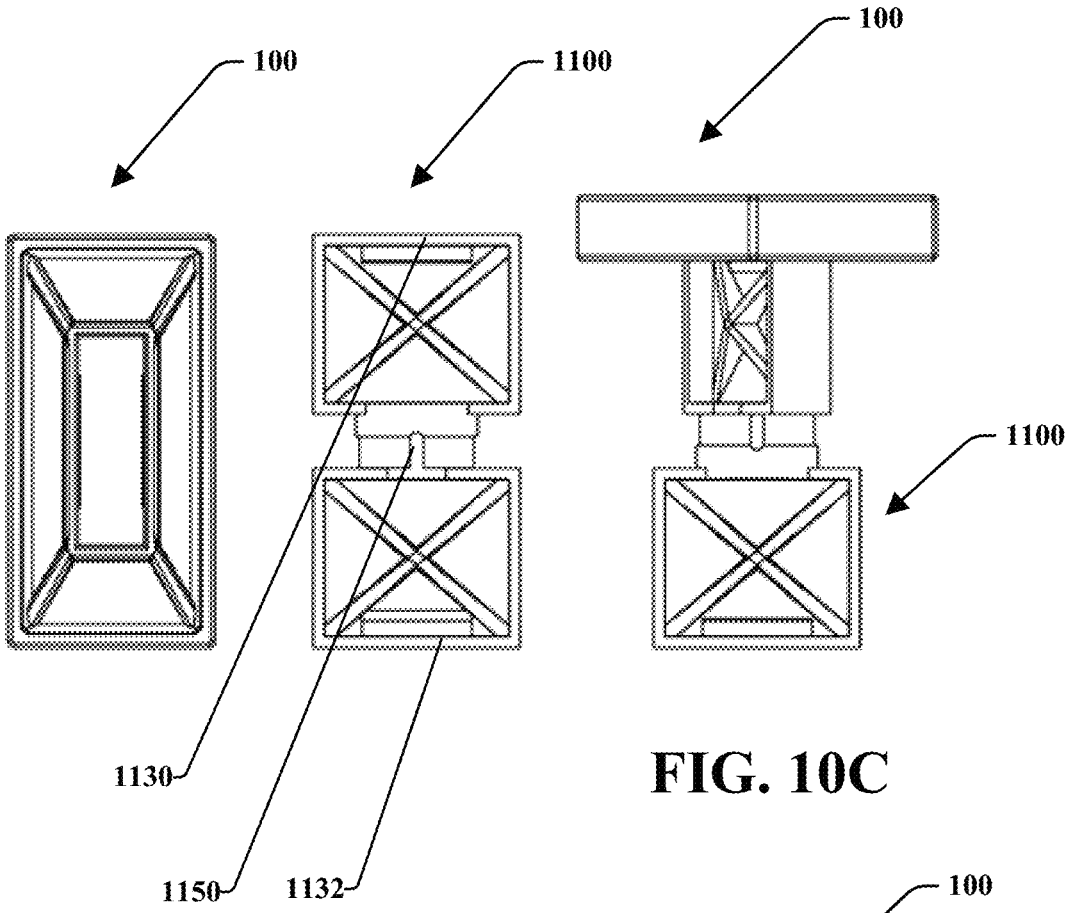
Figure 10D:
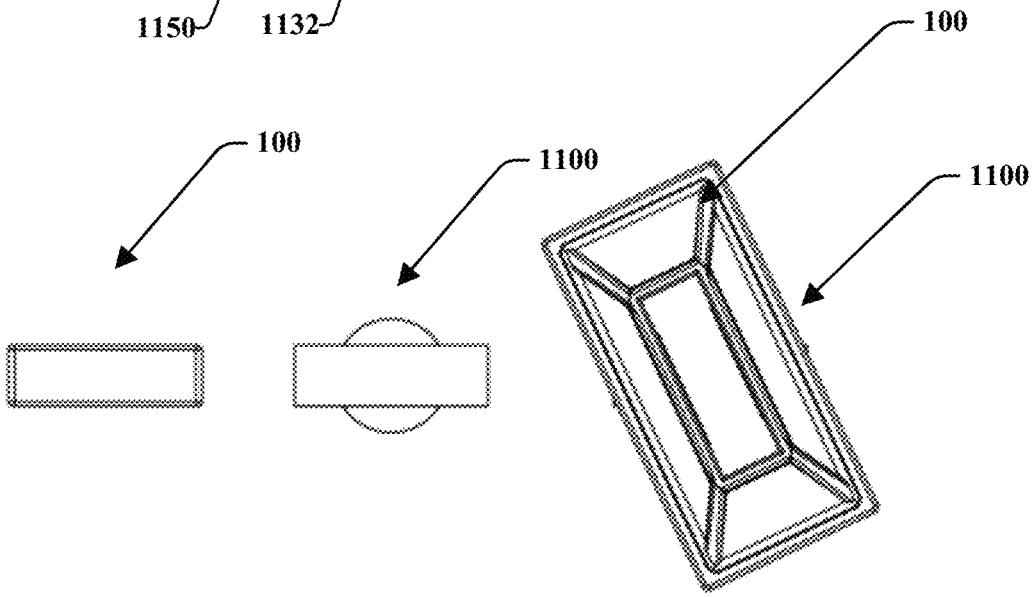
Figure 11A:
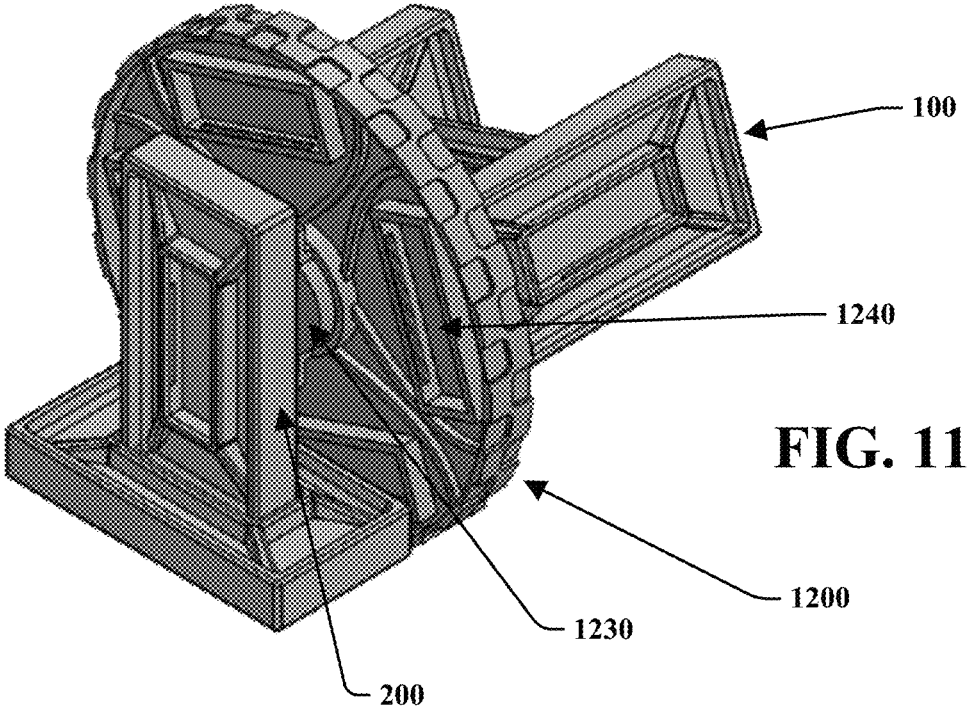
FIGS. 11A-D show an embodiment of a toy building system including a wheel tile.
Figure 11B:
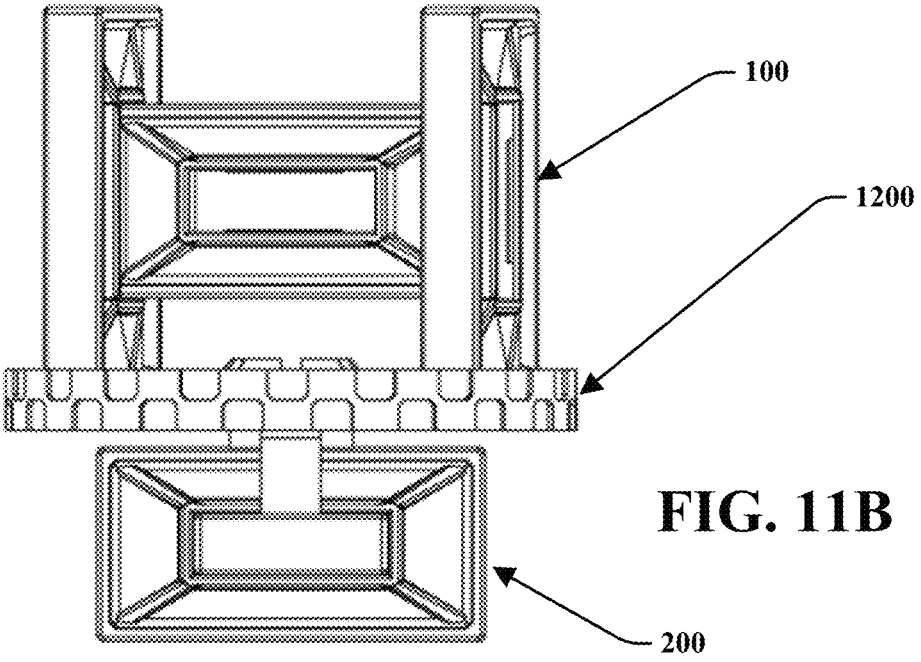
Figure 11C:
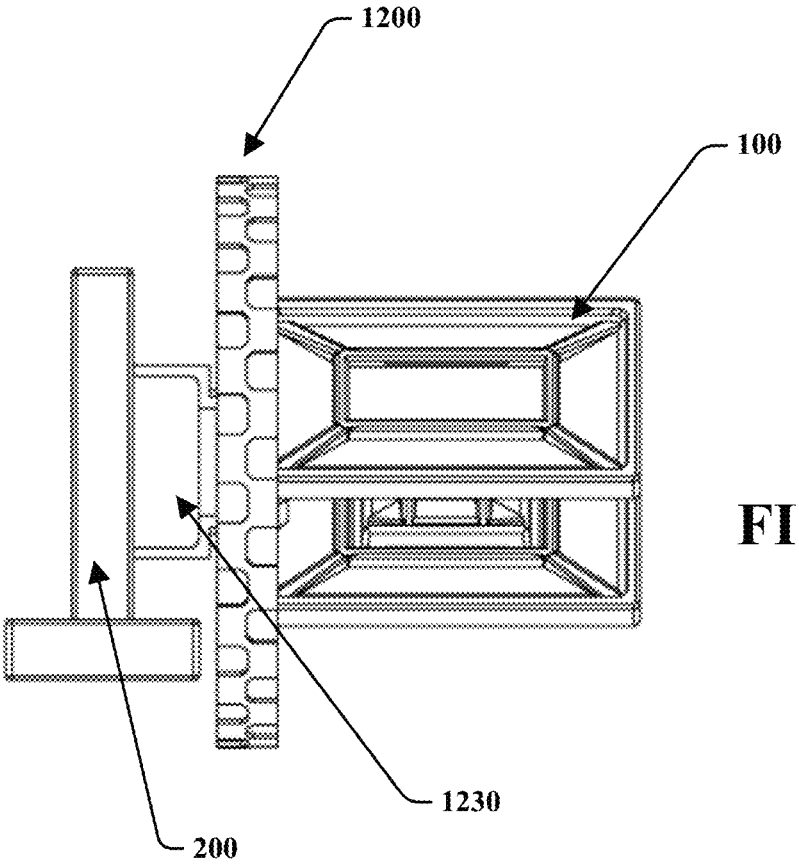
Figure 11D:
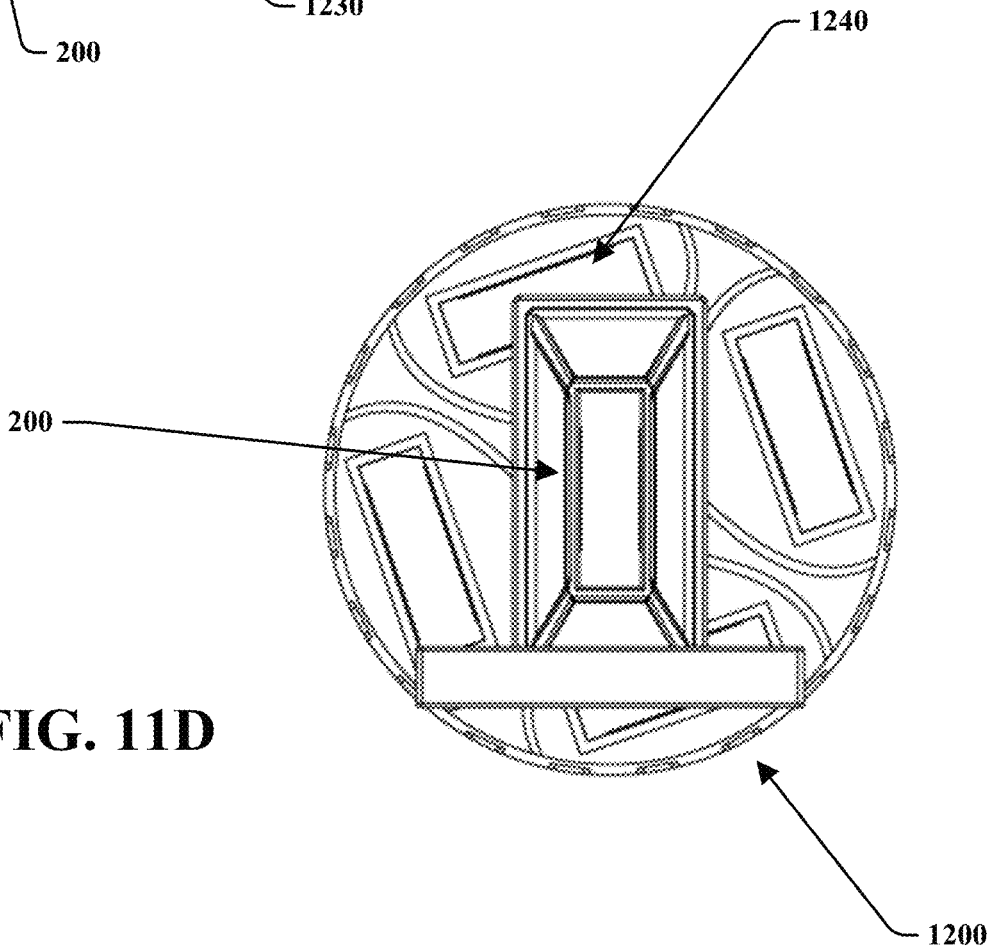

FIG. 8 depicts an embodiment of the toy building system further comprising a 45-angle clip 800. The 45-angle clip 800 has two receiving portions 842, 844 that are adapted to receive an edge of a tile 120, 130 and may connect at least two tiles 100, 200 in at a 45° angle. Each receiving portion 842, 844 of the 45-angle clip 800 may attach to either the lengthwise 120, 220 or widthwise edge 130, 230 of the tile 100, 200. The 45-angle clip 800 may be used to connect two tiles 100, 200 by a length of each tile 120, 220, by a width of each tile 130, 230, or by a length 120, 220 of one tile and a width 130, 230 of another tile. When the edge 120, 130 of a first tile 100 is connected to the edge 220, 230 of a second tile 200 by the 45° angle clip 800, the resulting shape is a 45° angle. In an embodiment, multiple tiles may be attached into each receiving portion 842, 844 of the 45-angle clip 800.

Any of the clips, 300, 400, 500, 600, 700 and 800 may be configured to hold (i.e., it has a holding strength sufficient for) any of the tiles 100, 200 such that the applicable clip may be flipped upside down and the tiles 100, 200 remain operatively positioned within the applicable clip. This allows a user to take one of the tracks as described below where the tiles 100, 200 have fallen and turn it upside down to revert the tiles 100, 200 to a standing position. The applicable clips will have enough holding power to prevent the tiles 100, 200 from being removed from the clip. This will allow a user to set up the domino or tile falling path in significantly shorter amount of time than if the tiles or dominoes had to be set up individually. When multiple tracks are utilized, the user can set up a significant number of tiles/dominoes in a very quick and efficient manner by merely turning the track over such that the tile/domino pointed downward to the ground and then quickly flipping it back to the operative position whereby the tile/domino is in a standing position ready to be knocked down.

FIGS. 9A-D depict an embodiment of the toy building system further comprising a twisted tile 900. The twisted tile 900 includes two mating portions 930, 932 at each of its widths. The mating portions 930, 932 of the twisted tile 900 may interact with the projection of another tile or the receiving portion of a clip. Unlike a general tile 100 where each edge 130, 132 is in the same orientation and all sides are on the same plane, the twisted tile 900 has a twist 950 in its body such that the widthwise edges 930, 932 of the tile 900 are in perpendicular planes.

FIGS. 10A-D depict an embodiment of the toy building system further comprising a rotatable tile 1100. The rotatable tile 1100 has a rotating portion 1150 along a mid-section of a base plate 1110 and at least one width edge or mating portion 1130, 1132. The mating portion 1130, 1132 may attach to another tile or the receiving portion of a clip.

FIGS. 11A-D depict an embodiment of the toy building system further comprising a wheel tile 1200. The wheel tile 1200 includes a wheel 1210 having a first face 1212 and a second face 1214. On one or both of the faces 1212, 1214 of the wheel tile 1200 is open and comprises a recess or hollow cavity. Within the recess of the wheel tile 1200, the wheel tile 1200 may include at least one projection adapted to receive the width or mating portion 130, 230, 930, 1130, etc. of another tile. On one or both of the faces 1212, 1214 of the wheel tile 1200, the wheel tile 1200 may itself include a mating portion 1230 adapted to fit within the projection of another tile or the receiving portion of a clip. The mating portion may have a substantially similar shape as an edge or mating portion of a tile 100, 200.

FIGS. 12A-E depict an embodiment of the toy building system further comprising an adapter tile 1300. The adaptor tile 1300 includes a base plate 1310, a first face 1312, and a second face 1314. The first face 1312 includes a plurality of projections 1330 or mating portion. The projections 1330 may be of any suitable shape and positioned in any suitable orientation. For example, the projections 1330 may be square, rectangular, ovular, or irregular. Two, three, four, five, etc. projections 1330 may be positioned on the first face 1312 of the adapter tile 1300 in any orientation suitable to receive a mating portion 1340 in a space provided. In an embodiment, each projection 1330 is circular. In an embodiment, at least four projections 1330 are positioned apart from one another in the shape of a square. The first face 1312 may include one, two, three, four etc. sets of projections 1330 so as to comprise multiple mating portions 1340. The second face 1314 is open and comprise a recess or hollow cavity. Within the recess is a projection or receiving portion 1340 operatively attachable to the projections or mating portion 1430 of a second adaptor tile 1400. When the mating portion 1430 of a first adaptor tile 1300 is connected to the receiving portion 1440 of a second adaptor tile 1400, the first face 1312 of the first adaptor tile 1300 and the second face 1414 of the second adaptor tile 1400 may be in surface contact.

Figure 12A:
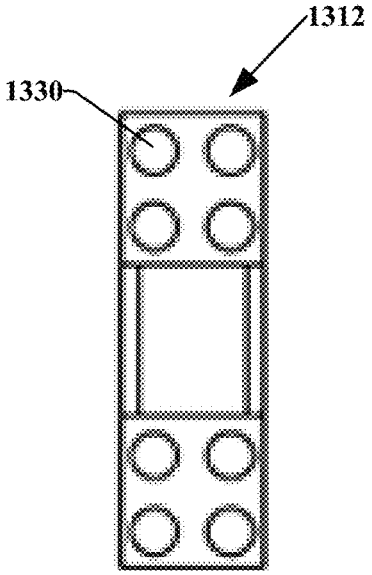
FIGS. 12A-E show an embodiment of a toy building system including an adaptor tile.
Figure 12B:
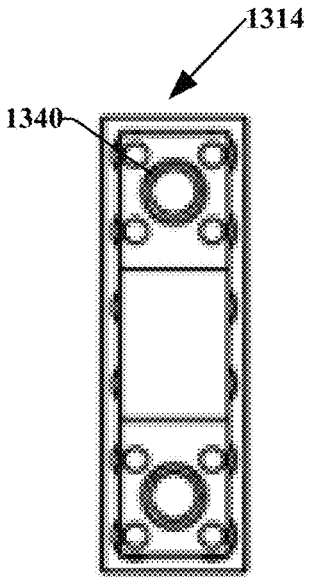
Figure 12C:
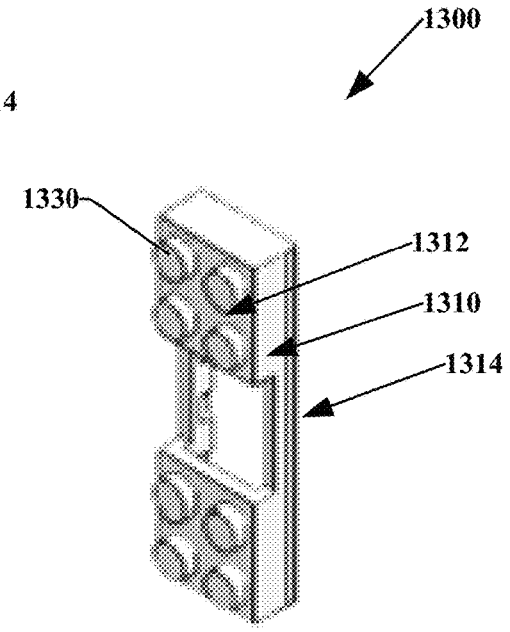
Figure 12D:
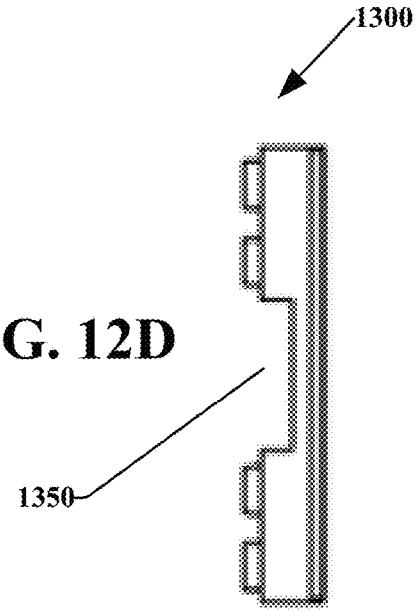
Figure 12E:
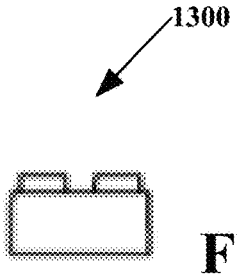
Figure 12F:
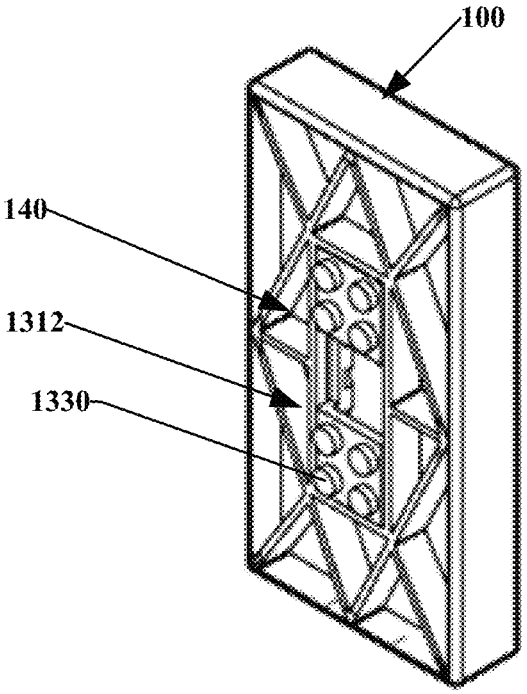
FIGS. 12F-G show an embodiment of a toy building system including an adaptor tile and a standard tile, and two configurations of attachment between the adaptor tile and standard tile.
Figure 12G:
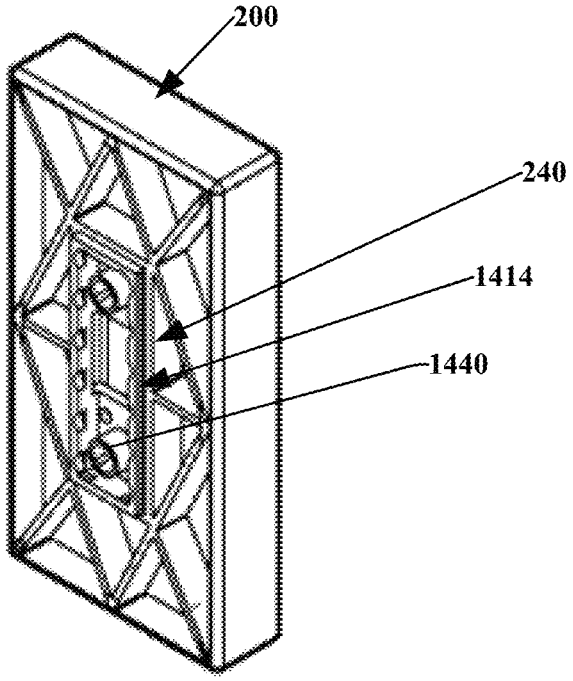

As shown in FIGS. 12F and G, the adaptor tile 1300 may be shaped to fit within a projection 140 on a second face 114 of a standard tile 100. For example, the thickness of the adaptor tile 1300 may generally correlate to the depth of the standard tile projection 140, and the length and width of the adaptor tile may generally correlate to the length and width of the projection 140 on the standard tile 100. The adaptor tile 1300 may operatively fit within the projection 140 of a standard tile 100 by the adaptor tile's first face 1312 or second face 1314. For example, the first face 1312 of the adaptor tile 1300 may fit into the projection 140 of the standard tile 100 and the second face 1314 or receiving portion 1340 of the adaptor tile 1300 may thereby be exposed as shown in FIG. 12G. Additionally, the second face 1314 of the adaptor tile 1300 may fit into the projection 140 of the standard tile 100 and the first face 1312 or mating portion 1330 of the adaptor tile 1300 may thereby be exposed as shown in FIG. 12F. The adaptor tiles 1300 may be used to connect two faces 112, 214 of two standard tiles 100, 200, when the corresponding mating portions 1330 and receiving portions 1440 of the two adaptor tiles 1300, 1400 are exposed and connected. In an embodiment, the base plate 1310 of the adaptor tile 1300 may be discontinuous and have a hole 1350 in a middle of the adaptor tile 1300 so as to facilitate removal of the adaptor tile from the standard tile, for example.

FIGS. 13A-E depict an embodiment of the toy building system further comprising a mini tile 1500. The mini tile 1500 generally has the same mating portions 1530 and receiving portions 1540 as a standard tile 100 and two mini tiles 1500, 1600 may interact in the same manner as two standard tiles 100, 200. For example, a width edge 1530 of the mini tile 1500 may serve as a mating portion and operatively insert into a projection or receiving portion 1640 of a second mini tile 1600. In an embodiment, the mini tile 1500 may be sized to interact and operatively attach to a standard tile 100. For example, the thickness of the mini tile 1500 may generally correspond to the width of the projection or receiving portion 140 of the standard tile 100 and the length edge 1520 of the mini tile 1500 may correspond to the length of the projection or receiving portion 140 of the standard tile 100. As a result, the length edge 1520 of the mini tile 1500 may serve as a mating portion and operatively fit within the projection 140 of the standard tile 100. In another embodiment, various clips as described above may be provided with receiving portions that generally correspond to the thickness and other dimensions of the mini tile. Each clip, such as the straight clip, cross-hatch-clip, three-way clip, four-way clip, right-angle clip, and 45-angle clip may have receiving portions for only the standard tile, for only the mini tile, for both the standard tile and mini tile on a single clip, and/or for both in an embodiment where the thicknesses are interchangeable. FIGS. 13 B-C show a straight clip 1700 with a receiving portion 1742 for the standard tile 100 and a receiving portion 1744 for the mini tile 1500. It is noted that many other variations are possible as described.

FIGS. 14A-F depict various views of a second tile 2000 that may be used in a toy building system or that may be used independently over other pieces as building or domino blocks. The tiles 2000 may connect to each other as a 3-D building system or the tiles 2000 may serve as dominos that may be placed in sequence and forced to fall in a particular pattern or orientation. Certain aspects of the tile 2000, such as the length, width, and thickness may generally correspond to a mating portion on other components of the system so as to be able to interconnect with those components of the toy building system, such as the clips 2600 or arc 2200. Certain aspects of the tile 2000 may also be varied, such as length and width to provide various shapes, sizes, and types of tiles that may be used in the toy building system. For example, the second tile 2000 may also be configured in dimensions similarly to that of the mini tile 1500.

Figure 14B:
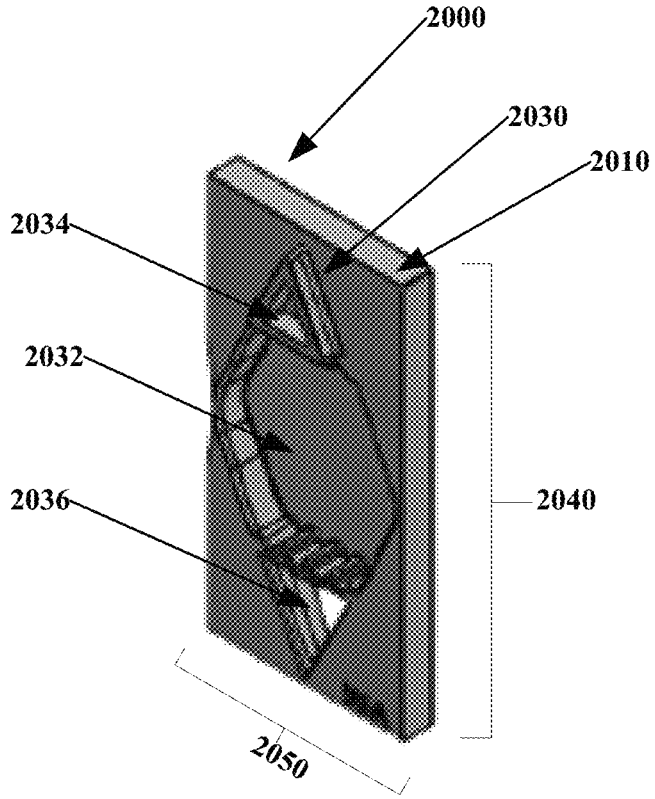
Figure 14C:
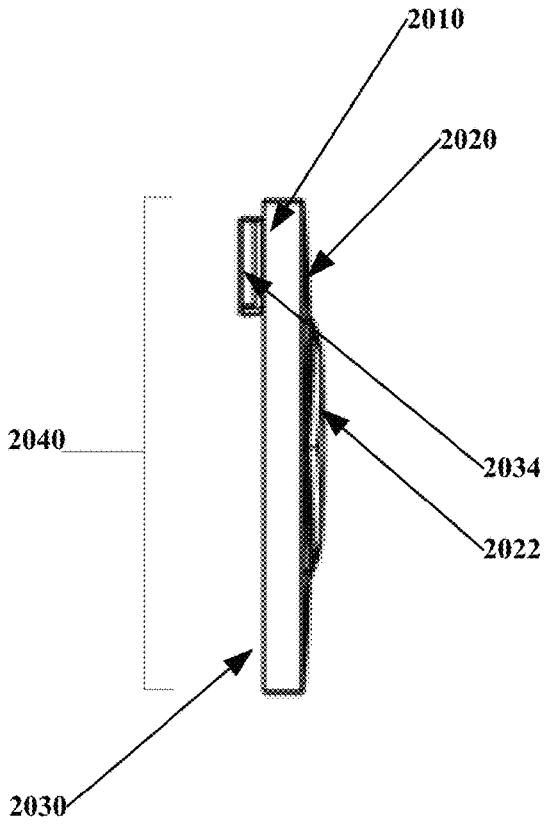
Figure 14D:
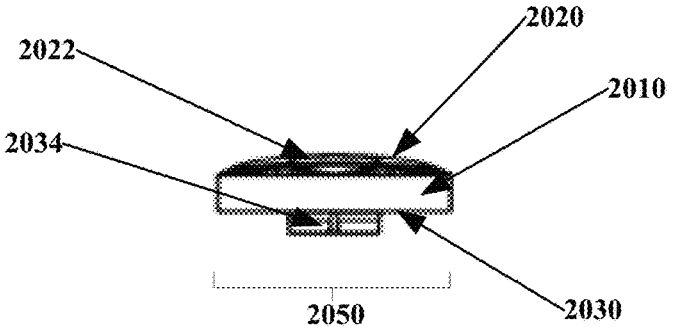
Figure 14E:
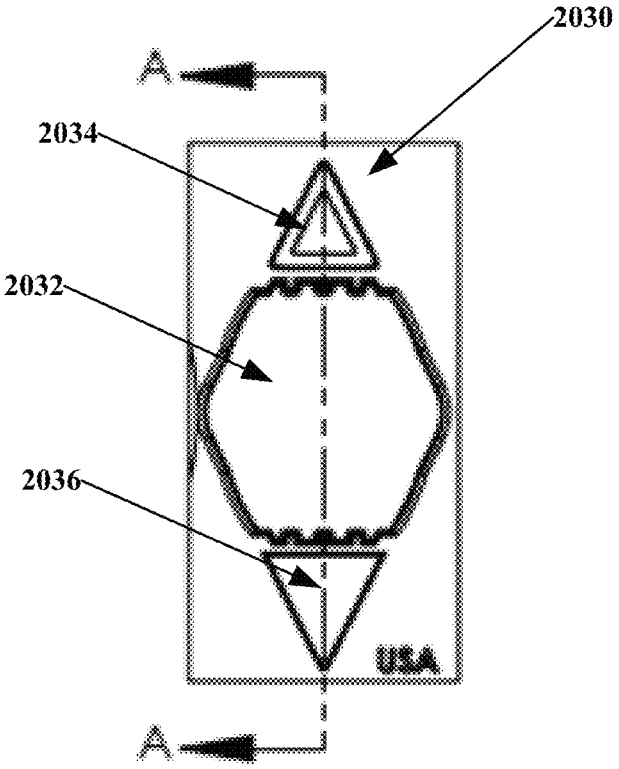
Figure 14F:
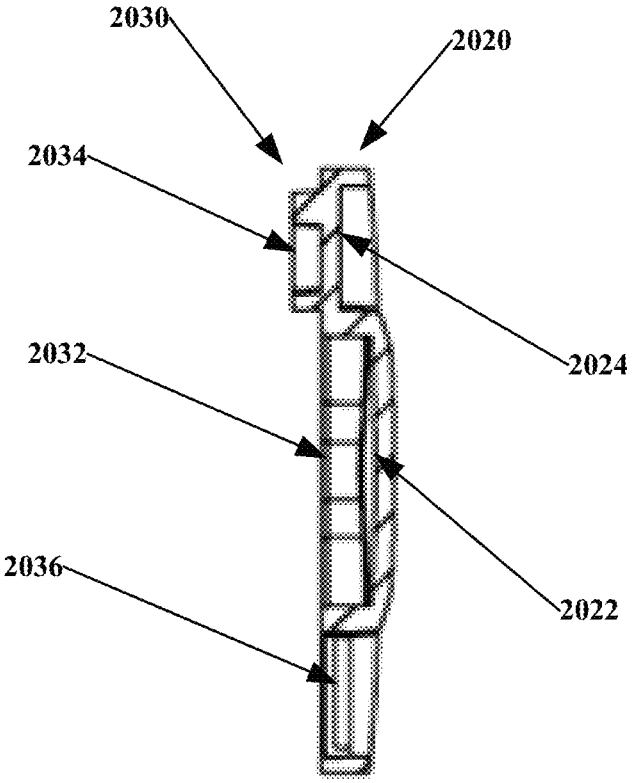
FIG. 14F shows a cross-section of the second tile in FIG. 14E taken along line A-A.
Figure 21A:
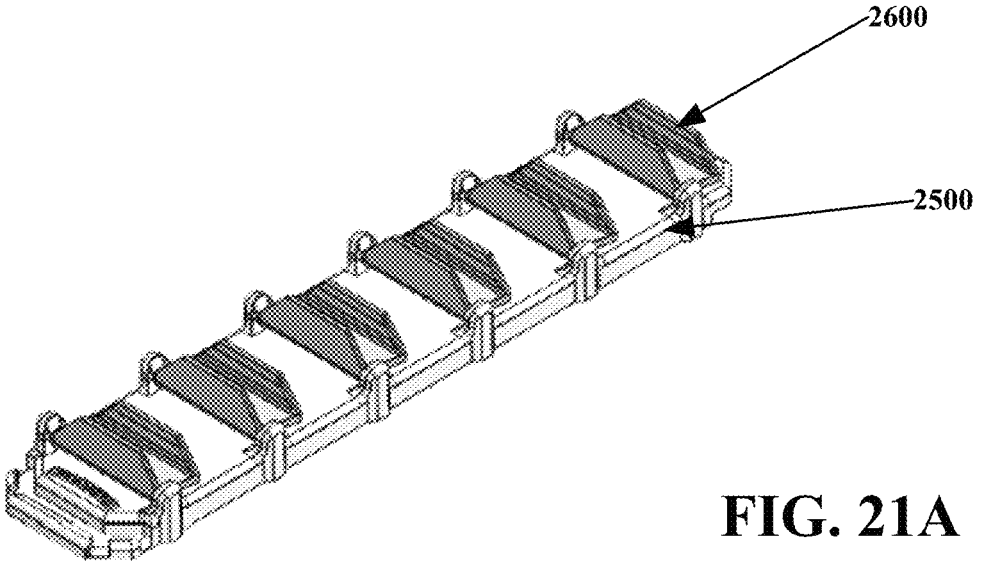
FIGS. 21A-D show a non-limiting attachment between a clip and a track.
Figure 21B:
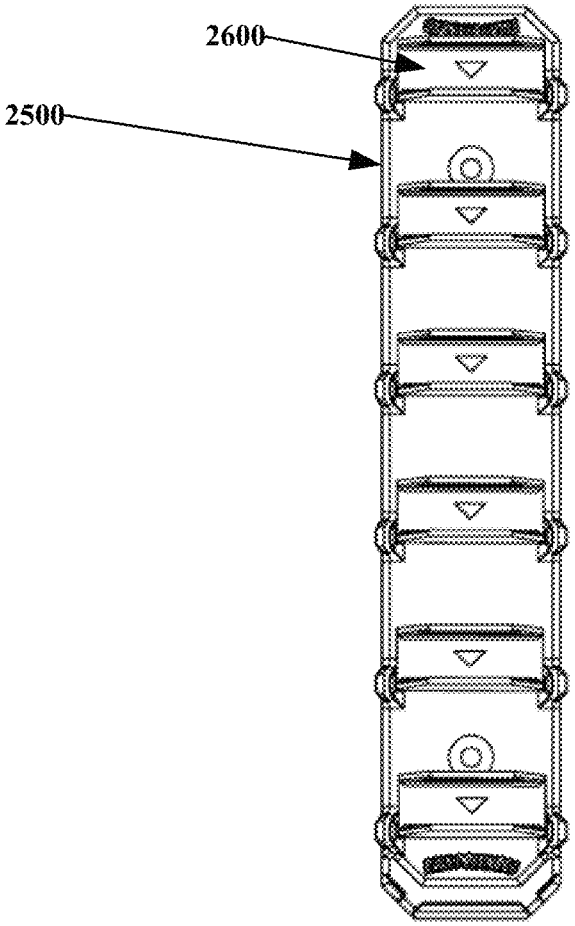
Figure 21C:
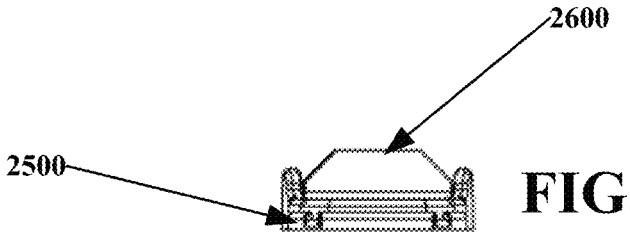
Figure 21D:
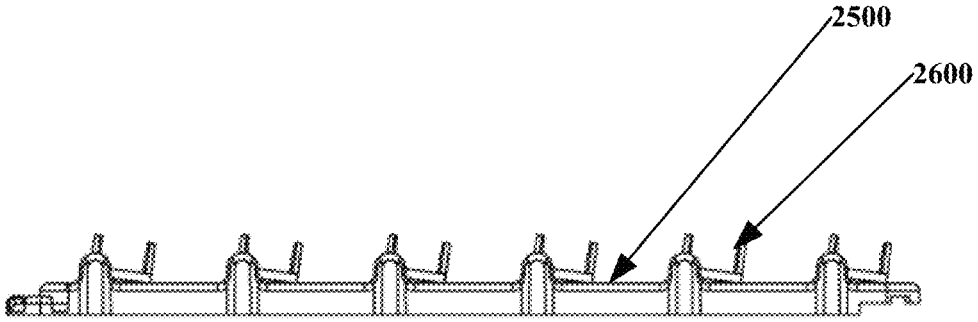
Figure 22:
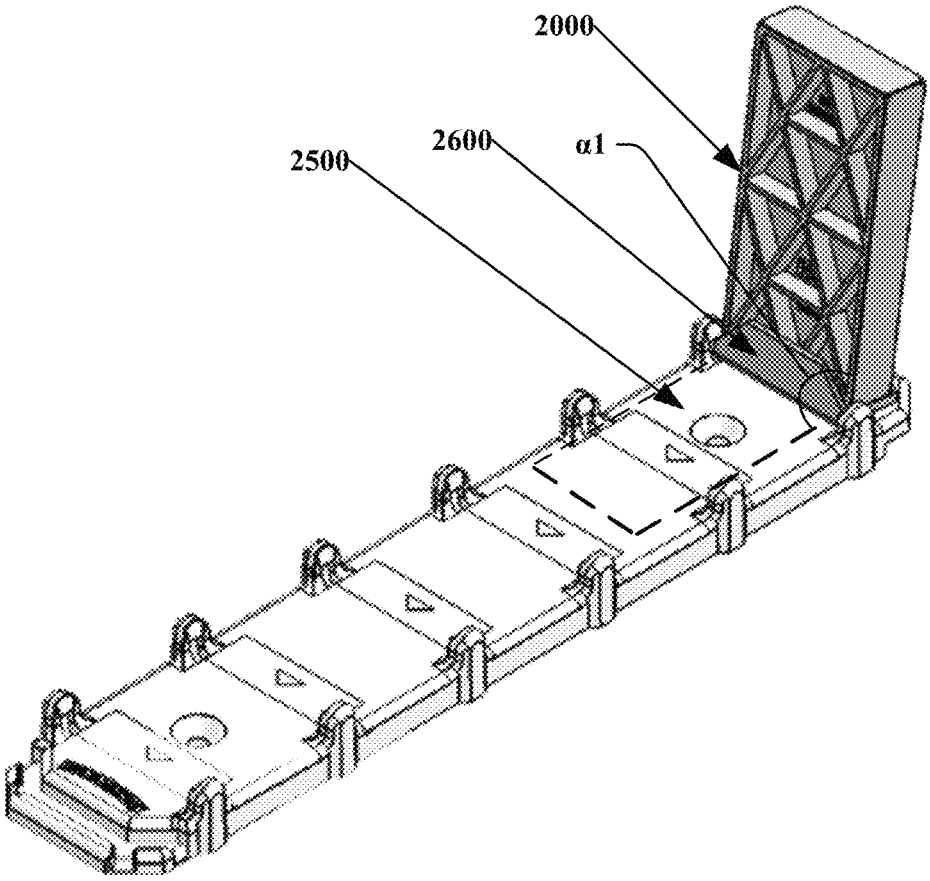
FIG. 22 shows a non-limiting attachment between a tile, a clip, and a track.
Figure 23A:
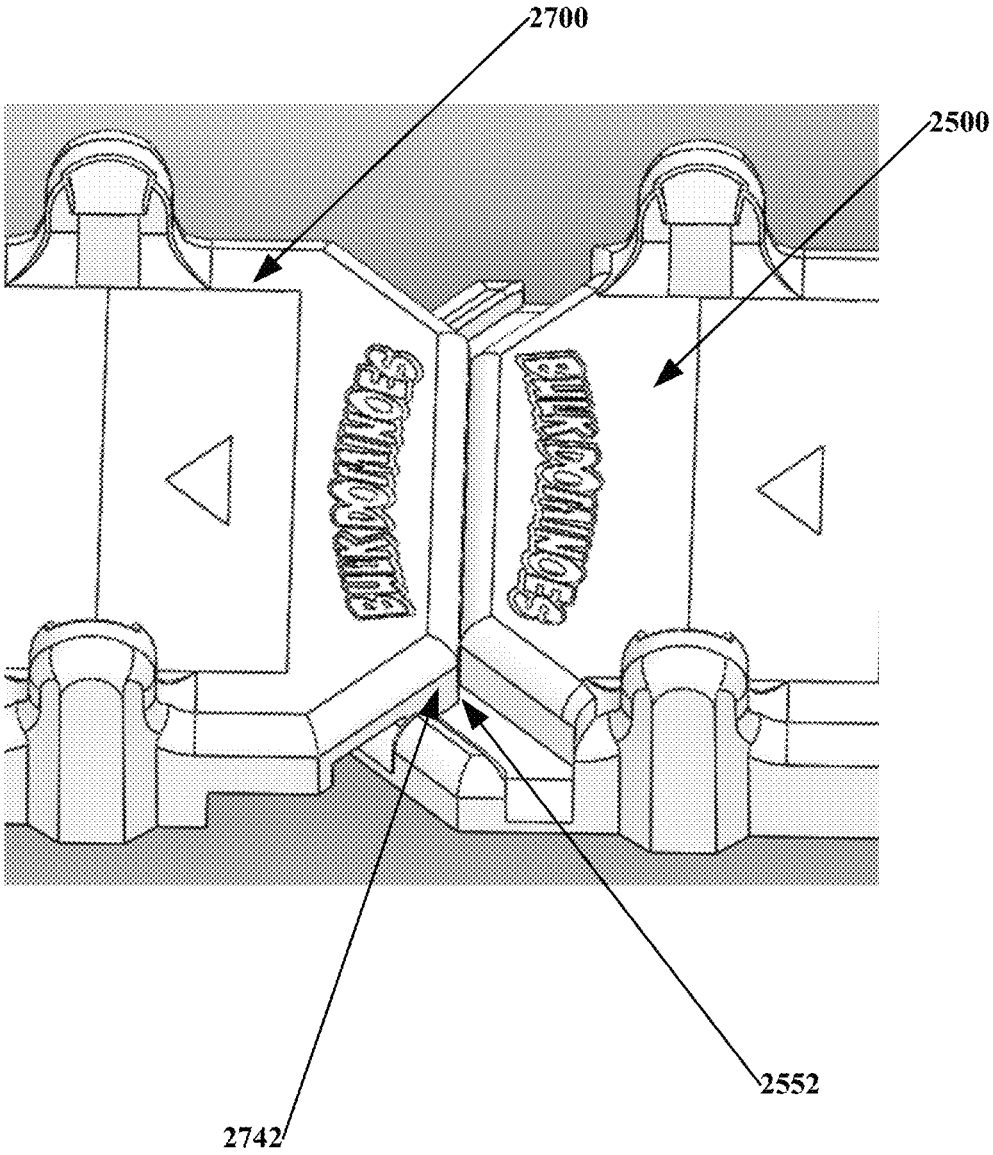
FIGS. 23A-D and 24 show non-limiting attachments between multiple tracks.
Figure 23B:
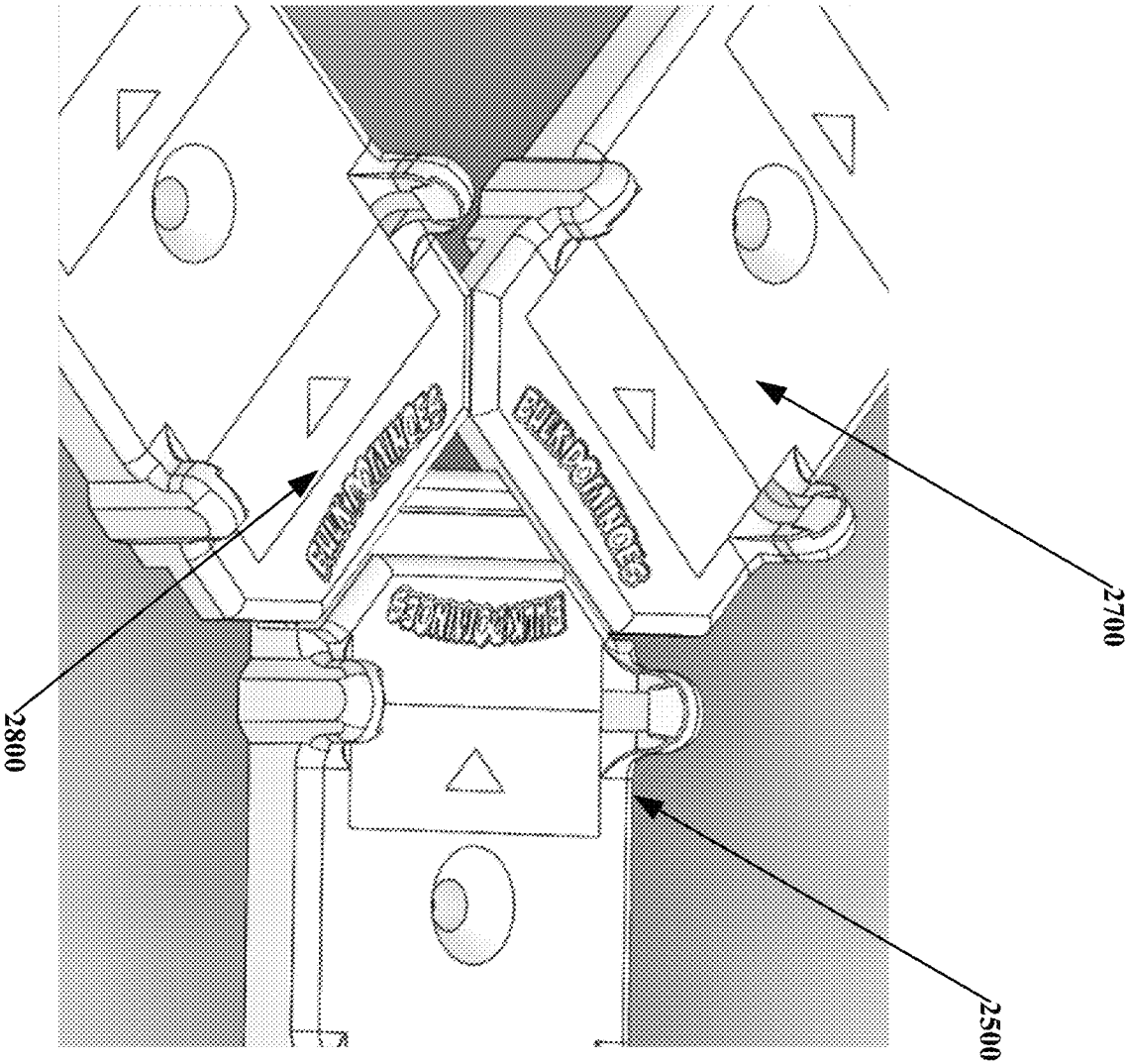
Figure 23C:
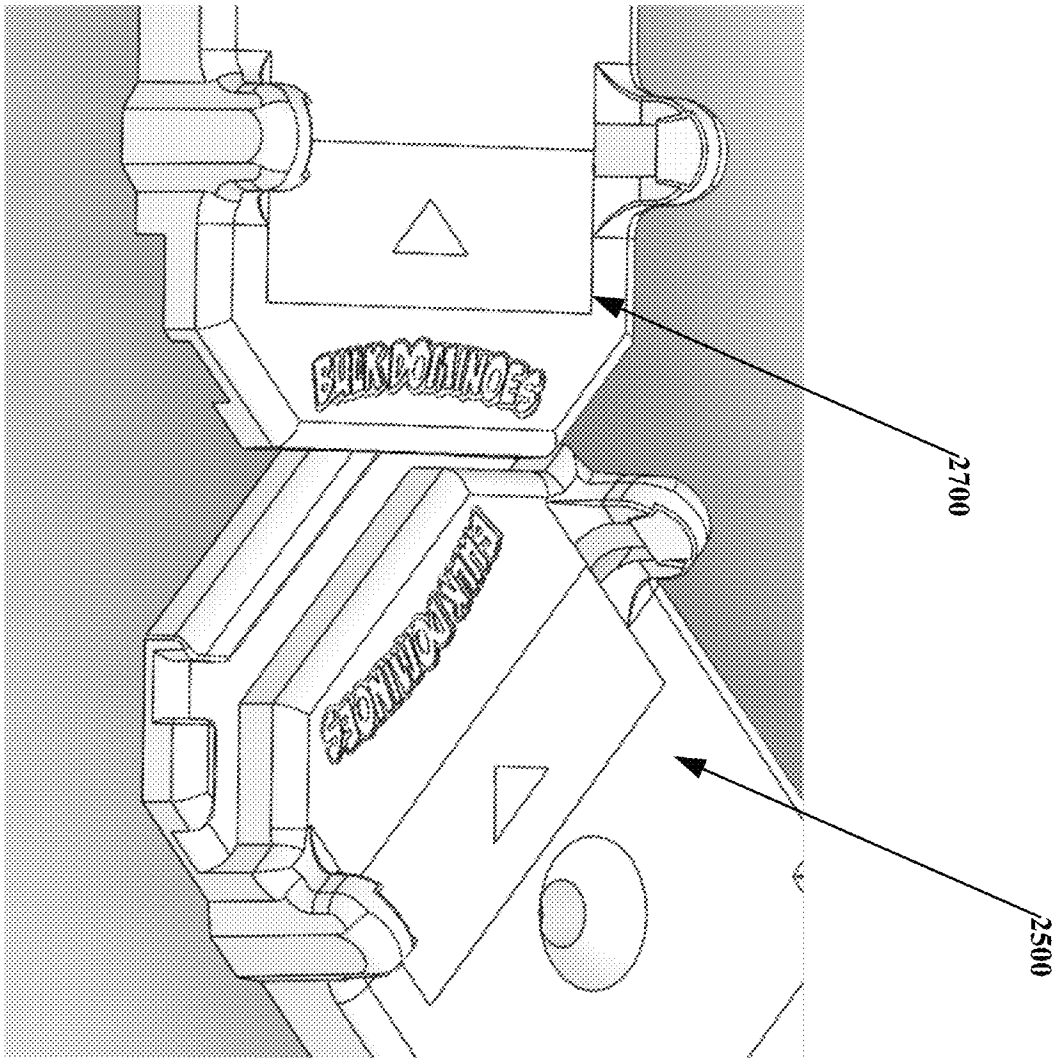
Figure 23D:
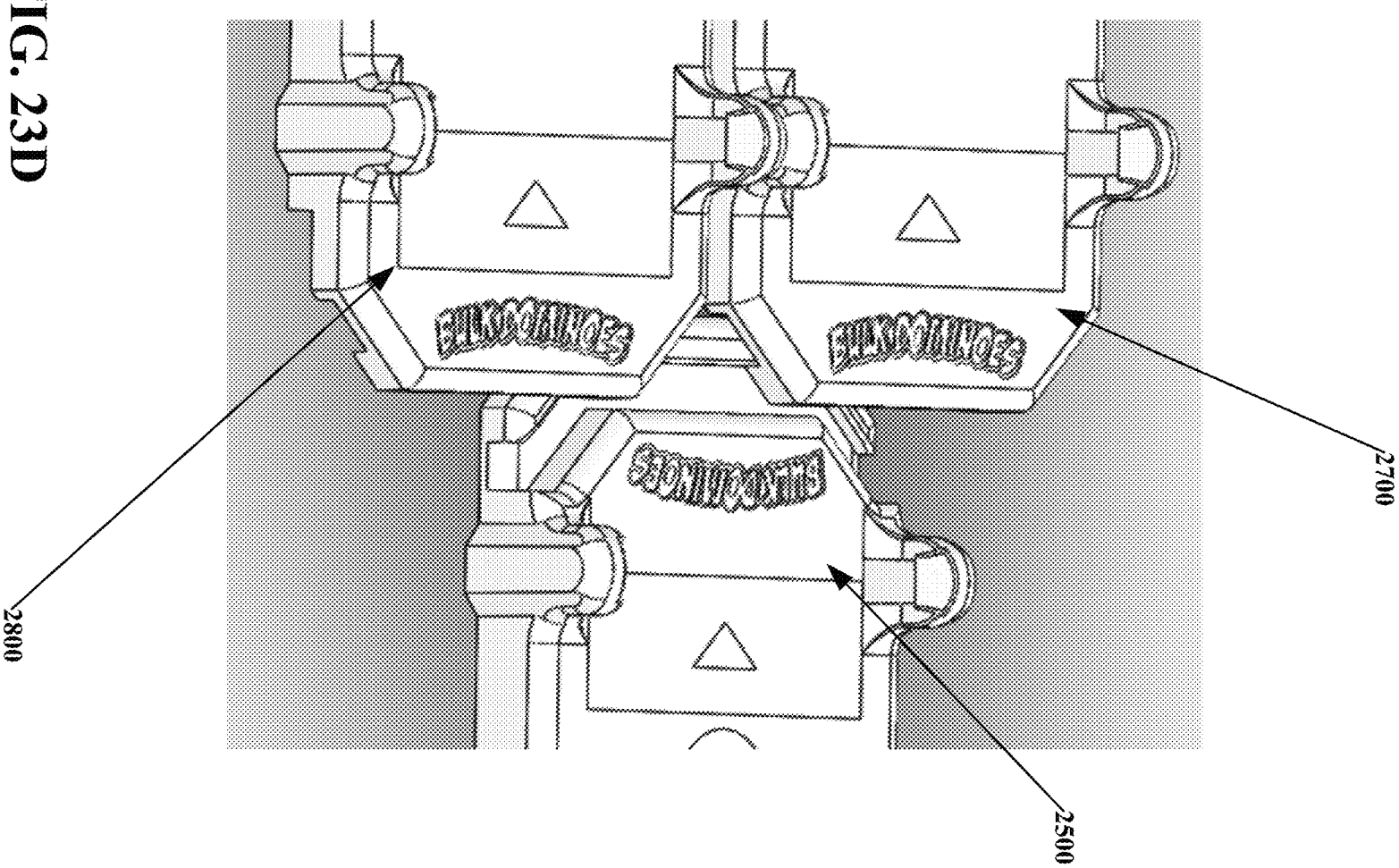

The tile 2000 may comprise a base plate 2010, a first face 2020, and a second face 2030, as shown in FIG. 14D. The base plate 2010 of the tile 2000 may include at least one length edge 2040, at least one width edge 2050, and a thickness. In an embodiment, either or both the length edge 2040 and width edge 2050 may serve as a mating portion of the tile 2000 to another component of the toy building system. For example, this interaction may be shown with the arc, see FIG. 16A for example, and the clips of the track, see FIGS. 20-22, as well as the other tiles shown in FIGS. 1 and 13 and clips shown in FIGS. 3-8. In an embodiment, the length edge 2040 or edge width 2050 of a tile 2000 may be inserted into a recess or space between two arms. In an embodiment, the thickness of the tile 2000 may generally correspond to the recess or space between the two arms of another component, such as an arc 300 or clip 700 to provide a friction or pressure fit of the tile 2000 into the corresponding mating portion. For example, FIG. 22 shows the width edge 2050 of a tile 2000 inserted into a clip 2600. The clip 2600, and therefore the tile 2000, may rotate about the axis defined by the connection of the clip 2600 to the track 2500 about angle $\alpha 1$, for example. The falling of the clip 2600 and tile 2000 from the standing position shown in FIG. 22, to the dotted outline in a falling position, may cause subsequent tiles and clips attached to the track (not shown) to also fall. The first face 2020 of the tile 2000 may include at least one projection 2022. This projection 2022 may generally correspond in size and shape to a first recess 2032 on the second face 2030 of the tile 2000, such that the projection 2022 on the first face 2020 of a first tile 2000 may attach to the first recess 2132 on the second face 2130 of a second tile 2100. In an embodiment, the projection 2022 and recess 2032 may generally correspond to a hexagonal shape. The projection 2022 and recess 2032 may also generally correspond to a triangle, square, rectangle, parallelogram, pentagon, or a shape having 6, 7, 8, 9, etc. sides. The shape may be irregular. The shape may include additional attachment features, such as other protrusions, teeth, snaps, or clipping aspects.

In an embodiment, the first face 2020 of a tile 2000 may include at least one recess 2024. This recess 2024 may generally correspond in size and shape to a projection 2034 on the second face 2030 of the tile 2000, such that the recess 2024 on the first face 2020 of a first tile 2000 may attach to the projection 2134 on the second face 2130 of a second tile 2100. In an embodiment, the recess 2024 and projection 2034 may generally correspond to a triangular shape. The recess 2024 and projection 2034 may also generally correspond to a square, rectangle, parallelogram, pentagon, hexagon, or a shape having 7, 8, 9, etc. sides. The shape may be irregular. The shape may include additional attachment features such as other protrusions, teeth, snaps, or clipping aspects. In an embodiment, the first face 2020 of a tile 2000 includes both a projection 2022 and a recess 2024 that respectively correspond to the recess 2032, 2132 and projection 2034, 2134 on the second face 2030, 2130 of the tile 2000 or a second tile 2100.

Figure 15A:
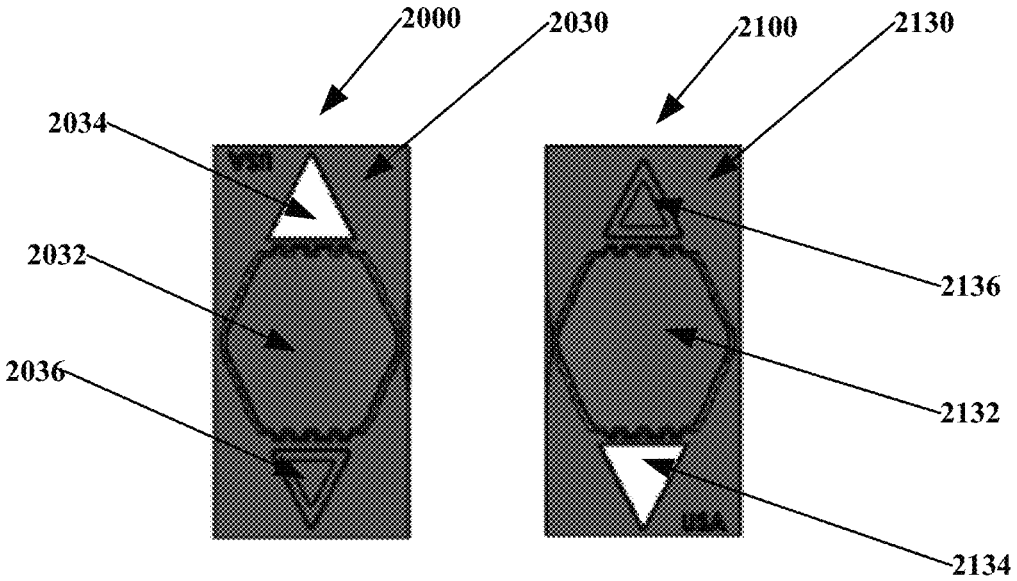
FIGS. 15A-B show a non-limiting attachment between two tiles.
Figure 15B:
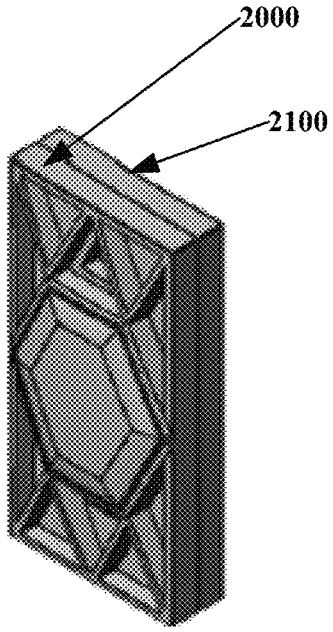

In an embodiment, the second face 2030 of the tile may further comprise a second recess 2036. The second recess 2036 may generally correspond in size and shape to the projection 2034 on the second face 2030 of the tile 2000, see FIG. 14B for example, such that the projection 2034 on the second face 2030 of a first tile 2000 may attach to the second recess 2136 on the second face 2130 of a second tile 2100. Additionally, the projection 2134 on the second face 2130 of the second tile 2100 may attach to the second recess 2036 on the second face 2030 of the first tile 2000. See FIG. 15A-15B showing an embodiment of a potential attachment between two tiles 2000, 2100. In other words, two tiles may be attached to one another either first face to second face (e.g. front to back) or second face to second face (e.g. back to back). In an embodiment, the second recess 2036 and projection 2034 may generally correspond to a triangular shape. The second recess 2036 and projection 2034 may also generally correspond to a square, rectangle, parallelogram, pentagon, hexagon or a shape having 7, 8, 9, etc. sides. The shape may be irregular. The shape may include additional attachment features such as other protrusions, teeth, snaps, or clipping aspects. In an embodiment, the projection 2034 on the second face 2030 of the tile 2000 may generally correspond in size and shape to the first recess 2024, 2124 on the first face 2020, 2120 of the tile 2000 or a second tile 2100 and the second recess 2036, 2136 on the second face 2030, 2130 of the tile 2000 or a second tile 2100, to provide multiple possible attachments between tiles.

FIGS. 16A-E depict an arc 2200. The arc 2200 may generally comprise a rounded portion 2210 and at least one attachment portion 2220. In an embodiment, the arc may have two attachment portions 2220, 2230, although additional attachment portions may also be included in the arc 2200. The attachment portion 2220 may comprise a receiving portion 2222 and one or more arms or engagement members 2224, 2226. The receiving portion 2222 and arm 2224 may be adapted to receive another piece of the toy building system. In an embodiment, the receiving portion 2222 and arm 2224 may be adapted to receive the length edge 2040 and/or width edge 2050 of a tile 2000 as well as tiles 100 and/or 1500. In an embodiment, the attachment portions 2220, 2230 may attach to the same tile, for example, the two length edges 2040 or two width edges 2050 of the tile 2000. In an embodiment, the attachment portions 2220, 2230 may each attach to an edge of a first tile and an edge of a second tile. In an embodiment, the arc 2200 and attached tile 2000 may balance so that the tile is in a generally upright or standing position. If a force is applied to the tile 100, 2000, as by another falling tile or a finger, for example, the tile 100, 2000 and arc 2200 may roll along the rounded portion 2210 to traverse a distance. The arc 2200 and attached tile 100, 2000 may interact with another tile in its path, as in dominos, or may interact with another chain reaction, as in a Rube Goldberg machine.

FIGS. 17A-F depict a line reactor 2300. The line reactor may include a first face 2310 and a second face 2320, and at least one panel 2330. Although FIGS. 17A-F generally depict a line reactor 2300 having two panels 2330, 2340, it is noted that any number of panels may be used including 1, 2, 3, 4, 5, 6, etc. panels. The line reactor 2300 and panels 2330, 2340 may be of any shape and size. In an embodiment, the line reactor 2300 and/or panels 2330, 2340 may be generally rectangular and similar in shape and size to a tile 100, 2000. The line reactor 2300 may be straight, or may be curved. The line reactor 2300 may further comprise at least one foot 2350. Although FIGS. 17A-F generally show two feet 2350, 2360 corresponding to two panels 2330, 2340, it is noted that the line reactor 2300 may include any number of feet, corresponding or not corresponding to the number of panels, and that the feet may be positioned in any location relative to the panels. For example, the feet 2350 may be generally placed in the middle of each panel 2330, on each end of the line reactor 2300, in the middle of the line reactor 2300, etc. The feet 2350 may stabilize the line reactor 2300 in an upright or standing position.

If a force is applied to the line reactor 2300, as by another falling tile or a finger, for example, the line reactor 2300 may fall over as a domino. The line reactor 2300 may interact with another tile in its path, as in dominos, or may interact with another chain reaction, as in a Rube Goldberg machine. In an embodiment, a force may be applied to the first panel 2330 of the line reactor, and the second panel 2340 of the line reactor may interact with a subsequent tile as it falls. In an embodiment, both the first and second panels 2330, 2340 may interact with subsequent lines of tiles to cause parallel lines of tiles to fall in unison. As a result, the line and trajectory of a domino show may be manipulated.

Figure 17A:
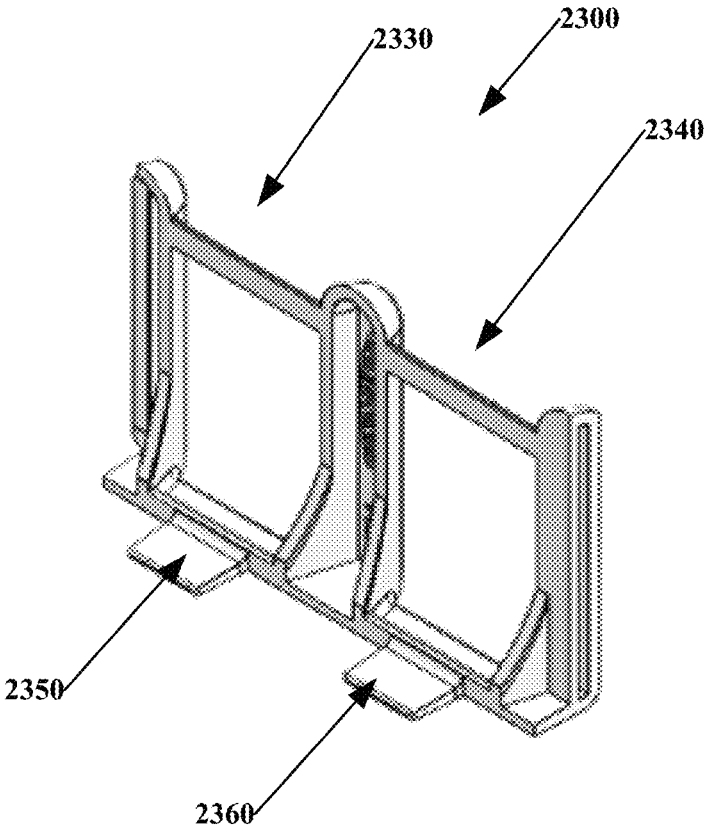
FIGS. 17A-C show an embodiment of a line reactor in a toy building system.
Figure 17B:
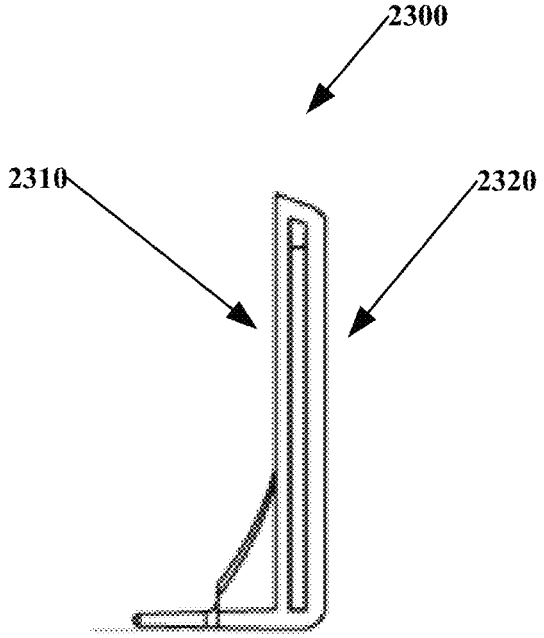
Figure 17C:
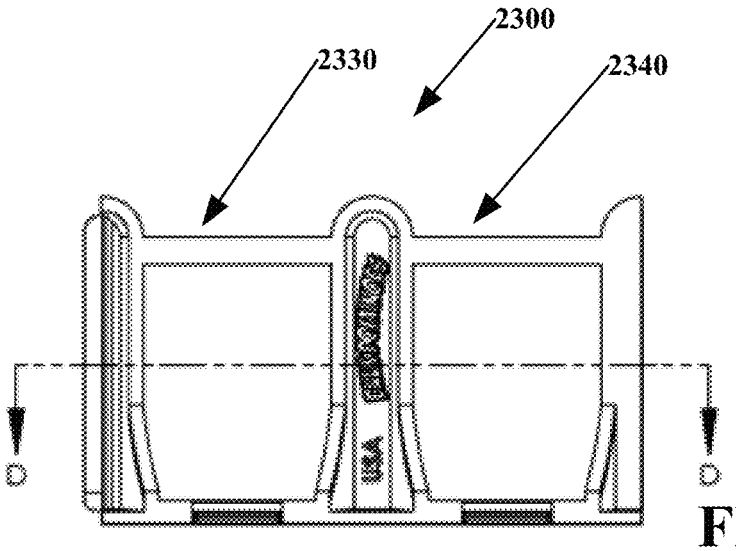
Figure 17D:
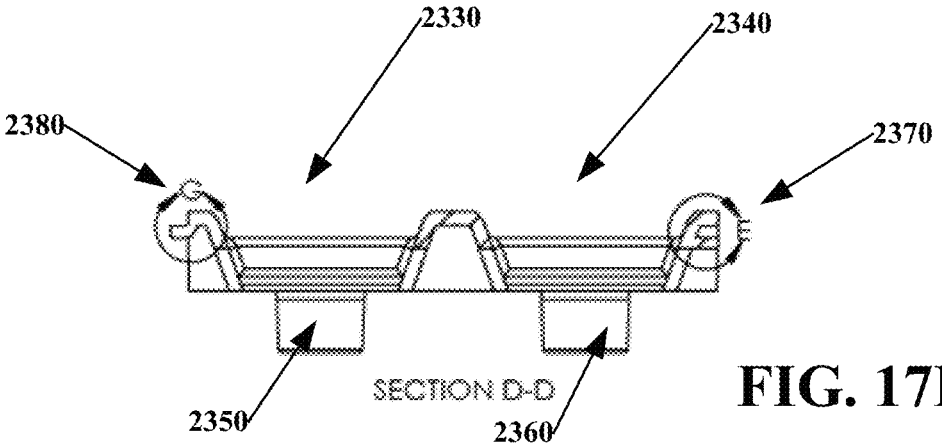
FIG. 17D shows a cross-section of the line reactor in FIG. 17C taken along line D-D.
Figure 17F:
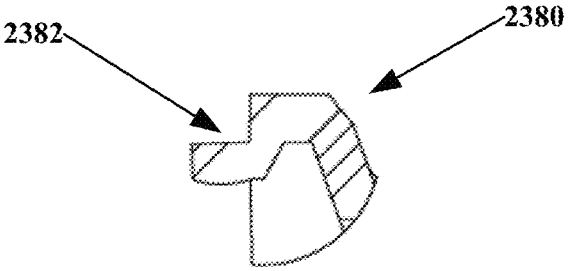
FIG. 17F shows a magnified view of section F of the line reactor as shown in FIG. 17D.
Figure 17E:
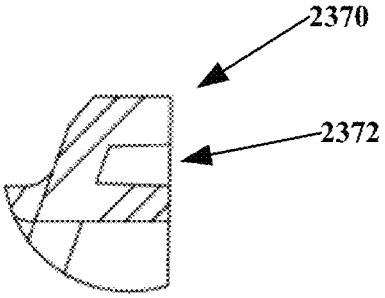
FIG. 17E shows a magnified view of section E of the line reactor as shown in FIG. 17D.
Figure 18:
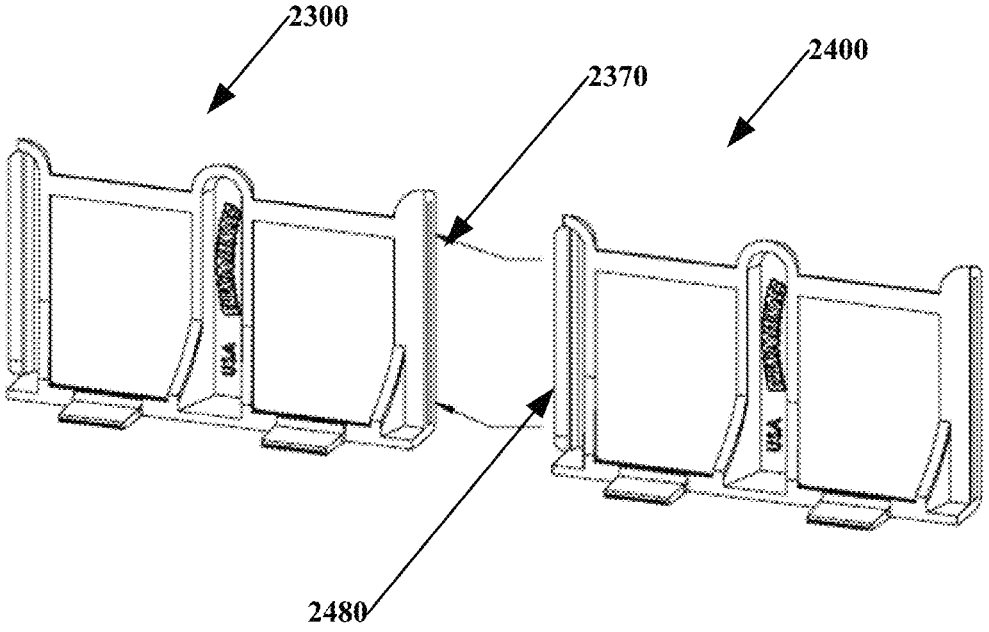
FIG. 18 shows a non-limiting attachment between two line reactors.
Figure 19A:
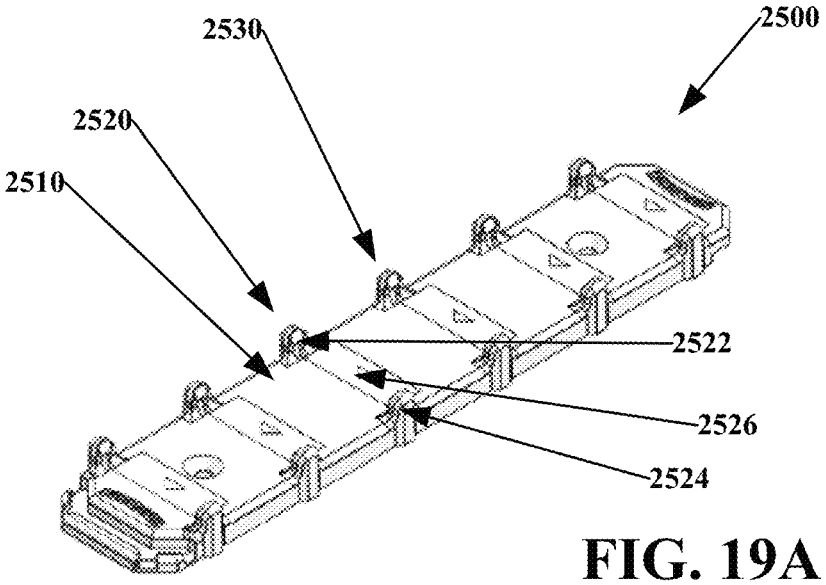
FIGS. 19A-D show an embodiment of a track in a toy building system.
Figure 19B:
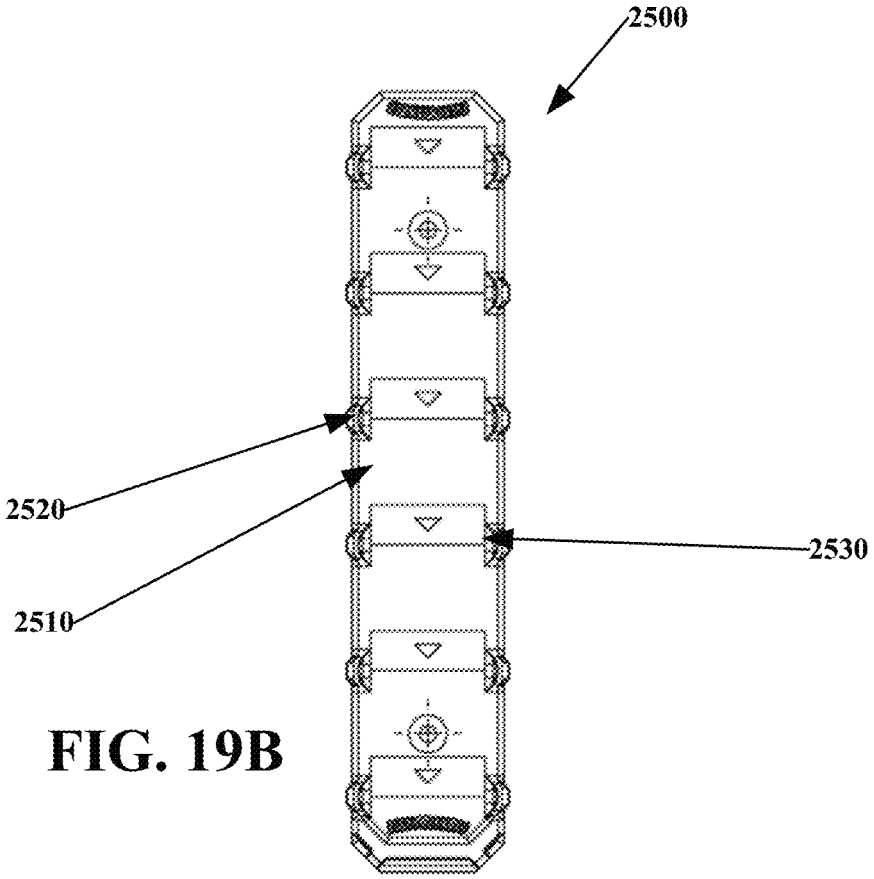
Figure 19C:
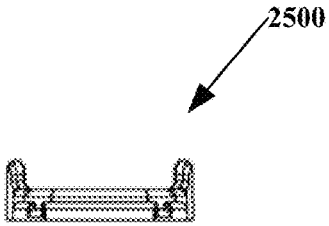
Figure 19D:
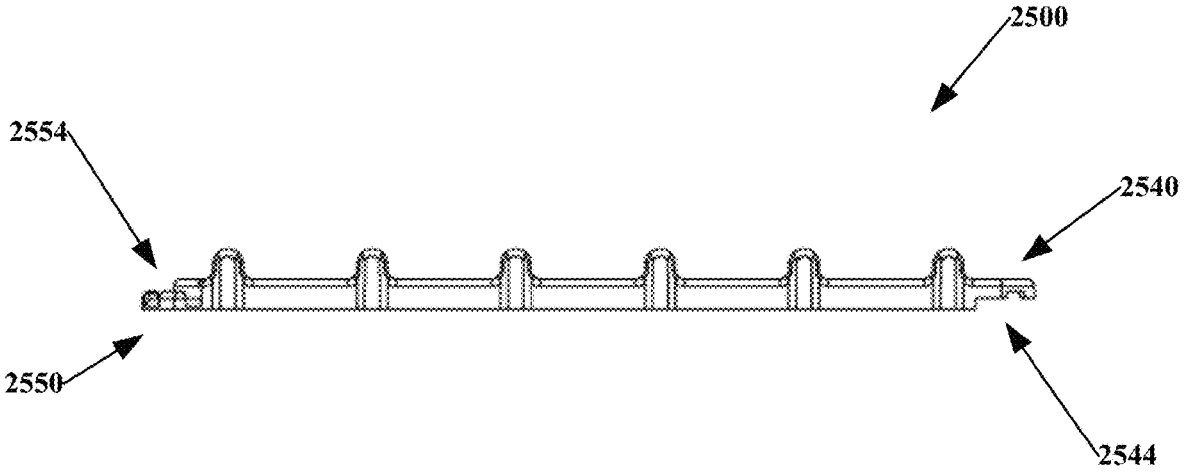
Figure 20A:
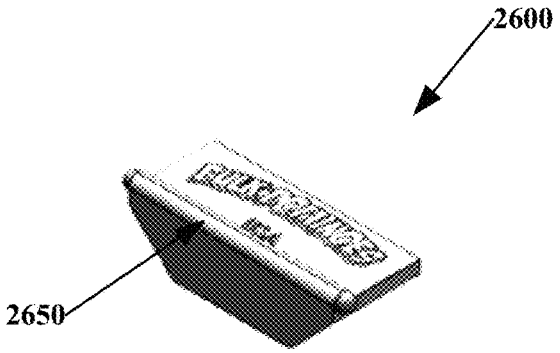
FIGS. 20A-D show an embodiment of a clip in a toy building system.
Figure 20C:
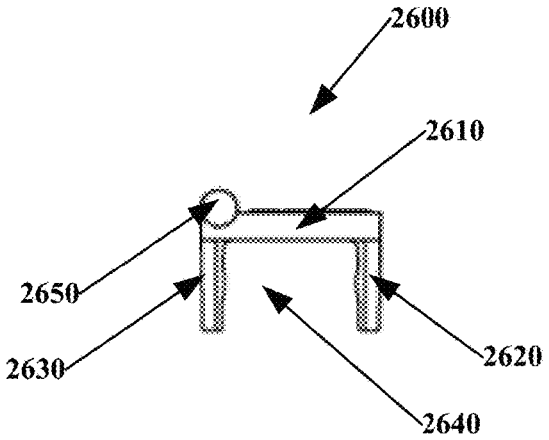
Figure 20B:
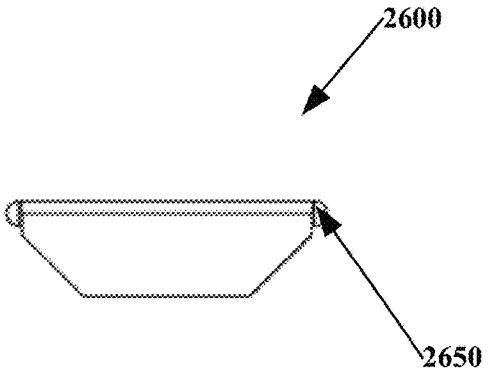
Figure 20D:
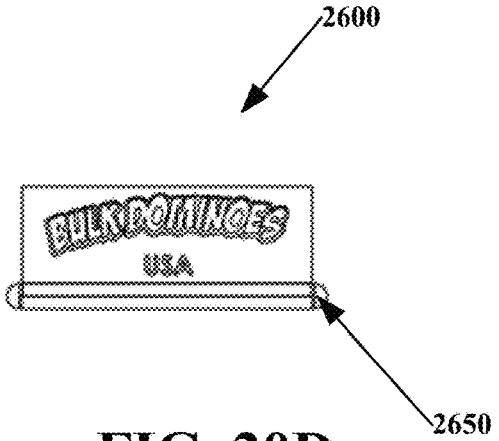

As shown in FIGS. 17D-E, the line reactor 2300 may include attachment portions 2370, 2380 on either end of line reactor 2300. The line reactor 2300 may attach to another line reactor 2400, as shown in FIG. 18, or to another component of the toy building system. In an embodiment, one attachment portion 2370 may include a recess 2372 that is selectively engageable to a mating projection. In an embodiment, another attachment portion 2380 may include the mating projection 2382. As show in FIGS. 17D-E, each end or side of the line reactor 2300 may include either the mating projection or the mating recess so that a line reactor 2300 may be able to receive another line reactor in the first attachment portion 2370 and/or engage another line reactor in the second attachment portion 2380. As a result, the attachment portion 2370 comprising the recess 2372 may engage the projection 2482 of the attachment portion 2480 of a second line reactor 2400. It is noted that the inverse may also occur where the attachment portion 2380 comprising the projection 2382 may engage the recess 2472 of the attachment portion 2470 of a second line reactor 2400. Multiple line reactors may be connected, including, for example, 2, 3, 4, 5, 6 line reactors. The line reactors may interact with one or more lines of dominos, other line reactors, or other components of the toy building system such as an arc or track.

FIGS. 19-24 depict tracks 2500 and clips 2600, and the selective assembly thereof that may facilitate the building of a domino show. The track 2500 may generally include a base 2510 and a plurality of clip attachment portions 2520, 2530 that are configured to receive a clip 2600 shown in FIGS. 20A-D. The track 2500 may include the plurality of clip attachment portions 2520, 2530 in a substantially straight line, or the plurality of clip attachment portions 2520, 2530 may be staggered, curved, rotatable, adjustable, or irregular to comprise various shapes and patterns as desired. In an embodiment, the clip attachment portions 2520 may include two arms 2522, 2524 and a space 2526 therebetween configured to accommodate a clip 2600. The arms 2522, 2524 may further including a mating portion to engage the clip 2600.

The clip 2600 may selectively attach to the track 2500. In an embodiment, the clip 2600 and track 2500 may each include corresponding mating portions to facilitate attachment. The clip 2600 itself may include a base 2610, two walls 2620, 2630 extending from the base 2610, and a space 2640 therebetween configured to accommodate a tile 100, 2000. It is noted that either the length edge 2040 or width edge 2050 of a tile 2000 (or tile 100) may be inserted into the walls 2620, 2630 and space 2640 of the clip 2600. The space 2640 may further include raised or rough areas or other engaging members to further secure a tile 100, 2000 within the clip 2600. The clip 2600 may also include a rounded rod 2650 extending from the base 2610 that engages with the mating portion of the arms 2522, 2524 of the track 2500. In an embodiment, a portion of the rod 2650 may extend into a hole in the arms 2522, 2524 to create an axis by which the clip 2600 may rotate.

In an embodiment, the clip 2600 may rest in the space 2526 between the arms 2522, 2524 of the track 2500 in a first position. In this first position, shown in FIG. 21D, any tile 100, 2000 inserted into the clip 2600 may rest slightly backwards compared to the direction in which the tiles 100, 2000 will fall. For example, if a force is applied to the tile 100, 2000, as by another falling tile or a finger, for example, the tile 100, 2000 may rotate along the axis defined by the rod 2650 of the clip 2600 from a first position to a second position, wherein the tile may thereby interact with another tile in its path or on the track 2500, as in dominos, or may interact with another chain reaction, as in a Rube Goldberg machine. Unlike conventional dominos, however, where the precise placement of each tile must be carefully executed in order to create a domino show, as described herein, the tiles may be easily transitioned from the second falling position to the first resting position by temporarily angling the track 2500 in that direction and allowing the weight of the tiles to fall back into the first position. Alternatively each tile may be manually pushed back into the first position or the final fallen tile may be pushed back so as to force the other tiles back as well. The transition of the tiles on the track 2500 from a first position to a second position, and back again, may be repeated indefinitely.

Figure 24:
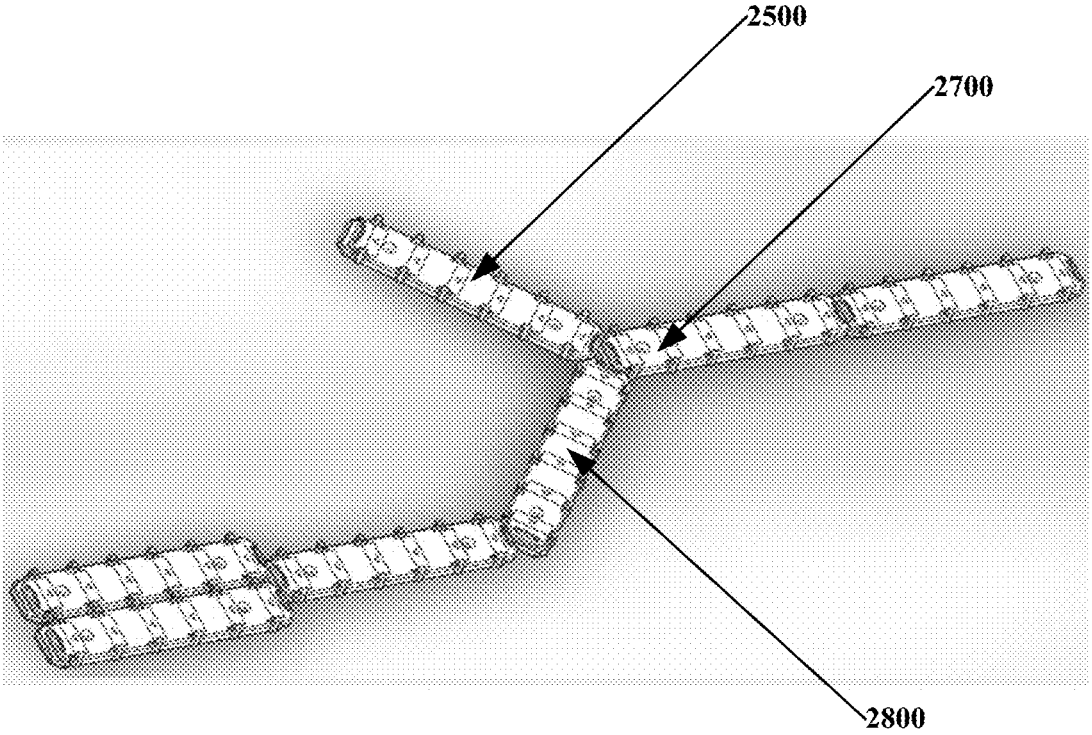

As shown in FIGS. 23-24, multiple tracks 2500, 2700, 2800 may be connected to each other in various angles and orientations to create a domino show. Similar to the connections between line reactors 2300, each end 2540, 2550 of the track 2500 may include mating portions, see FIG. 19D for example. In an embodiment, a first end 2540 of the track 2500 may include a mating portion 2542 on the underside 2544 of the end 2540. In an embodiment, a second end 2550 of the track 2500 may include a mating portion 2552 on the topside 2554 of the end 2550 (although, they could also be the opposite). The mating portions 2542, 2552 may generally comprise corresponding recesses and projections that enable the connection between the two mating portions of two or more tracks 2500, 2700, 2800, see FIG. 23A for example, showing a straight connection between two tracks 2500, 2700. Multiple tracks may be connected, including, for example, 2, 3, 4, 5, 6, etc. tracks. The tracks may be connected in a straight configuration, see FIG. 23A, or at an angle, see FIG. 23C. The angle at which the tracks connect can be any appropriate angle, e.g., any of 15 degrees through 200 degrees relative to one another. Multiple tracks may be connected to a single track in a straight configuration, see FIG. 23D, and multiple tracks may be connected to a single track at an angle or angles, see FIG. 23B. The tracks may interact with one or more lines of dominos, arcs, line reactors, other tracks, or other components of the toy building system.

Turning to FIGS. 25A-D, an embodiment of a rotatable track 2900 is shown. The rotatable track 2900 may generally include a base 2910 and at least one clip attachment portion 2920 that is configured to receive a clip, for example clip 2600 shown in FIGS. 20A-D or any other clip disclosed herein or otherwise available. In an embodiment including a plurality of clip attachment portions 2920, 2930, the rotatable track 2900 may include the plurality of clip attachment portions 2920, 2930 (not shown) in a substantially straight line, or the plurality of clip attachment portions 2920, 2930 may be staggered, curved, rotatable, adjustable, or irregular to comprise various shapes and patterns as desired. In an embodiment, the clip attachment portion 2920 may include two arms 2922, 2924 and a space 2926 therebetween configured to accommodate a clip 2600 and/or to accommodate directly a tile such as tile 100. The arms 2922, 2924 may further include a mating portion to engage the clip 2600. As described herein, the clip 2600 and/or tile 100 may selectively attach to the rotatable track 2900. In an embodiment, the clip 2600 (and/or tile 100) and rotatable track 2900 may each include corresponding mating portions to facilitate attachment. In an embodiment, the clip 2600 may include a rounded rod 2650 extending from the base 2610 that engages with the mating portion of the arms 2922, 2924 of the rotatable track 2900. In an embodiment, a portion of the rod 2650 may extend into a hole in the arms 2922, 2924 to create an axis by which the clip 2600 may rotate.

Figure 28:
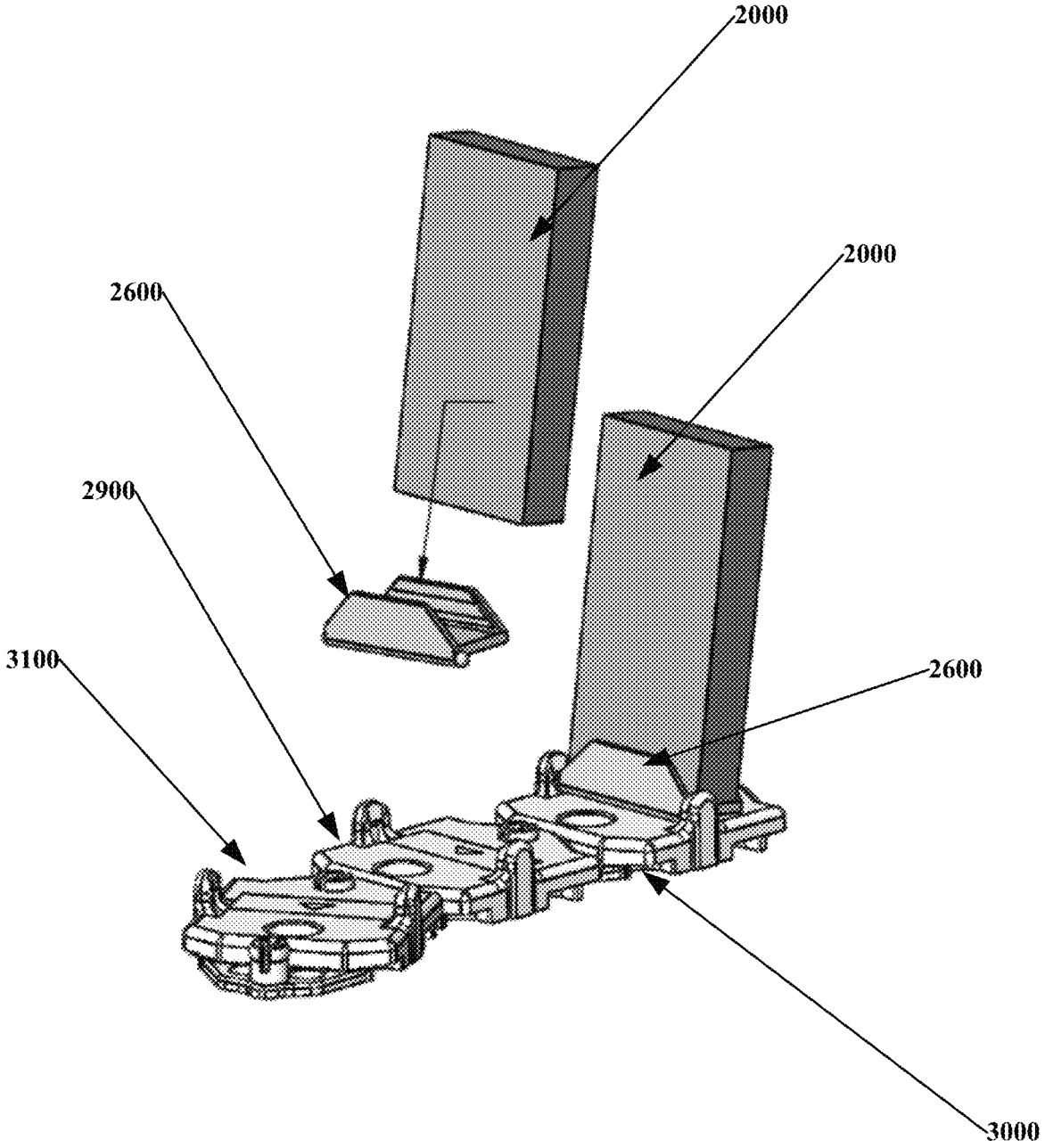
FIG. 28 shows a non-limiting attachment between a tile, a clip, and a rotatable track.

In an embodiment, the clip 2600 may rest in the space 2926 between the arms 2922, 2924 of the rotatable track 2900 in a first position, see FIG. 28. The first position may be similar to that shown in FIG. 21D illustrating clip 2600 inserted into track 2500. Here too, any tile 100, 2000 inserted into the clip 2600 may rest slightly backwards compared to the direction in which the tiles 100, 2000 will fall. The tile 100, 2000 and clip 2600 may rotate along the axis defined by the rod 2650 of the clip 2600 from a first position to a second position, wherein the tile may thereby interact with another tile or piece of the domino system. Unlike conventional dominos, however, where the precise placement of each tile must be carefully executed in order to create a domino show, as described herein, the tiles may be easily transitioned from the second falling position to the first resting position by temporarily angling the rotatable track 2900 in that direction and allowing the weight of the tiles to fall back into the first position. Alternatively each tile may be manually pushed back into the first position or the final fallen tile may be pushed back so as to force the other tiles back as well. The transition of the tiles on the rotatable track 2900 from a first position to a second position, and back again, may be repeated indefinitely.

Figure 27:
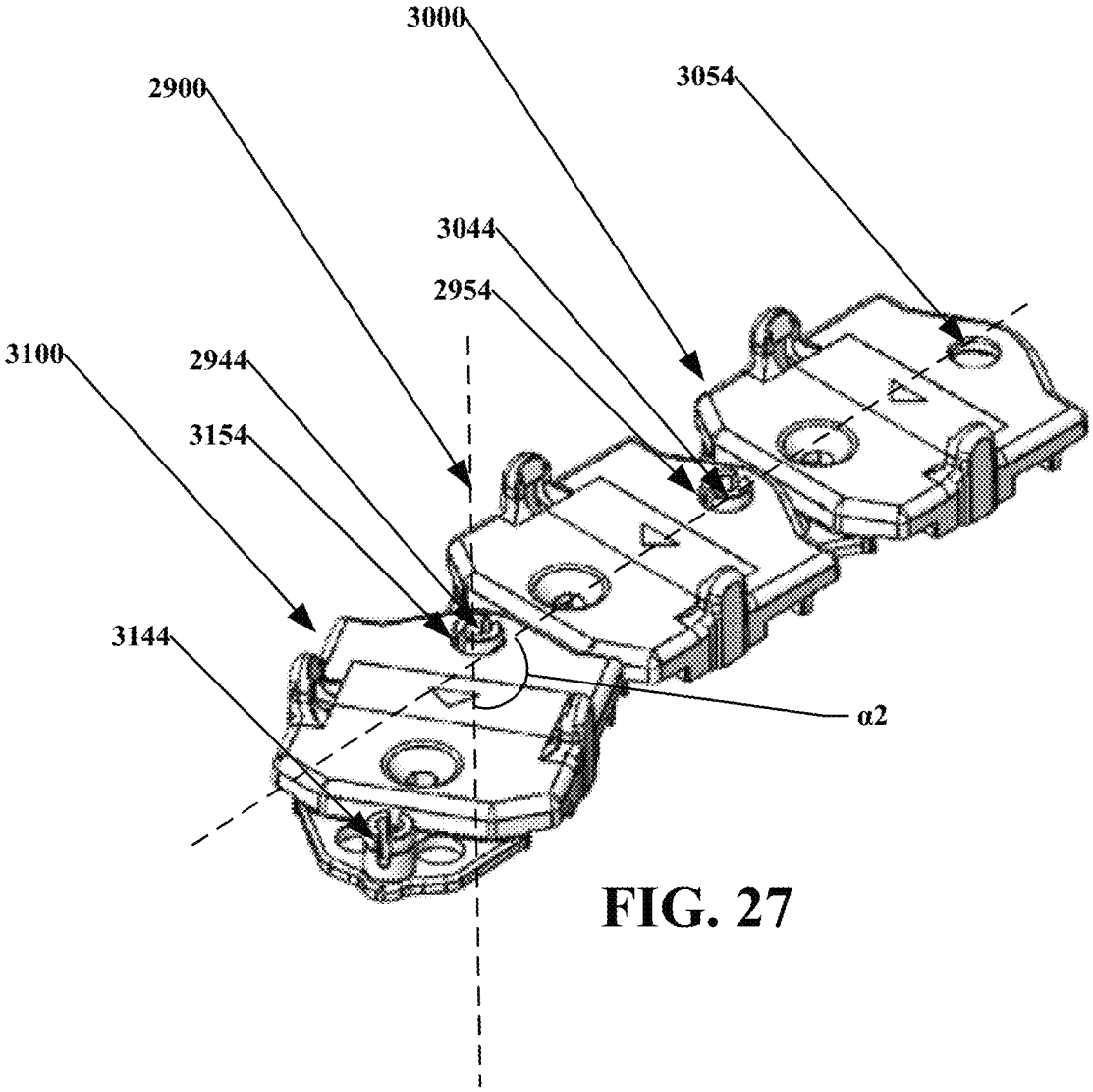
FIG. 27 shows non-limiting attachments between multiple rotatable tracks.

As shown in FIG. 27, multiple rotatable tracks 2900, 3000, 3100 may be connected to each other in various angles and orientations to create a domino show. Similar to the connections between line reactors 2300 and tracks 2500, each end 2940, 2950 of the track 2900 may include mating portions, see FIGS. 25A-C and 26A-D for example. Although, it should be understood that these mating portions may be of any appropriate configuration and are not limited to just those shown. By way of a non-limiting example, the mating portions may comprise friction fit, mating bayonet parts, slot and tab, multiple slots and tabs, any female to male or male to female engagement, tab and aperture, etc. As shown, the mating portions 2942, 2952 may generally comprise corresponding recesses, apertures, projections, and spaces that enable the connection between the two mating portions of two or more rotatable tracks 2900, 3000, 3100, see FIG. 27 for example, showing a connection between three tracks 2900, 3000, 3100. In an embodiment, the mating portions 2942, 2952 of a rotatable track and the mating portions 2542, 2552 of a straight track 2500 may correspond and selectively engage, such that the first mating portion 2542 of the straight track 2500 may engage with the second mating portion 2952 of the rotatable track 2900 and the first mating portion 2942 of the rotatable track 2900 may engage with the second mating portion 2552 of the straight track 2500. It is noted that although different engaging members are described for the straight track 2500, 2600, 2700 and the rotatable track 2900, 3000, 3100, that the engaging members may be combined or reversed.

Figure 25A:
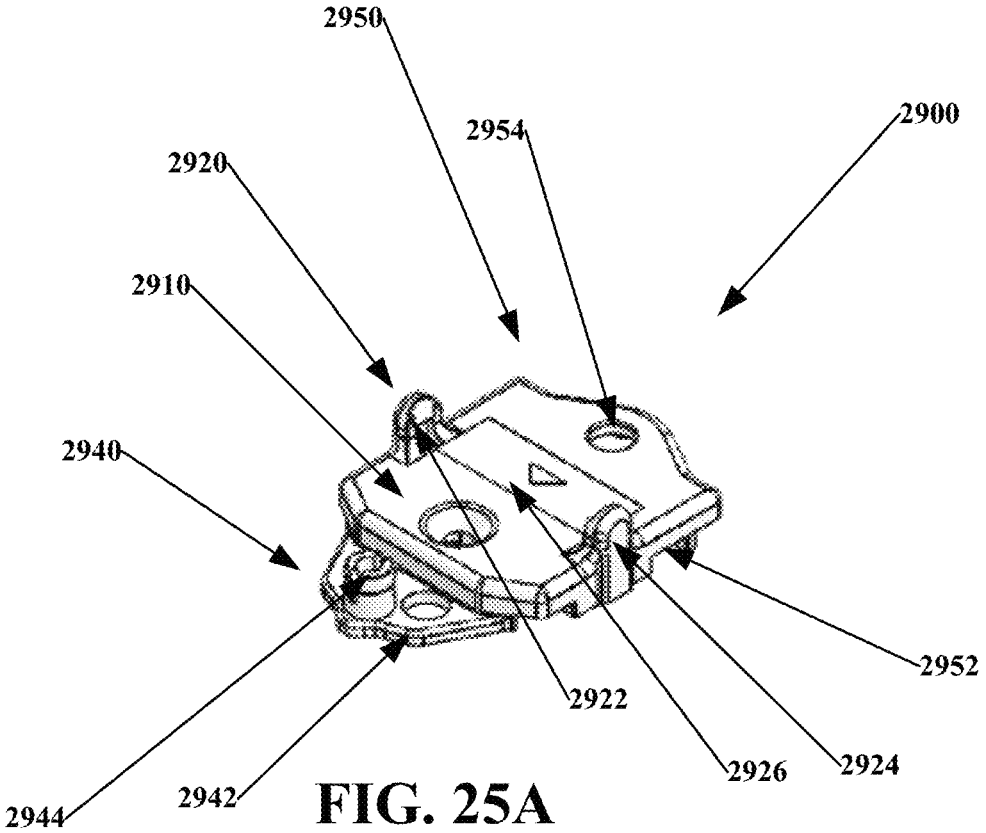
FIGS. 25A-D show an embodiment of a rotatable track in a toy building system.
Figure 25B:
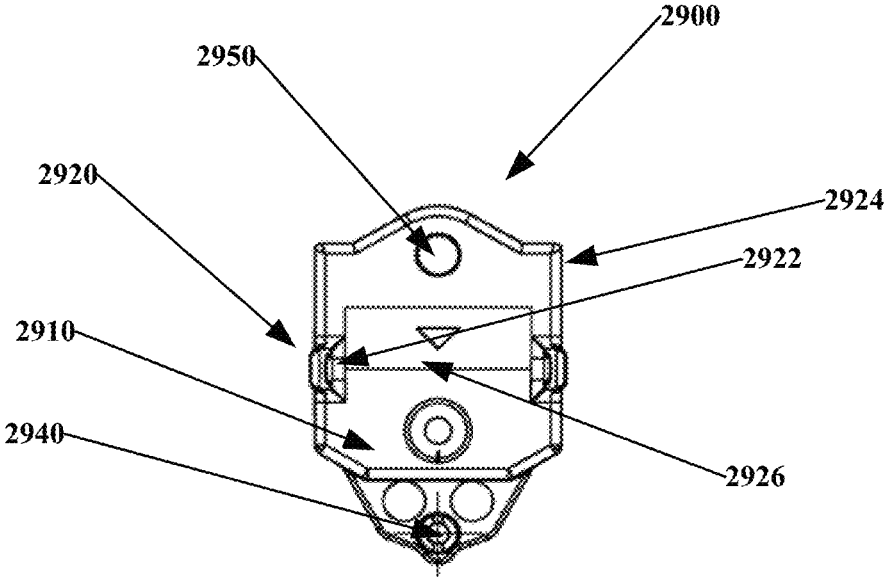
Figure 25C:
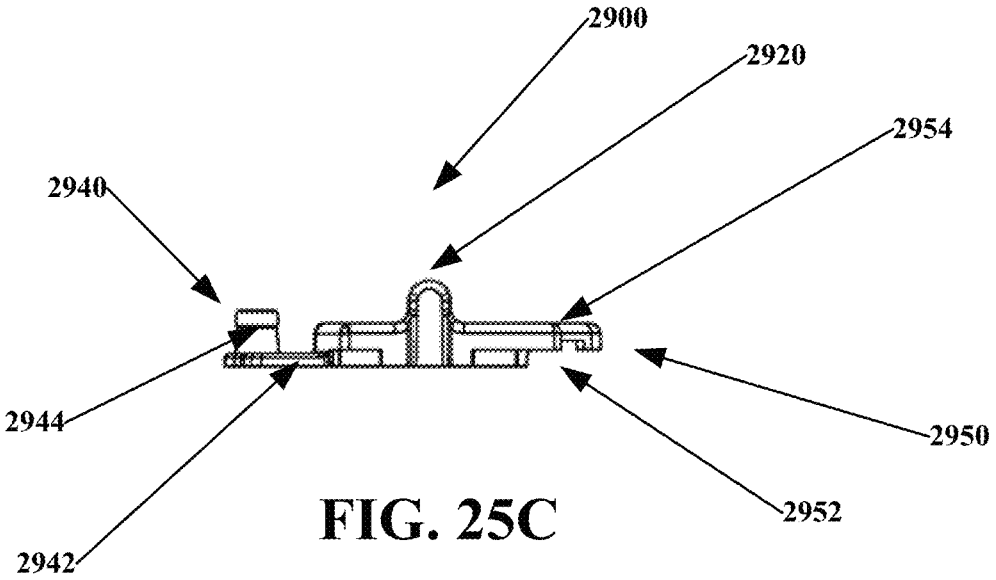
Figure 25D:
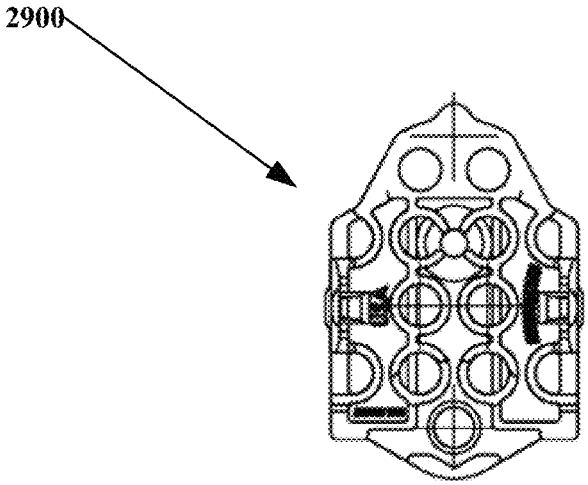
Figure 26A:
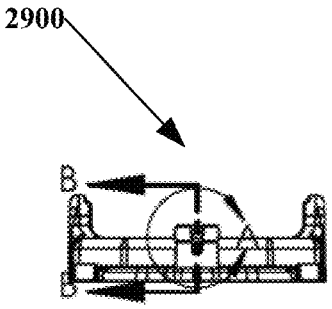
FIG. 26A shows an embodiment of a rotatable track in a toy building system.
Figure 26B:
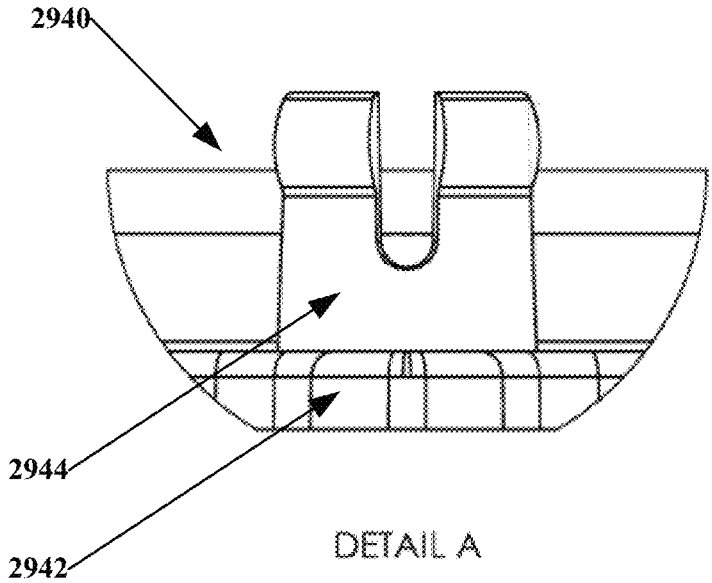
FIG. 26B is a magnified view of section A of the rotatable track as shown in FIG. 13A.
Figure 26C:
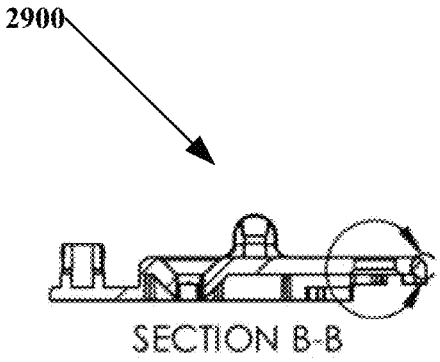
FIG. 26C shows a cross-section of the rotatable track in FIG. 13A taken along line B-B.
Figure 26D:
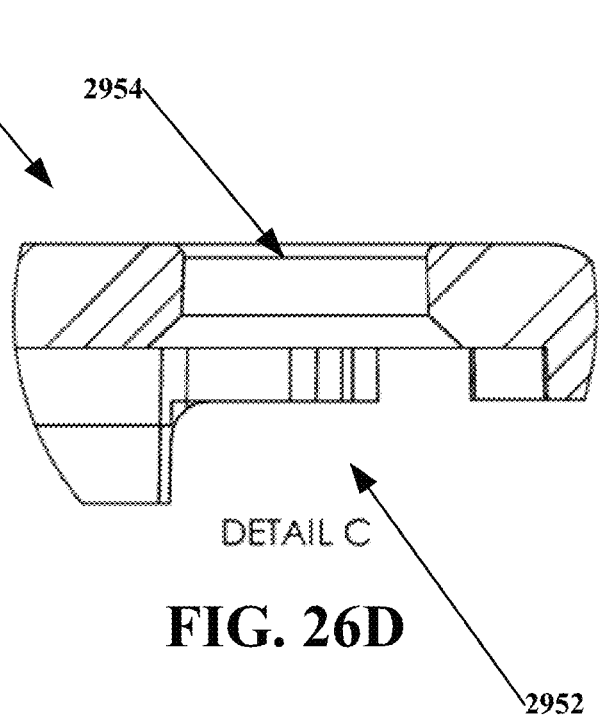
FIG. 26D is a magnified view of section C of the rotatable track as shown in FIG. 13C.

In an embodiment, a first end 2940 of the rotatable track 2900 may include a rotatable base 2942 and projection 2944 that corresponds to a space 2952 and receiving portion or aperture 2954 on the second end 2950 of the rotatable track 2900 or another rotatable track 3000, see FIGS. 25A and 25B as well as FIGS. 26-D showing an embodiment of the mating portions. In an embodiment, the rotatable base 2942 and projection 2944 of a first rotatable track 2900 may selectively engage with the space 3052 and receiving portion or aperture 3054 on a second rotatable track 3000 and vice versa, where the rotatable base 3042 and projection 3044 of the second rotatable track 3000 may selectively engage with the space 2952 and receiving portion or aperture 2954 on the first rotatable track 2900. Multiple tracks may be connected, including, for example, 2, 3, 4, 5, 6, etc. rotatable tracks. The connection between the rotatable tracks may be rotated about the axes defined by the rotatable bases, 2942, 3042, 3142 and the engagement between projections and apertures such as the aperture 2954 of a first track 2900 and the projection 3044 of a second track as well as the engagement between the projection 2944 of the first track and the aperture 3152 of a third track 3100 as shown in FIG. 27. In an embodiment, the connection between two rotatable tracks may be about 180°, but is not limited to such. In some embodiments, the connection may be between 15 to 200 degrees relative to one another. For example, the connection may be rotated to an angle $\alpha$2. The rotatable tracks may interact with one or more lines of tiles, arcs, line reactors, tracks, launchers, or other components of the toy building system. In fact, the rotatable tracks may be attached to one another to form any straight or curved shape, such as even a full or partial circle. The tracks may also be attached such that they lie on a different plan to add height to the falling path for the dominoes.

Figure 29:
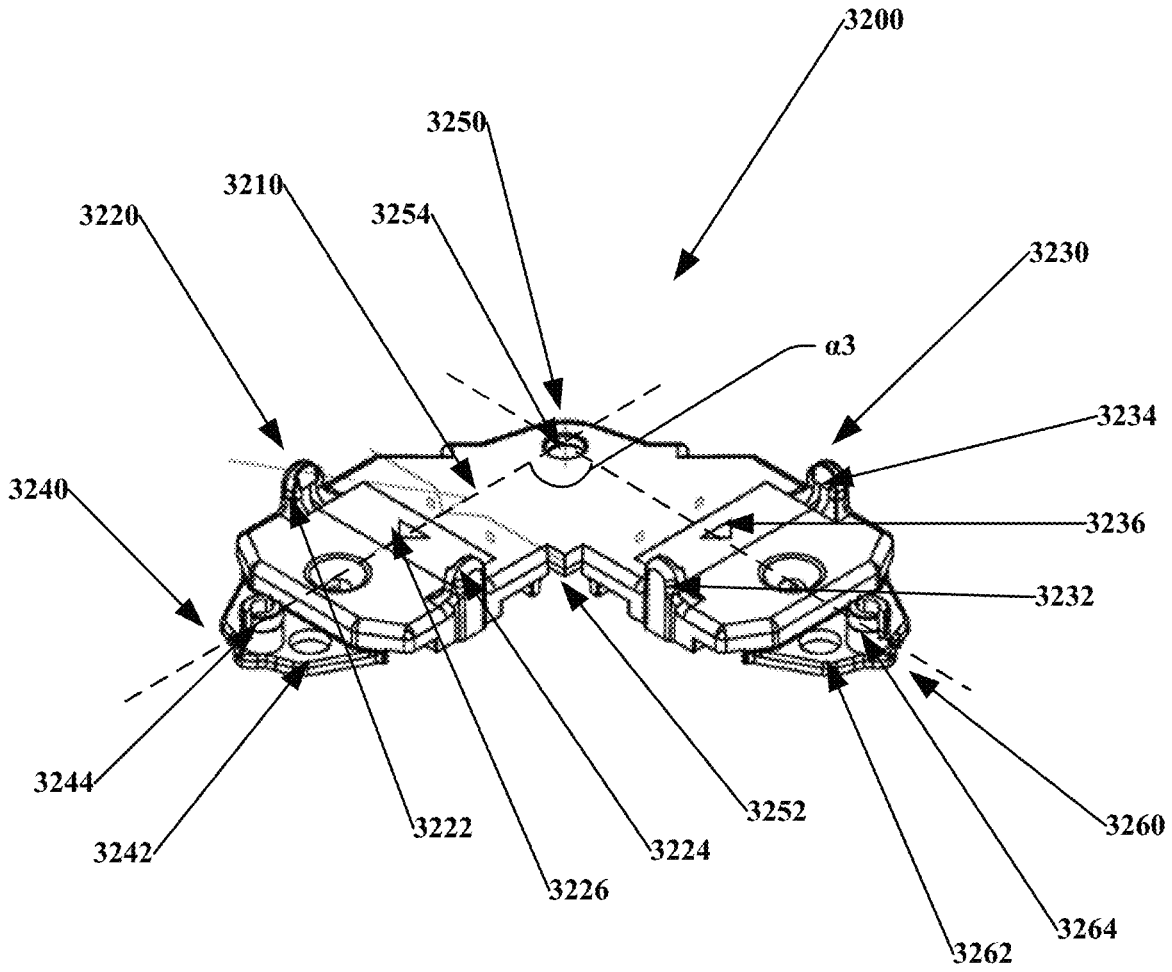
FIG. 29 shows an embodiment of a split track in a toy building system.

FIG. 29 shows a split track 3200. In an embodiment, the split track 3200 may generally include a base 3210 and two clip attachment portions 3220, 3230. The clip attachment portions 3220, 3230 may be positioned at an angle (any appropriate angle may work, e.g., 45 degrees or 90 degrees or anything therebetween relative to one another) from one another two define two separate falling tracks or paths. In an embodiment, the clip attachment portions 3220, 3230 may be positioned at a 90° angle 2 one another. In an embodiment, the clip attachment portions 3220, 3230 may be positioned at an angle between about 20° to about 180° from one another. In an embodiment, the clip attachment portions 3220, 3230 may be positioned at angle $\alpha$3 from one another. The clip attachment portions 3220, 3230 may be each configured to receive a clip, for example clip 2600 shown in FIGS. 20A-D or a tile, such as tile 100. In an embodiment, the clip attachment portions 3220, 3230 may be similar to the clip attachment portions in the straight track 2500 and rotatable track 2900. The clip attachment portions 3220, 3230 may each include two arms 3222, 3224 and 3232, 3234 and a space 3226 and 3236 therebetween respectively configured to accommodate a clip 2600. The arms 3222, 3224 and 3232, 3234 may further include a mating portion to engage the clip 2600. As described herein, the clip 2600 may selectively attach to the split track 3200. In an embodiment, the clip 2600 and split track 3200 may each include corresponding mating portions to facilitate attachment. In an embodiment, the clip 2600 may include a rounded rod 2650 extending from the base 2610 that engages with the mating portion of the arms 3222, 3224 and 3232, 3234 of the split track 3200. In an embodiment, a portion of the rod 2650 may extend into a hole in the arms 3222, 3224 and 3232, 3234 to create an axis by which the clip 2600 may rotate, such as by way of a non-limiting example between about 15 to 200 degrees relative to one another.

In an embodiment, the mating portions of the split track 3200 may be similar to that of the rotatable track 2900. In an embodiment, the split track 3200 may include a rotatable portion to manipulate the curvature of a falling line similar to the rotatable track 2900. In an embodiment, a first end 3240 of the split track 3200 may include a rotatable base 3242 and projection 3244. A second end 3250 of the split track 3200 may include a space 3252 and a receiving portion or aperture 3254—although any appropriate attachment portions can work as well. A third end 3260 of the split track 3200 may include a rotatable base 3262 and projection 3264. The rotatable base 3242 and projection 3244 of the first end 3240 and the rotatable base 3262 and projection 3264 of the third end 3260 may correspond to the space 3252 and a receiving portion or aperture 3254 of the second end or the space 2952 and receiving portion or aperture 2954 on the second end 2950 of the rotatable track 2900, see FIGS. 27 and 29.

In an embodiment, the rotatable bases 3242, 3262 and projections 3244, 3264 of the split track may selectively engage with any of the mating components on another split track or on the rotatable track. For example, the rotatable base 3242 and projection 3244 of the first end 3240 of a first split track 3200, or the rotatable base 3262 and projection 3264 of the third end 3260 of a first split track 3200, may selectively engage with the space and receiving portion or aperture on a second split track and vice versa as well as the space 2952 and receiving portion or aperture 2954 the rotatable track 2900. In an embodiment, the space 3252 and receiving portion or aperture 3254 of the split track 3200 may selectively engage with any of the mating components on another split track or on the rotatable track. For example, the space 3252 and receiving portion or aperture 3254 of the split track 3200 may selectively engage with the rotatable base 2942 and projection 2944 of a second split track or the rotatable base and projection of rotatable track 1900. Multiple split track and/or rotatable tracks may be connected, including, for example, 2, 3, 4, 5, 6, etc. rotatable 2900 or split tracks 3200. The connection between the split tracks 3200, with another split track or with a rotatable track 2900, may be rotated about the axes defined by the rotatable bases, 3242, 3262 and the engagement between projections and apertures of another component of the system. In an embodiment, the connection between a split track and another track may be about 180°. Although, the split track and another track may be at an angle of connection that is between 15 to 200 degrees relative to one another. The rotatable tracks may interact with one or more lines of tiles, arcs, line reactors, tracks, launchers, or other components of the toy building system.

The split track 3200 may serve to split a single falling lane, path, or line, or a single force, into two falling lanes, paths, or lines or even potentially act as a stop or end. The split tracks 3200 may interact with one or more lines of tiles, arcs, line reactors, tracks, launchers, or other components of the toy building system. For example, a tile 190, 1400 may each be selectively positioned in a corresponding clip that is selectively positioned in the clip attachment portions 3220, 3230 that are oriented at an angle (any appropriate angle may be suitable, such as by way of a non-limiting example, between 20 and 200 degrees relative to one another) from one another on the split track 3200 and that each define a new falling line. In an embodiment, a single falling line of tiles, arcs, line reactors, tracks, launchers, etc. may simultaneously or near simultaneously engage both of the interconnecting or flat tiles 100, 2000, 3300 to initiate each of their individual and subsequent falling lines. This can be repeated to have any number of falling lines at a single time.

FIGS. 30A-D show an embodiment of a flat tile 3300. The flat tile 3300 may share similar aspects to that of the interconnecting tiles 100, 2000, such as length, width, and thickness so as to be able to similarly interconnect with other components of the toy building system, such as the clips 2600 or arc 2200. Similar to the interconnecting tiles 100, 2000, certain aspects may be varied, such as length and width to provide various shapes, sizes, and types of tiles that may be used in the toy building system. The flat tile 3300 may also be configured in dimensions similarly to that of the mini tile 1500. In an embodiment, the flat tile 3300 may comprise a base plate 3310, a first face 3320, and a second face 3330, as shown in FIGS. 30A-D. The base plate 3310 of the tile 3300 may include at least one length edge 3340, at least one width edge 3350, and a thickness. In an embodiment, either or both the length edge 3340 and width edge 3350 may serve as a mating portion of the flat tile 3300 to another component of the toy building system.

Figure 16A:
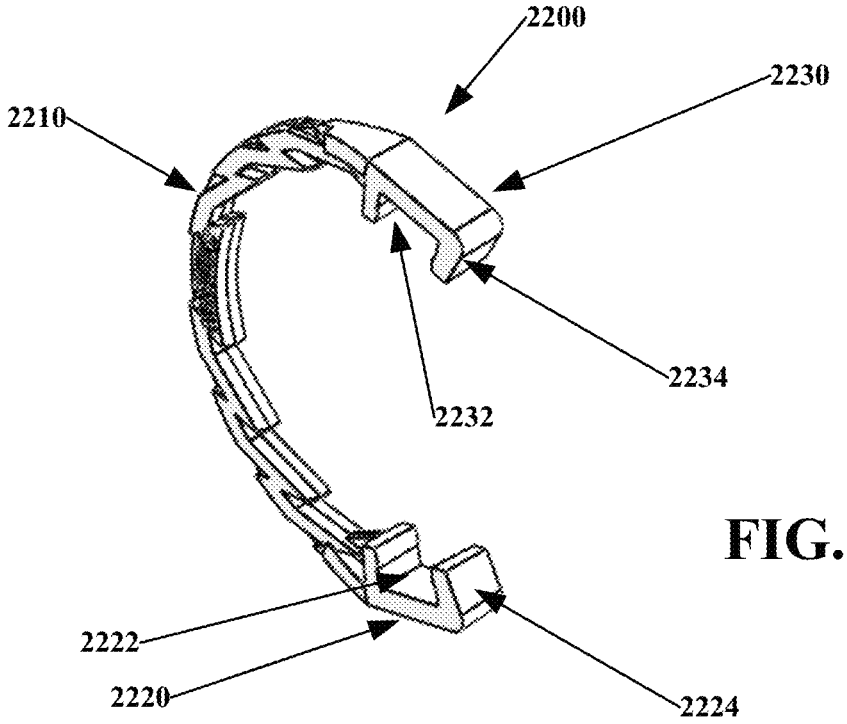
FIGS. 16A-D show an embodiment of an arc in a toy building system.
Figure 16B:
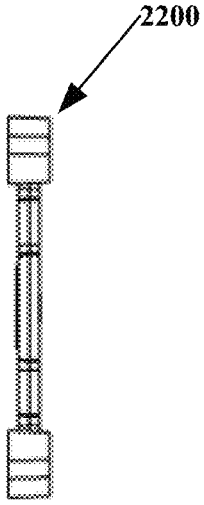
Figure 16C:
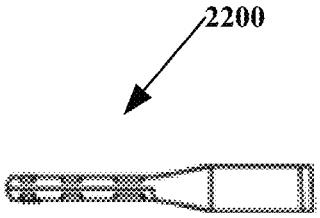
Figure 16D:
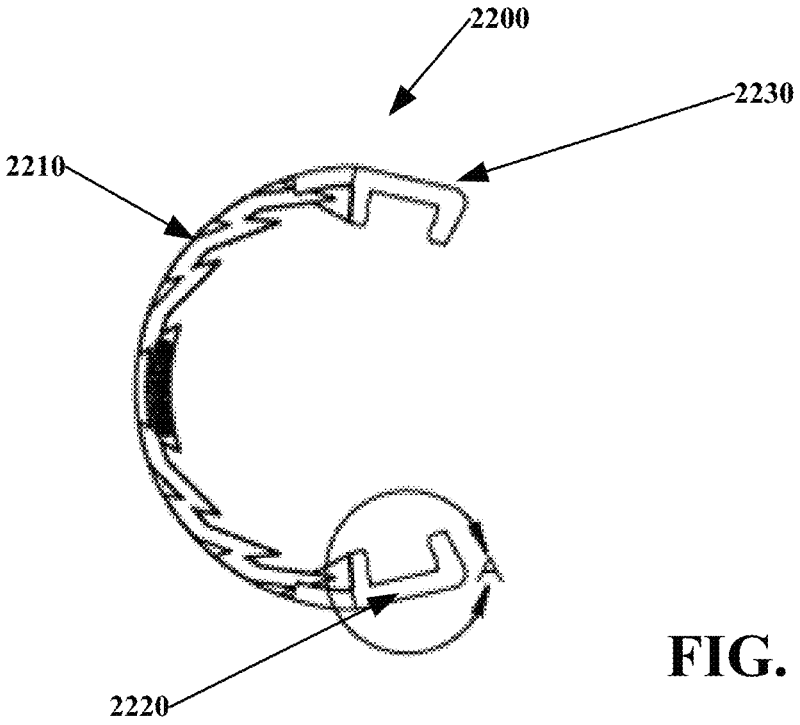
Figure 16E:
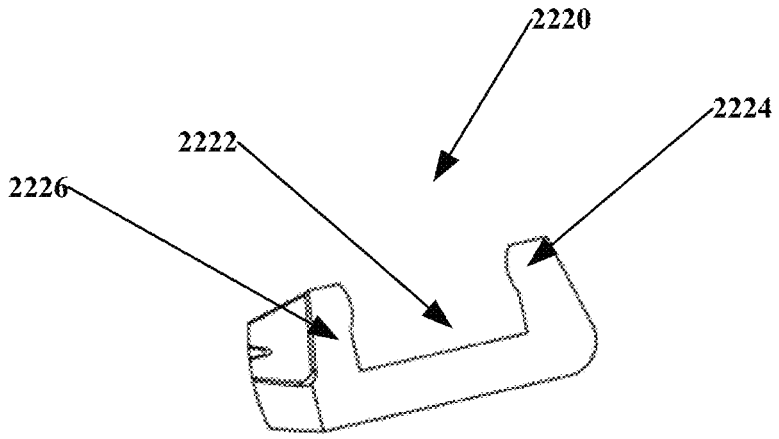
FIG. 16E shows a magnified view of section A of the arc as shown in FIG. 16D.

For example, this interaction may be shown with the arc 2200, see FIG. 16A for example, and the clips 2600 of the track, see FIGS. 20-22, wherein the length edge 3340 or edge width 3350 of a tile may be inserted into a recess or space between two arms. In an embodiment, the thickness of the flat tile 3300 may generally correspond to the recess or space between the two arms of another component, such as an arc 2200 or clip 2600 to provide a friction or pressure fit of the tile 3300 into the corresponding mating portion. For example, FIG. 22 shows the width edge 2050 of a tile 2000 inserted into a clip 2600. The same or similar connection may be possible with the flat tile 3300 and the clip 2600 (as well as the other tiles 100, 1500 disclosed herein).

Figure 30A:
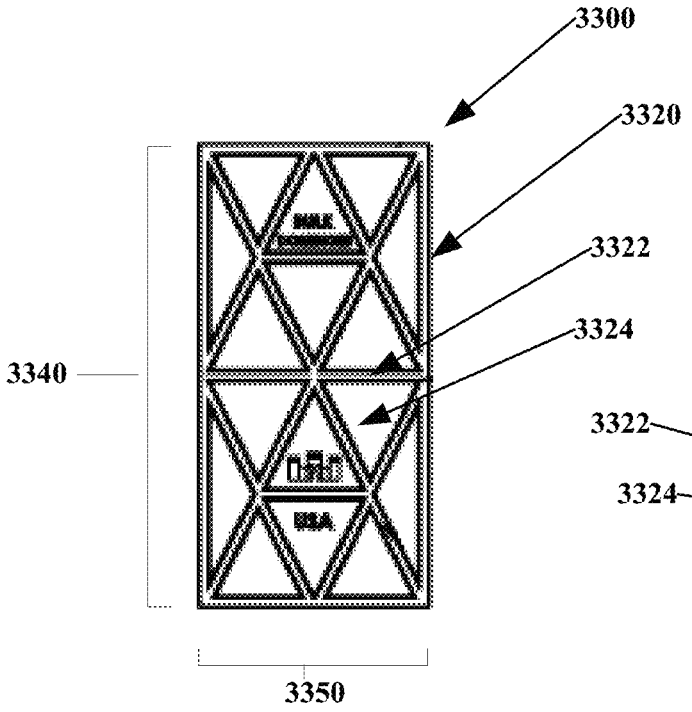
FIGS. 30A-D show an embodiment of a flat tile in a toy building system.
Figure 30B:
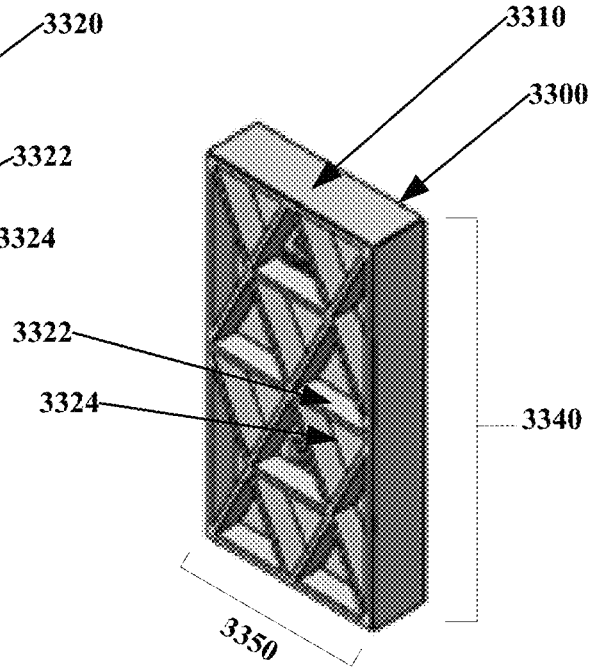
Figure 30C:
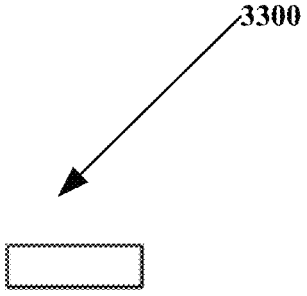
Figure 30D:
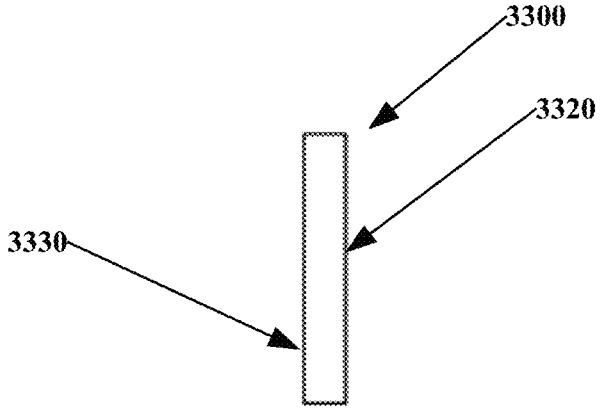

The first face 3320 of the flat tile 3300 may include at least one ridge 3322 and at least one recess 3324. The at least one ridge 3322 and at least one recess 3324 may form a pattern on the base plate 3310 of the flat tile 3300. In an embodiment, the pattern may be a triangular pattern. In an embodiment, the pattern may be a mirrored triangular pattern as shown in FIG. 30A. In an embodiment, at least one ridge 3322 and at least one recess 3324 may provide surface for stacking tiles on top of each other. In an embodiment, the at least one ridge 3322 and at least one recess 3324 allow multiple points of contact between other flat tiles 3300, interconnecting tiles 100, 2000, or other components of the toy building system for structure building. For example, the at least one ridge 3322 and at least one recess 3324 may generally correspond to the projection 2034 on the second face 2030 of the tile 2000, as shown in FIG. 14B, and may facilitate attachment between the two tiles 2000, 3300. In another embodiment, the at least one ridge 3322 and at least one recess 3324 may generally correspond to the first projection 2022 on the first face 2020 of the tile 2000 or the length edge or width edge of any of the tiles disclosed herein. In an embodiment, the flat tile 3300 may include multiple ridges and recesses that facilitate selective attachment to any of the tiles and systems disclosed herein.

Figure 31:
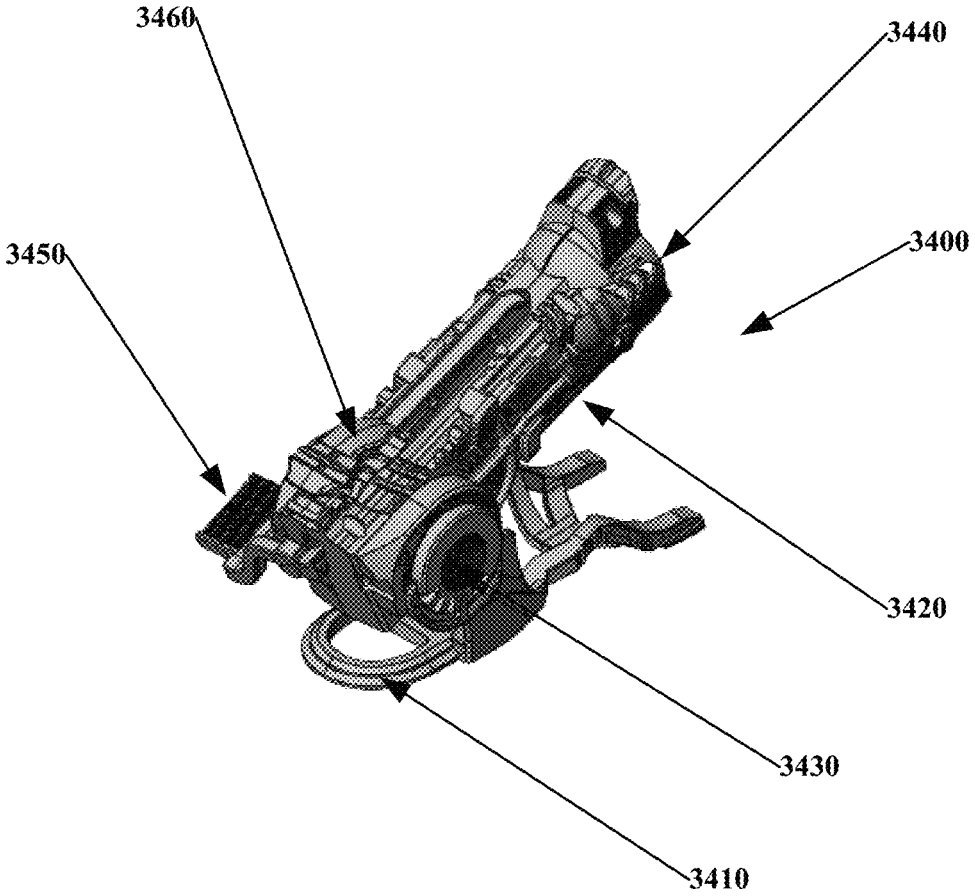
FIG. 31 shows an embodiment of a launcher.
Figure 32A:
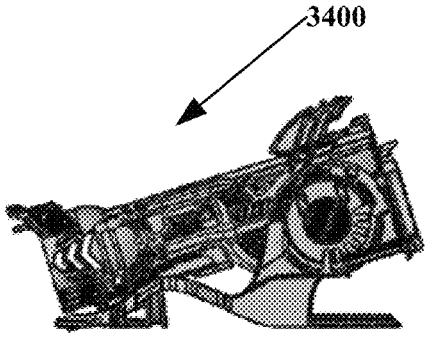
Figure 32B:
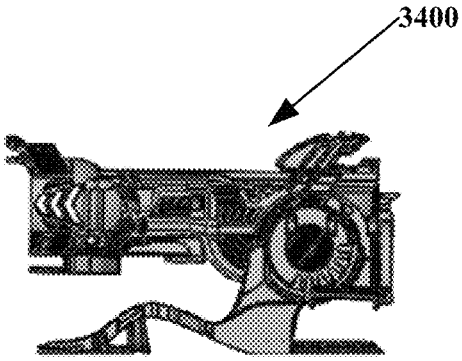
Figure 32C:
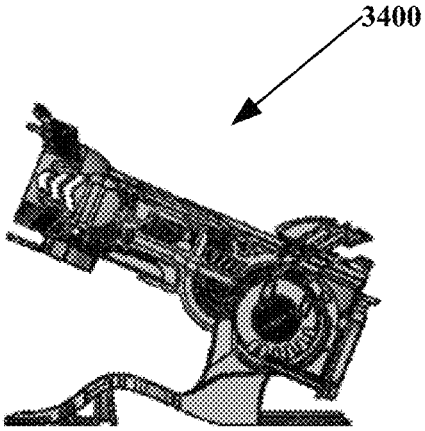
Figure 32D:
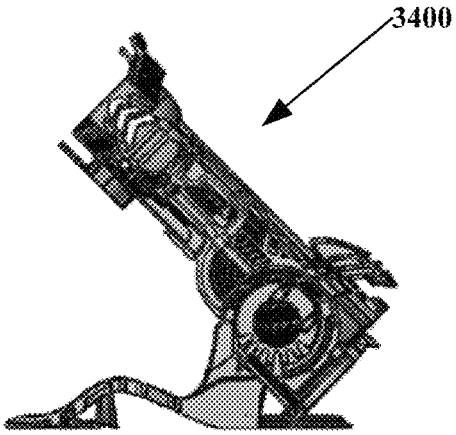
Figure 34E:
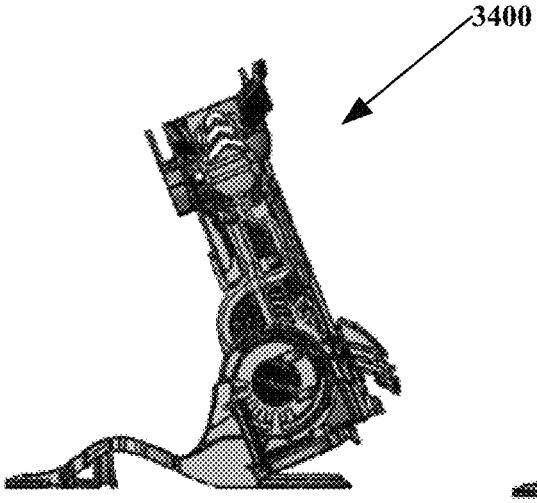
Figure 34F:
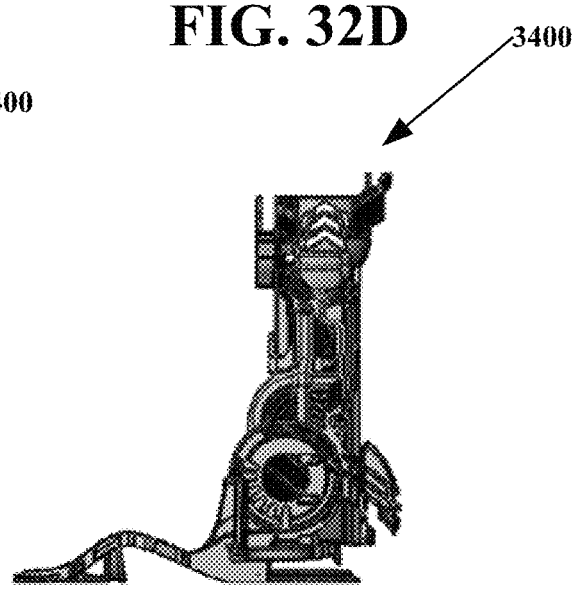

FIGS. 31 and 32-F show an embodiment of a launcher 3400. The launcher may include a stand 3410, a barrel 3420, and a rotatable cog 3430. In an embodiment, the rotatable cog 3430 biases the barrel 3452 on the stand 3410 to provide numerous different angular configurations, such as those shown in FIGS. 32A-F. In an embodiment, the barrel 3420 may be rotated by the rotatable cog 3430 over 180°, including from a position shown in FIG. 32A, to a similar mirrored position over 180° around an axis defined by the rotatable cog 3430. In an embodiment, the barrel 3420 may have a range of rotation of up to 270°. In an embodiment, the launcher includes at least 6 different angles including those shown in FIGS. 32A-F. The barrel 3452 may lock or snap in each angular position on the stand 3410, or the barrel 3452 may be tensioned to allow the barrel 3452 to remain in its placed position on the stand 3410.

The launcher may further include a loader and retention lane 3440. The loader and retention lane 3440 is configured to hold and retain a projectile. In an embodiment, the projectile may be a ball. In an embodiment, the projectile may be a ping pong ball, a bouncy ball, a tennis ball, a Styrofoam ball, and the like. The projectile may be inserted into the loader and retention lane 3440, where the projectile reaches a stop point within the loader and retention lane 3440. In an embodiment, the loader and retention lane 3440 may generally be a hollow tube or barrel that is approximately the size of the projectile. When the projectile is pushed through the loader and retention lane 3440, the projectile may rest at the back of the hollow tube or barrel until launched or the projectile may be secured into position by, in an example, an arm that extends into the path of the loader and retention lane 3440. In another embodiment, magnets may be used to retain the ball within the loader and retention lane 3440. In some embodiments, the projectile may comprise a ping-pong ball that can be shot out to contact and knock down any of the tiles described above.

At this point, the projectile may be launched at any time, but will remain in the loader and retention lane 3440 until fired. In an embodiment, when the projectile is fired, it may be released through the same loader and retention lane 3440 to its target. The launcher may further include a lever 3450 and a pusher 3460. In an embodiment, the lever 3450, once engaged, may trip the pusher 3460, which then fires the projectile from the loader and retention lane 3440. The lever 3450 may also pull back the arm, magnet, or other retaining mechanism to allow release of the projectile back through the loader and retention lane 3440. In an embodiment, the pusher 3460 may be powered by a band. In an embodiment, the pusher 3460 may be powered by a rubber band.

In an embodiment, the lever 3450 may be selectively engaged or initiated by another component of the domino system, such as a tile, arc, line reactor, track, another launcher, etc. For example, a falling tile, arc, line reactor, or projectile may hit the lever 3450 which then may engage the pusher 3460 to launch the projectile. In an embodiment, a falling tile, arc, line reactor, or projectile may push the lever 3450 in a downward potion which then may engage the pusher 3460 to launch the projectile. The launched projectile may then interact with, engage, or initiate another component of the system, such as a tile, arc, line reactor, track, another launcher, etc. to continue the falling line.

Although the embodiments of the present teachings have been illustrated in the accompanying drawings and described in the foregoing detailed description, it is to be understood that the present teachings are not to be limited to just the embodiments disclosed, but that the present teachings described herein are capable of numerous rearrangements, modifications and substitutions without departing from the scope of the claims hereafter. The claims as follows are intended to include all modifications and alterations insofar as they come within the scope of the claims or the equivalent thereof.

What is claimed is:

1. A toy building system, comprising:

a plurality of tiles, wherein each tile includes at least one mating edge;

a plurality of clips, wherein each clip comprises a receiving portion configured to selectively receive the at least one mating edge of the tiles and further comprises an engagement portion; and a plurality of tracks, wherein each track comprises at least one receiving portion configured to selectively engage the engagement portion of the clips and further comprises connecting portions, wherein the connecting portions are configured to selectively connect the plurality of tracks, wherein the tracks are rotatable about an axis defined by the selective connection of the connecting portions and wherein the plurality of clips are rotatable about an axis defined by the selective engagement of the clips to the tracks, wherein the receiving portion of each clip includes a base, a first wall and a second wall extending from the base, and a receiving space between the first wall and the second wall.

2. The toy building system of claim 1, wherein the mating edge is a width edge.

3. The toy building system of claim 1, wherein selective attachment between the plurality of tiles and the plurality of clips is friction-fit.

4. The toy building system of claim 1, wherein the engagement portion of each clip includes more than one protrusions extending from the clip.

5. The toy building system of claim 4, wherein the receiving portion of each track includes a base, a first arm and a second arm extending from the base, and a receiving space between the first arm and the second arm.

6. The toy building system of claim 5, wherein the first arm and second arm each include a recess configured to selectively engage the more than one protrusions extending from each clip.

7. The toy building system of claim 6, wherein the selective engagement between the plurality of clips and plurality of tracks is snap-fit engagement.

8. The toy building system of claim 7, wherein the connecting portions of each track include a protrusion on a first end of the track and a recess on a second end of the track, wherein the protrusion of the first end of one track is configured to connect to the recess on the second end of another track.

9. The toy building system of claim 8, wherein the selective connection between the plurality of tracks is a snap-fit connection.

10. The toy building system of claim 9, wherein the connection between the plurality of tracks is rotatable by up to about 180°.

11. The toy building system of claim 10, wherein the plurality clips are rotatable from a first standing position to a second falling position.

12. The toy building system of claim 11, wherein transition of one clip from the standing to the falling positions causes subsequent clips to transition from the standing to the falling positions by contact through attached tiles.

13. A toy building system, comprising:

a plurality of tiles, wherein each tile includes at least one mating edge;

a plurality of clips, wherein each clip comprises a receiving portion configured to selectively receive the at least one mating edge of the tiles and further comprises an engagement portion; and a plurality of tracks, wherein each track comprises at least one receiving portion configured to selectively engage the engagement portion of the clips and further comprises connecting portions, wherein the connecting portions are configured to selectively connect the plurality of tracks, wherein the tracks are rotatable about an axis defined by the selective connection of the connecting portions and wherein the plurality of clips are rotatable about an axis defined by the selective engagement of the clips to the tracks, wherein a right angle track includes at least two receiving portions positioned at about a right angle from each other.

14. A toy building system, comprising:

a plurality of tiles, wherein each tile includes at least one mating edge;

a plurality of clips, wherein each clip comprises a receiving portion configured to selectively receive the at least one mating edge of the tiles and further comprises an engagement portion; and a plurality of tracks, wherein each track comprises at least one receiving portion configured to selectively engage the engagement portion of the clips and further comprises connecting portions, wherein the connecting portions are configured to selectively connect the plurality of tracks, wherein the tracks are rotatable about an axis defined by the selective connection of the connecting portions and wherein the plurality of clips are rotatable about an axis defined by the selective engagement of the clips to the tracks, wherein a first end of first track is configured to selectively connect to a second end of at least a second and a third track.

15. The toy building system of claim 14, wherein the second and the third tracks are adjacent or separated by an angle up to about 180°.

16. A toy building system, comprising:

at least two tiles, wherein each tile is configured to selectively attach to a corresponding clip, wherein each clip is configured to selectively and rotatably attach to a corresponding track, and wherein a plurality of tracks are configured to selectively and rotatably attach to each other, wherein the clips are rotatable from a first standing position to a second falling position, and wherein the tracks are rotatable by up to about 180° while maintaining the tile in the first standing position.

17. The toy building system of claim 16, wherein transition of one clip from the standing to the falling positions causes subsequent clips to transition from the standing to the falling positions by contact through attached tiles.

18. The toy building system of claim 17, wherein the clips are rotatable from a first falling position to a second standing position by tilting the toy building system backward in a direction of the standing position.

19. The toy building system of claim 16 further comprising at least one straight track and an additional clip, wherein the straight track is selectively attachable to at least one of the plurality of tracks wherein at least one of the additional clip is selectively attachable to the straight track.

* * * * *